US009593543B2

(12) United States Patent
Wright et al.

(10) Patent No.: US 9,593,543 B2
(45) Date of Patent: Mar. 14, 2017

(54) DRILL ROD HANDLING SYSTEM FOR MOVING DRILL RODS TO AND FROM AN OPERATIVE POSITION

(71) Applicant: LONGYEAR TM, INC., South Jordan, UT (US)

(72) Inventors: Christopher Allen Wright, North Bay (CA); Anthony Charles William Markham, Trout Creek (CA)

(73) Assignee: BLY IP INC., Salt Lake City, UT (US)

( * ) Notice: Subject to any disclaimer, the term of this patent is extended or adjusted under 35 U.S.C. 154(b) by 207 days.

(21) Appl. No.: 14/584,877

(22) Filed: Dec. 29, 2014

(65) Prior Publication Data

US 2015/0184473 A1 Jul. 2, 2015

Related U.S. Application Data

(60) Provisional application No. 61/921,830, filed on Dec. 30, 2013, provisional application No. 62/052,712, filed on Sep. 19, 2014.

(51) Int. Cl.

| | |
|---|---|
| ***E21B 19/15*** | (2006.01) |
| ***E21B 19/24*** | (2006.01) |
| ***E21B 19/20*** | (2006.01) |

(52) U.S. Cl.

CPC ..... *E21B 19/155* (2013.01); *E21B 19/20* (2013.01); *E21B 19/24* (2013.01)

(58) Field of Classification Search

CPC ..... E21B 19/20; E21B 19/155

See application file for complete search history.

(56) References Cited

U.S. PATENT DOCUMENTS

| | | | |
|---|---|---|---|
| 430,994 | A | 6/1890 | Ely |
| 621,293 | A | 3/1899 | Crass |

(Continued)

FOREIGN PATENT DOCUMENTS

| | | | |
|---|---|---|---|
| AU | 2008265945 | A1 | 12/2008 |
| AU | 2009/246461 | A1 | 11/2009 |

(Continued)

OTHER PUBLICATIONS

International Search Report and Written Opinion mailed Apr. 3, 2015 for Application No. PCT/US2014/072580, which was filed Dec. 29, 2014 (1st Named Inventor—Wright // Applicant—Longyear TM, Inc. //) (18 pages).

(Continued)

*Primary Examiner* — Shane Bomar

(74) *Attorney, Agent, or Firm* — Ballard Spahr LLP

(57) ABSTRACT

A drill head assembly for receiving a drill rod in an operative position. The drill head assembly has a chuck and cradle configured for movement between a first position and a second position. In the first position, the longitudinal axis of the chuck is substantially parallel to the longitudinal axis of a drill mast. In the second position, the longitudinal axis of the chuck is substantially perpendicular to the longitudinal axis of the drill mast. From the first position, the cradle is configured for sequential axial and then pivotal movement relative to the transverse axis to reach the second position, with pivotal movement being restricted until axial movement is completed. Drill rod handling systems having such drill head assemblies, and methods of using such drill head assemblies, are also disclosed.

19 Claims, 26 Drawing Sheets

(56) References Cited

U.S. PATENT DOCUMENTS

| | | | | |
|---|---|---|---|---|
| 712,253 | A | 10/1902 | Brown et al. | |
| 1,416,685 | A | 5/1922 | Bufford | |
| 2,633,045 | A | 3/1953 | Lurie | |
| 2,650,070 | A | 8/1953 | Lundeen | |
| 2,921,489 | A | 1/1960 | Schweitzer | |
| 2,928,301 | A | 3/1960 | Beeman et al. | |
| 2,933,961 | A | 4/1960 | Adams | |
| 2,989,880 | A | 6/1961 | Hesser et al. | |
| 3,196,717 | A | 7/1965 | Sheppard | |
| 3,880,024 | A | 4/1975 | Asada | |
| 3,892,140 | A | 7/1975 | Fox et al. | |
| 4,060,014 | A | 11/1977 | Turner, Jr. | |
| 4,079,640 | A | 3/1978 | Golden | |
| 4,212,212 | A | 7/1980 | Chandler et al. | |
| 4,221,269 | A | 9/1980 | Hudson | |
| 4,324,157 | A | 4/1982 | Soutsos | |
| 4,475,607 | A | 10/1984 | Haney | |
| 4,485,697 | A | 12/1984 | Heilhecker et al. | |
| 4,512,216 | A | 4/1985 | Callegari, Sr. et al. | |
| 4,604,922 | A | 8/1986 | Soutsos | |
| 4,683,962 | A | 8/1987 | True | |
| 4,694,712 | A | 9/1987 | Doss | |
| 4,765,401 | A | 8/1988 | Boyadjieff | |
| 4,843,924 | A | 7/1989 | Hauk | |
| 4,869,137 | A | 9/1989 | Slator | |
| 4,885,963 | A | 12/1989 | Nishikawa | |
| 4,895,056 | A | 1/1990 | Schulze-Beckinghausen | |
| 5,054,550 | A | 10/1991 | Hodge | |
| 5,060,542 | A | 10/1991 | Hauk | |
| 5,092,411 | A | 3/1992 | Hausherr et al. | |
| 5,207,128 | A | 5/1993 | Albright | |
| 5,320,021 | A | 6/1994 | Heintz | |
| 5,423,390 | A | 6/1995 | Donnally et al. | 175/85 |
| 5,435,213 | A | 7/1995 | Buck | |
| 5,458,454 | A * | 10/1995 | Sorokan | E21B 19/155 166/77.52 |
| 5,660,087 | A | 8/1997 | Rae | |
| 5,845,549 | A | 12/1998 | Bouligny | |
| 5,868,045 | A | 2/1999 | Hauk | |
| 5,931,231 | A | 8/1999 | Mock | |
| 5,941,324 | A | 8/1999 | Bennett | 175/85 |
| 6,070,500 | A | 6/2000 | Dlask et al. | |
| 6,082,225 | A | 7/2000 | Richardson | |
| 6,318,199 | B1 | 11/2001 | Buck | |
| 6,634,443 | B1 | 10/2003 | Paech et al. | 175/85 |
| 6,910,402 | B2 | 6/2005 | Drzewiecki | |
| 6,971,283 | B2 | 12/2005 | Belik | |
| 7,000,502 | B2 | 2/2006 | Belik | |
| 7,117,938 | B2 | 10/2006 | Hamilton et al. | |
| 7,188,547 | B1 | 3/2007 | West et al. | |
| 7,191,686 | B1 | 3/2007 | Angelle et al. | |
| 8,291,791 | B2 | 10/2012 | Light et al. | |
| 2002/0157823 | A1 | 10/2002 | Pietras et al. | |
| 2003/0177870 | A1 | 9/2003 | Neves et al. | |
| 2003/0221871 | A1 | 12/2003 | Hamilton et al. | |
| 2005/0072274 | A1 | 4/2005 | Hauk et al. | |
| 2006/0027047 | A1 | 2/2006 | Buck | |
| 2006/0053977 | A1 | 3/2006 | Hawkins | |
| 2006/0054331 | A1 | 3/2006 | Hawkins | |
| 2006/0179980 | A1 | 8/2006 | Pietras et al. | |
| 2006/0243490 | A1 | 11/2006 | Riel | |
| 2007/0017703 | A1 | 1/2007 | Belik | |
| 2008/0202812 | A1 * | 8/2008 | Childers | E21B 19/20 175/52 |
| 2008/0265945 | A1 | 10/2008 | Chang | |
| 2009/0238663 | A1 | 9/2009 | Littlely | |
| 2010/0083796 | A1 | 4/2010 | Nelson | |
| 2013/0037324 | A1 * | 2/2013 | Milivojevic | E21B 19/20 175/24 |
| 2014/0209382 | A1 * | 7/2014 | Smith | E21B 19/155 175/24 |

FOREIGN PATENT DOCUMENTS

| | | | |
|---|---|---|---|
| AU | 2009246458 | A1 | 11/2009 |
| AU | 2012/201534 | A1 | 4/2012 |
| CA | 2690398 | A1 | 12/2008 |
| CA | 2696269 | A1 | 3/2009 |
| CA | 2720969 | A1 | 11/2009 |
| CA | 2722523 | A1 | 11/2009 |
| CN | 1306859 | A | 8/2001 |
| CN | 1368592 | | 9/2002 |
| CN | 200975217 | | 11/2007 |
| CN | 200880104593 | | 7/2010 |
| DE | 29720465 | U1 | 1/1998 |
| DE | 20202396 | U1 | 6/2002 |
| EP | 1644608 | A1 | 4/2006 |
| JP | 62-156468 | | 7/1987 |
| JP | 2652808 | B2 | 9/1997 |
| JP | 2002194984 | | 7/2002 |
| JP | 2003-184471 | A | 7/2003 |
| JP | 2007062968 | | 3/2007 |
| JP | 2009250285 | | 10/2009 |
| NZ | 588426 | A | 7/2012 |
| NZ | 588759 | A | 7/2012 |
| WO | WO-98/26153 | A1 | 6/1998 |
| WO | WO-99/03646 | A1 | 1/1999 |
| WO | WO-99/06186 | A1 | 2/1999 |
| WO | WO-99/55728 | A2 | 11/1999 |
| WO | WO-03/033858 | A1 | 4/2003 |

OTHER PUBLICATIONS

Extended European Search Report issued on Dec. 18, 2015 for application EP 08798826.7, filed on Aug. 27, 2008 and published as EP 2183460 on May 12, 2010 (Applicant—Boart Longyear TM, Inc. // Inventor—Kruse) (7 pages).

Non Final Rejection dated Jan. 31, 2011 by the U.S. Patent and Trademark Office for U.S. Appl. No. 12/464,707 (Inventor—Trevor Lyndon Light et al) (24 pages.).

Notice of Allowance dated May 19,2011 by the U.S. Patent and Trademark Office for U.S. Appl. No. 12/464,707 (Inventor—Trevor Lyndon Light et al) (23 pages).

Issue Notification dated Aug. 10, 2011 from U.S. Appl. No. 12/464,707 filed May 12, 2009 (Inventor—Trevor Lyndon Light et al) (1 page).

Notice of Allowance was issued on Apr. 17, 2012 by the U.S. Patent and Trademark Office for U.S. Appl. No. 13/188,249, which was filed on Jul. 21, 2011 and published as US 2011-0271797 A1 on Nov. 10, 2011 (Inventor—Trevor Lyndon Light et al;) (5 pages).

Final Rejection was issued on Jan. 25, 2012 by the U.S. Patent and Trademark Office for U.S. Appl. No. 13/188,249, which was filed on Jul. 21, 2011 and published as US 2011-0271797 A1 on Nov. 10, 2011 (Inventor—Trevor Lyndon Light et al;) (5 pages).

Non Final Rejection was issued on Nov. 22, 2011 by the U.S. Patent and Trademark Office for U.S. Appl. No. 13/188,249, which was filed on Jul. 21, 2011 and published as US 2011-0271797 A1 on Nov. 10, 2011 (Inventor—Trevor Lyndon Light et al;) (12 pages).

Requirement for Restriction/Election dated Jan. 25, 2010 by the U.S. Patent and Trademark Office for U.S. Appl. No. 12/138,297 filed Jun. 12, 2008 (Inventor—Michel Armand Lauzon et al) (6 pages).

Non Final Rejection dated May 27, 2010 by the U.S. Patent and Trademark Office for U.S. Appl. No. 12/138,297 filed Jun. 12, 2008 (Inventor—Michel Armand Lauzon et al) (7 pages).

Final Rejection dated Nov. 9, 2010 by the U.S. Patent and Trademark Office for U.S. Appl. No. 12/138,297 filed Jun. 12, 2008 (Inventor—Michel Armand Lauzon et al) (7 pages).

Notice of Allowance dated Jan. 28, 2011 by the U.S. Patent and Trademark Office for U.S. Appl. No. 12/138,297 filed Jun. 12, 2008 (Inventor—Michel Armand Lauzon et al) (15 pages).

Notice of Allowance dated Apr. 15, 2011 by the U.S. Patent and Trademark Office for U.S. Appl. No. 12/138,297 filed Jun. 12, 2008 (Inventor—Michel Armand Lauzon et al) (8 pages).

Issue Notification dated Jul. 27, 2011 by the U.S. Patent and Trademark Office for U.S. Appl. No. 12/138,297 filed Jun. 12,2008

(56) References Cited

OTHER PUBLICATIONS and published as 2008-0307932-A1 on Dec. 18, 2008 (Inventor—Michel Armand Lauzon et al) (1 page).
Non Final Rejection dated Mar. 3, 2010 by the U.S. Patent and Trademark Office for U.S. Appl. No. 12/119,385 filed May 12, 2008(Inventor—Keith William Littlely) (15 page).
Notice of Allowance dated Sep. 24, 2010 by the U.S. Patent and Trademark Office for U.S. Appl. No. 12/119,385 filed May 12, 2008 (Inventor—Keith William Littlely) (4 page).
Issue Notification dated Nov. 23, 2010 by the U.S. Patent and Trademark Office for U.S. Appl. No. 12/119,385 filed May 12, 2008 (Inventor—Keith William Littlely) (1 page).
Requirement for Restriction/ Election mailed on Jan. 13, 2010 by the U.S. Patent and Trademark Office for U.S. Appl. No. 12/197,817 filed Aug. 25, 2008 and published as US-2009-0056931-A1 on Mar. 5, 2009 (Inventor—Christof Kruse et al) (Attorney Docket 36362. 0056U2) (6 pages).
Non Final Rejection issued on May 20, 2010 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (9 pages).
Requirement for Restriction/ Election dated Oct. 13, 2010 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (5 pages).
Final Rejection dated Jan. 21, 2011 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (7 pages).
Notice of Allowance dated Feb. 3, 2011 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (12 pages).
Notice of Allowance dated Apr. 21, 2011 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (6 pages).
Examination Report was issued on Sep. 12, 2012 by the Austrialian Patent Office for Austrailian Application No. 2012201534, which was filed on May 12, 2008 (Inventor—Trevor Lyndon Light et al) (2 Pages).
Office Action was issued on Sep. 11, 2012 by the Canadian Intellectual Property Office for Canadian Application no. 2720969, which was filed on Oct. 7, 2010 (Inventor—Trevor Lyndon Light et al) (4 Pages).
Notice of Allowance issued on Aug. 1, 2013 by the Canadian Intellectual Property Office for Canadian Application No. 2720969, which was filed on Oct. 7, 2010 (Inventor—Trevor Lyndon Light et al) (1Page).
First Office Action was issued on Dec. 5, 2012 by the State Intellectual Property Office of the People's Republic for Chinese Application No. 200980112940.7, which was filed on Oct. 12, 2010 (Inventor—Trevor Lyndon Light et al) (Original 10 Pages / Translated 3 Pages).
Second Office Action was issued on Aug. 21, 2013 by the State Intellectual Property Office of the Peoples Republic for Chinese Application No. 200980112940.7, which was filed on Oct. 12, 2010 (Inventor—Trevor Lyndon Light et al) (Original 3 Pages / Translated 3 Pages).
Notice of Allowance was issued on May 14, 2012 by the Canadian Intellectual Property Office for Canadian Application No. 2696269, which was filed on Aug. 27, 2008 (Inventor—Christof Kruse et al) (1 Page).
First Office Action was issued on May 3, 2012 by the State Intellectual Property Office of the People's Republic for Chinese Application No. 200880104693.9, which was filed on Aug. 27, 2008 and published as CN101790619A on Jul. 28, 2010 (Inventor—Christof Kruse, et al) (Original 3 Pages / Translated 5 Pages).
Second Office Action was issued on Jan. 30, 2013 by the State Intellectual Property Office of the People's Republic for Chinese Application no. 200880104693.9, which was filed on Aug. 27, 2008 and published as CN101790619A on Jul. 28, 2010 (Inventor—Christof Kruse, et al) (Original 3 Pages / Translated 5 Pages).
Third Office Action was issued on Jul. 19, 2013 by the State Intellectual Property Office of the People's Republic for Chinese Application no. 200880104693.9, which was filed on Aug. 27, 2008 and published as CN101790619A on Jul. 28, 2010 (Inventor—Christof Kruse, et al) (Original 3 Pages / Translated 4 Pages).
Extended European Search Report was issued on Dec. 18, 2015 by the European Patent Office for Application No. 08798826.7, which was filed on Aug. 27, 2010 and published as 2183460 on May 12, 2010 (Inventor—Christof Kruse, et al) (7 Pages).
Notice of Allowance issued on Jun. 21, 2012 by the Canadian Intellectual Property Office for Canadian Application No. 2722523, which was filed on May 12, 2009 (Inventor—Keith William Littlely) (1Page).
First Office Action was issued on Dec. 5, 2012 by the State Intellectual Property Office of the People's Republic for Chinese Application No. 200980114772.5, which was filed on May 12, 2009 (Inventor—Keith William Littlely) (Original Pages / Translated 3 Pages).
Notice of Allowance issued on Jun. 12, 2012 by the Canadian Intellectual Property Office for Canadian Application No. 2690398, which was filed on Jun. 13, 2008 (Inventor—Michel Armand Lauzon et al) (1Page).
International Search Report and Written opinion mailed on Apr. 3, 2015 for Application No. PCT/US2014/072580, which was filed on Dec. 29, 2014 and published as US-2015-0184473-A1 on Jul. 2, 2015 (Inventor—Christopher Allen Wright) (18 Pages).
International Preliminary Report on Patentability dated Mar. 2, 2010 from International Patent Application No. PCT/US2008/074499 filed Aug. 27, 2008 (Inventor—Christof Kruse et al) (4 pages).
Written Opinion dated Jan. 21, 2009 from International Patent Application No. PCT/US2008/074499 filed Aug. 27, 2008 (Inventor—Christof Kruse et al) (4 pages).
International Search Report dated Nov. 19, 2009 from International Patent Application No. PCT/US2009/043628 filed May 12, 2009 and published as WO2009/140278-A1 on Nov. 19, 2009 (Inventor—Keith William Littlely) (3pages).
Written Opinion dated Nov. 12, 2010 from International Patent Application No. PCT/US2009/043628 filed May 12, 2009 and published as WO2009/140278-A1 on Nov. 19, 2009 (Inventor—Keith William Littlely) (5pages).
International Preliminary Report on Patentability dated Nov. 17, 2010 from International Patent Application No. PCT/US2009/043628 filed May 12, 2009 and published as WO2009/140278-A1 on Nov. 19, 2009 (Inventor—Keith William Littlely) (6 pages).
International Search Report dated Dec. 23, 2008 from International Patent Application No. PCT/US2008/067007 filed Jun. 13,2008 and published as WO2008/157424 on Nov. 24, 2011 (Inventor—Michel Armand Lauzon et al) (10 pages).
International Preliminary Report on Patentability dated Dec. 17, 2009 from International Patent Application No. PCT/US2008/067007 filed Jun. 13,2008 and published as WO2008/157424 on Nov. 24, 2011 (Inventor—Michel Armand Lauzon et al) (7 pages).
Written Opinion dated Dec. 15, 2009 from International Patent Application No. PCT/US2008/067007 filed Jun. 13, 2008 and published as WO2008/157424 on Nov. 24, 2011 (Inventor—Michel Armand Lauzon et al) (6 pages).
International Search Report dated Jan. 5, 2010 as issued in International Application No. PCT/US2009/043633 filed May 12, 2009. (Inventor—Trevor Lyndon Light et al) (3 Pages).
International Preliminary Report on Patentability dated Nov. 17, 2010 as issued in International Application No. PCT/US2009/043633 filed May 12, 2009. (Inventor—Trevor Lyndon Light et al) (4 Pages).
Written Opinion dated Nov. 12, 2010 as issued in International Application No. PCT/US2009/043633 filed May 12, 2009. (Inventor—Trevor Lyndon Light et al) (3 Pages).

(56) References Cited

OTHER PUBLICATIONS www.scorpion.com Scorpion Oil Tools 400 series, 1 page.

* cited by examiner

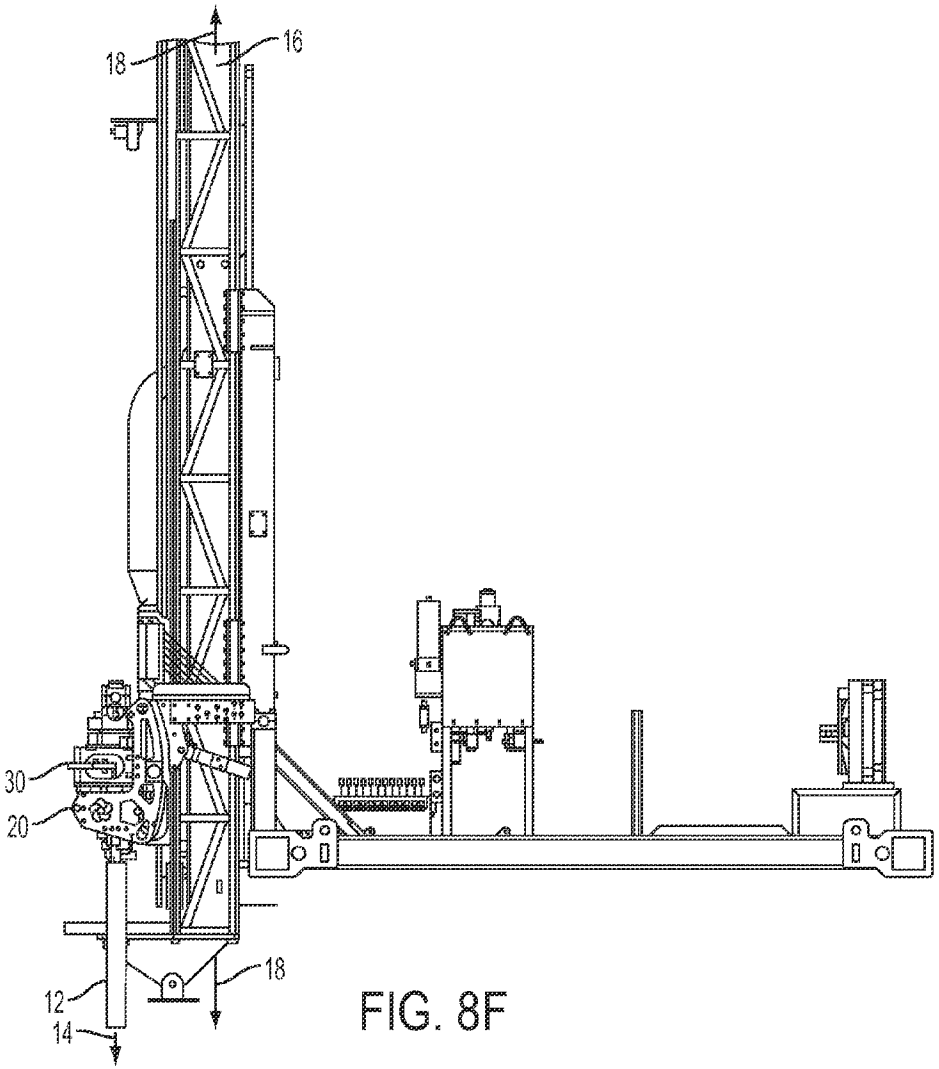
FIG. 8F
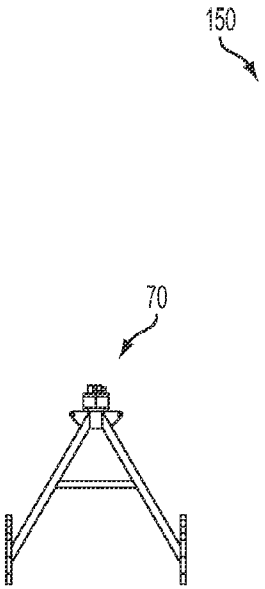

DRILL ROD HANDLING SYSTEM FOR MOVING DRILL RODS TO AND FROM AN OPERATIVE POSITION

CROSS-REFERENCE TO RELATED PATENT APPLICATIONS

This application claims priority to U.S. Provisional Patent Application No. 61/921,830, filed Dec. 30, 2013, and to U.S. Provisional Patent Application No. 62/052,712, filed Sep. 19, 2014, each of which is hereby incorporated herein by reference in its entirety.

FIELD

This invention relates to drill head assemblies for securing a drill rod in an operative position for drilling and rod handling operations. This invention further relates to loading devices for engaging a drill rod as it is secured to a drill head assembly.

BACKGROUND

Prior to drilling operations, a drill rod must be secured in the chuck of a drill head assembly. Conventionally, workers use their hands to support, lift, and/or rotate a drill rod in a position that allows the chuck to threadingly engage the drill rod. Typically, a worker threads a mainline hoist plug onto a new rod. As the rod is lifted by the hoist, the worker guides an end of the new rod over a previous rod in the hole, and the chuck is rotated by hand to engage the threads of the drill rod. The chuck is then repositioned and rotated to apply sufficient torque to the rod to make the joint. Ideally, the workers will stabilize the drill rod such that the drill rod does not rotate with the chuck but is advanced axially within the chuck. However, in practice, the workers supporting the drill rod often fail to prevent rotation of the drill rod, and the workers also regularly fail to maintain the drill rod in alignment with the chuck. These issues create inefficiency in the process of engaging the drill rod with the chuck and frequently lead to worker injuries.

Some conventional attempts at addressing these problems include floating devices, such as spline/spring assemblies, and hydraulic float devices, such as feed cylinder valves. Both of these attempts allow axial translation during rotation. However, splined floating devices are expensive and heavy and can add to the overall length of the drill head assembly. It is not always practical to apply the force required to compress the springs of these floating devices before threading and/or unthreading the joint. Furthermore, because the drill rod is not always oriented parallel to the feed cylinder, use of hydraulic float devices is not always possible.

Additionally, due to the complexity of conventional rod loaders and rod carousels/magazines, these rod loaders and rod carousels/magazines cannot be retrofit to existing drill systems in a cost-effective manner. Moreover, these existing products only work with particular drill head and/or drill mast geometries.

Thus, there is a need in the pertinent art for devices and systems that reduce manual drill rod handling during threading and unthreading of drill rod joints. There is a further need in the pertinent art for devices and systems that enhance the ergonomics, safety, and productivity in drill rod handling.

SUMMARY

Described herein is a drill head assembly for securing a drill rod in an operative position. The drill rod can have a longitudinal axis, and the drill head assembly can be operatively coupled to a drill mast. The drill mast can have a longitudinal axis. The drill head assembly can have a cradle configured for movement relative to both the longitudinal axis of the drill mast and a transverse axis substantially perpendicular to the longitudinal axis of the drill mast. The drill head assembly can also have a chuck operatively supported by the cradle. The chuck can have a longitudinal axis and define an opening. The opening of the chuck can be configured to securely receive a portion of the drill rod such that the longitudinal axis of the drill rod is substantially axially aligned with the longitudinal axis of the chuck. The cradle can be configured for movement between a first position and a second position. In the first position, the longitudinal axis of the chuck can be substantially parallel to the longitudinal axis of the drill mast. From the first position, the cradle can be configured for sequential axial and then pivotal movement relative to the transverse axis to reach the second position. In the second position, the longitudinal axis of the chuck can be substantially parallel to a surface of a drilling formation. When the drill hole is substantially vertical (with a longitudinal axis substantially parallel to the longitudinal axis of the drill mast), it is contemplated that, in the second position, the longitudinal axis of the chuck can be substantially perpendicular to the longitudinal axis of the drill mast (and the longitudinal axis of the drill hole). When the drill hole is angled relative to the longitudinal axis of the drill mast, it is contemplated that the longitudinal axis of the chuck can be positioned at a corresponding acute angle relative to the longitudinal axis of the drill hole. During movement of the cradle between the first and second positions, pivotal movement of the cradle can be restricted until the completion of axial movement relative to the transverse axis.

Also described is a loading device for engaging a drill rod moving relative to a translation axis. The loading device can have a base assembly having at least one proximal roller and at least one distal roller. The at least one proximal roller can be spaced from the at least one distal roller. The proximal and distal rollers can have respective longitudinal axes, and the longitudinal axes of the at least one proximal roller can be substantially parallel to the longitudinal axes of the at least one distal roller. The longitudinal axes of the proximal and distal rollers can be substantially perpendicular to the translation axis. The loading device can also have a support assembly secured to the base assembly. The support assembly can have at least one support roller, and each support roller of the at least one support roller can have a respective longitudinal axis. The longitudinal axes of the at least two support rollers can be substantially parallel. The longitudinal axes of the at least two support rollers can be substantially perpendicular to the translational axis and the longitudinal axes of the proximal and distal rollers. The loading device can also have a clamping assembly spaced from the support assembly relative to a transverse axis. The transverse axis can be substantially parallel to the longitudinal axes of the proximal and distal rollers. The clamping assembly can have at least one clamping roller configured for movement relative to the transverse axis between an open position and an engaged position. The proximal, distal, support, and clamping rollers can cooperate to define a receiving space. The receiving space can be configured to receive at least a portion of the drill rod. In the engaged position of the clamping roller, the proximal, distal, support, and clamping rollers can be positioned in engagement with the drill rod.

Alternatively, in additional aspects, the loading device can have a pair of spaced base assemblies (first and second base assemblies) and a clamping assembly. The first and second base assemblies can be spaced relative to a translation axis. The loading device can have a frame that is securely coupled to and positioned between the first and second base assemblies such that a longitudinal axis of the frame is substantially axially aligned with the translation axis. A carriage can be operatively coupled to the frame such that the carriage is configured for selective movement along the length of the frame relative to the translation axis. The carriage can support a vice assembly that defines a central space for receiving a portion of a drill rod. The vice assembly can be selectively adjusted to securely engage the drill rod. The frame can have a central opening extending substantially along the length of the frame. First and second shafts can be provided, with the first and second shafts being supported by the frame. Bearing blocks can be provided at the interface of the first and second shafts, the frame, and the first and second base assemblies. The first and second shafts can be supported by the frame such that the shafts are oriented substantially perpendicularly to the translation axis (and parallel to one another). A chain can be positioned over both shafts, thereby forming a closed chain loop containing both the first and second shafts. The chain can be operatively coupled to the first shaft such that rotation of the first shaft in a first direction effects advancement of the chain loop in a corresponding direction and the carriage is advanced toward the second shaft (and second base assembly) relative to the translation axis. The chain can also be operatively coupled to the first shaft such that rotation of the first shaft in an opposed, second direction effects advancement of the chain loop in a corresponding direction and the carriage is advanced toward the first shaft (and first base assembly) relative to the translation axis. The first shaft can be operatively coupled to a wheel, which is configured for rotation relative to a rotation axis and configured to selectively impart rotational motion to the first shaft.

Additionally, a loading device for selectively moving a drill rod relative to a translation axis is described. The loading device can be spaced from a drill head assembly and have a first base assembly, a second base assembly, a support platform and a driving assembly. The second base assembly can be spaced from the first base assembly relative to the translation axis. The support platform can extend between and be coupled to the first base assembly and the second base assembly. The support platform can have a longitudinal axis substantially parallel to the translation axis and be configured to support at least a portion of the drill rod as the drill rod is moved relative to the translation axis. The drilling assembly can have at least one driving roller, at least one drive assembly (e.g., a hydraulic drive assembly), and at least one guide roller. Each driving roller can have a respective longitudinal axis, and the longitudinal axis of each driving roller can be substantially perpendicular to the translation axis. Each driving roller can be configured for rotation about its longitudinal axis. Each drive assembly can be positioned in operative communication with a respective driving roller and can be configured for selective activation to selectively rotate a respective driving roller. Each guide roller can have a respective longitudinal axis, and the longitudinal axis of each guide roller can be substantially perpendicular to the translation axis and substantially parallel to the longitudinal axis of each respective driving roller. The at least one driving roller and the at least one guide roller can cooperate to define a receiving space that is configured to receive at least a portion of the drill rod. The at least one driving roller and the at least one guide roller can be configured for engagement with the drill rod when at least a portion of the drill rod is received within the receiving space. When at least a portion of the drill rod is received within the receiving space, rotation of the at least one driving roller in a first direction can be configured to advance the drill rod toward the drill head assembly.

A drill rod handling system including a loading device, a drill mast, and a drill head assembly is also described. Upon engagement between the loading device and the drill rod, the longitudinal axis of the drill rod can be substantially parallel to the translation axis. The loading device can be configured to permit movement of the drill rod relative to the translation axis but restrict rotation of the drill rod relative to the translation axis. The drill head assembly can be operatively coupled to the drill mast and configured to receive the drill rod from the loading device in an operative position.

Drilling methods performed using the disclosed drill rod handling system are also described. A drill rod can be engaged with the loading device, and the cradle of the drill head assembly can be moved between the first position and the second position. The drill rod can be advanced relative to the translation axis such that a portion of the drill rod is securely threaded onto a Kelly rod that is positioned in the opening of the chuck of the drill head assembly in the operative position.

Alternatively, the drill rod can be inserted directly into a head spindle of the chuck. For example, a drill rod receiving assembly as disclosed herein can be provided to receive the drill rod. The drill rod receiving assembly can have a longitudinal axis and be configured for positioning within a head spindle of a drill head such that the longitudinal axis of the drill rod receiving assembly is substantially aligned with a longitudinal axis of the head spindle. The head spindle can span between a gear box portion and a chuck portion of the drill head. The drill rod receiving assembly can have an elongate shaft and a receiving element. The elongate shaft can have a first end, an opposed second end, an inner surface, and an outer surface. The inner surface of the elongate shaft can define a bore extending between the first and second ends of the elongate shaft. The first end of the elongate shaft can define a first opening in communication with the bore. The second end of the elongate shaft can be configured for receipt within the chuck portion of the drill head. The receiving element can be configured for operative coupling to the gear box portion of the drill head and have a first end, an opposed inner surface, and an outer surface. The inner surface of the elongate shaft can define a bore extending between the first and second ends of the receiving element. The first end of the receiving element can define a first opening in communication with the bore. The second end of the receiving element can define a second opening in communication with the bore. At least a portion of the inner surface of the receiving element can be inwardly tapered moving from the first opening toward the second opening. The second end of the receiving element can be operatively coupled to the first end of the elongate shaft such that the second opening of the receiving element is substantially aligned and in communication with the first opening of the elongate shaft. Upon advancement of the drill rod from the first opening of the receiving element toward the second end of the elongate shaft, the inner surfaces of the receiving element and the elongate shaft can be configured to cooperate to guide the drill rod to a desired orientation in which a longitudinal axis of the drill rod is substantially parallel to the longitudinal axis of the head spindle.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein:

FIGS. 8A-8F depict the sequential movement of a drill head assembly relative to a loading device during securing of a drill rod to the drill head assembly as disclosed herein.

Figure 1:
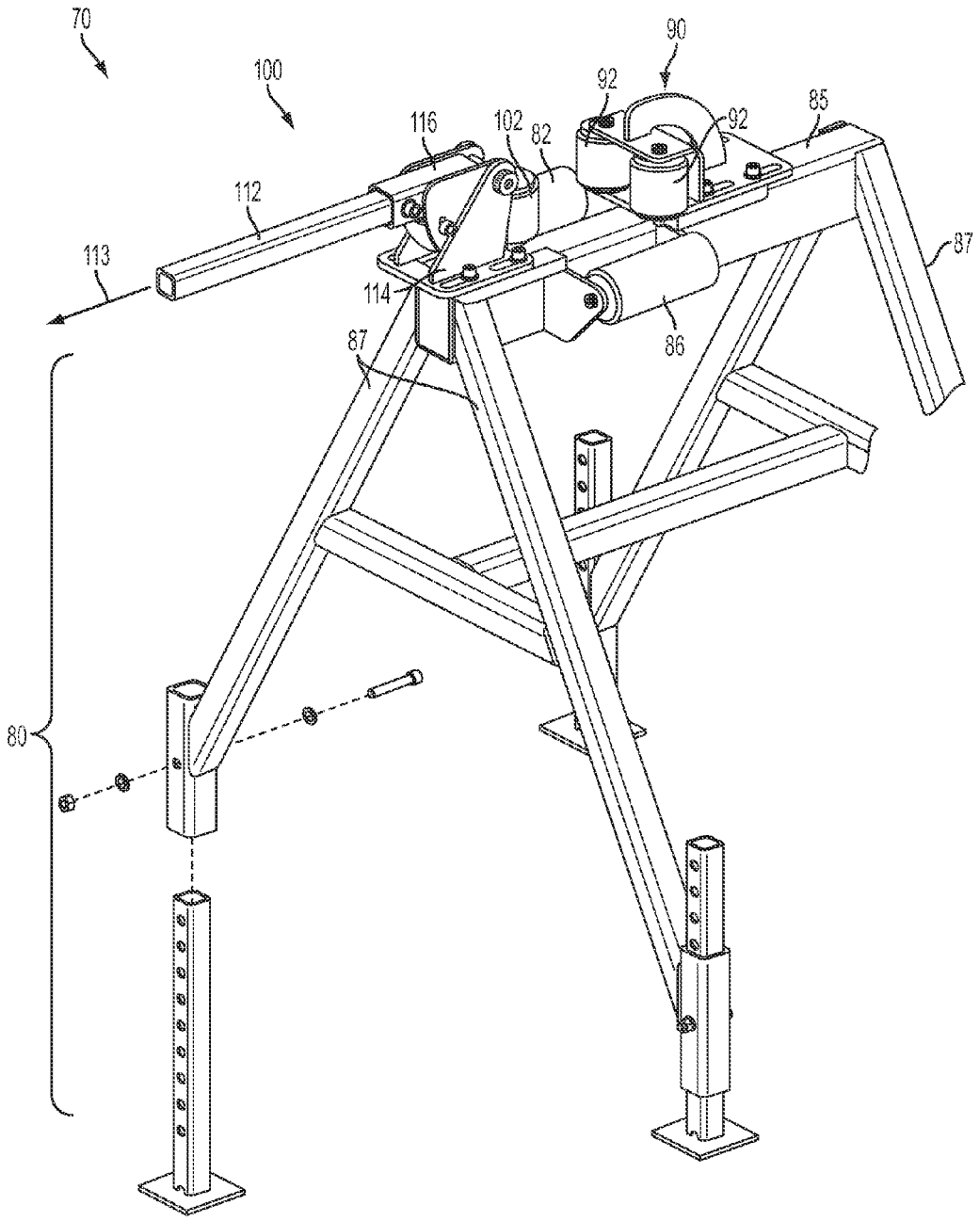
FIG. 1 depicts a perspective view of an exemplary loading device as disclosed herein.
Figure 2:
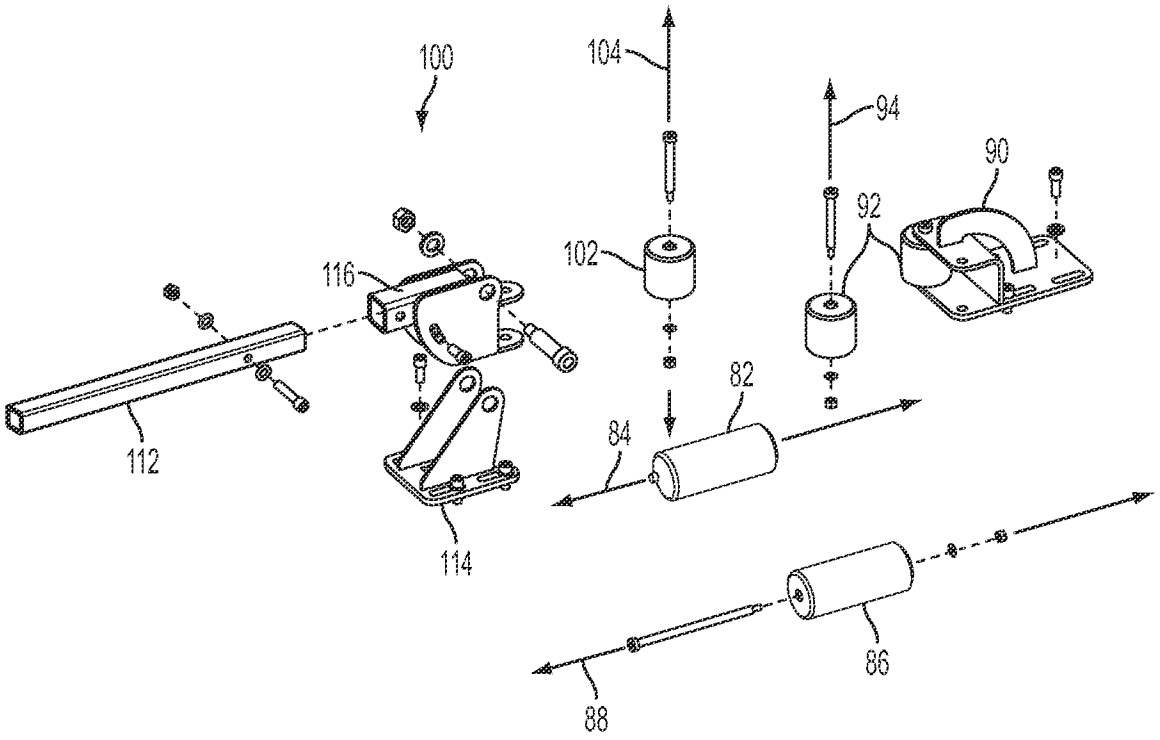
FIG. 2 depicts an exploded view of the clamping assembly of the loading device of FIG. 1.
Figure 3:
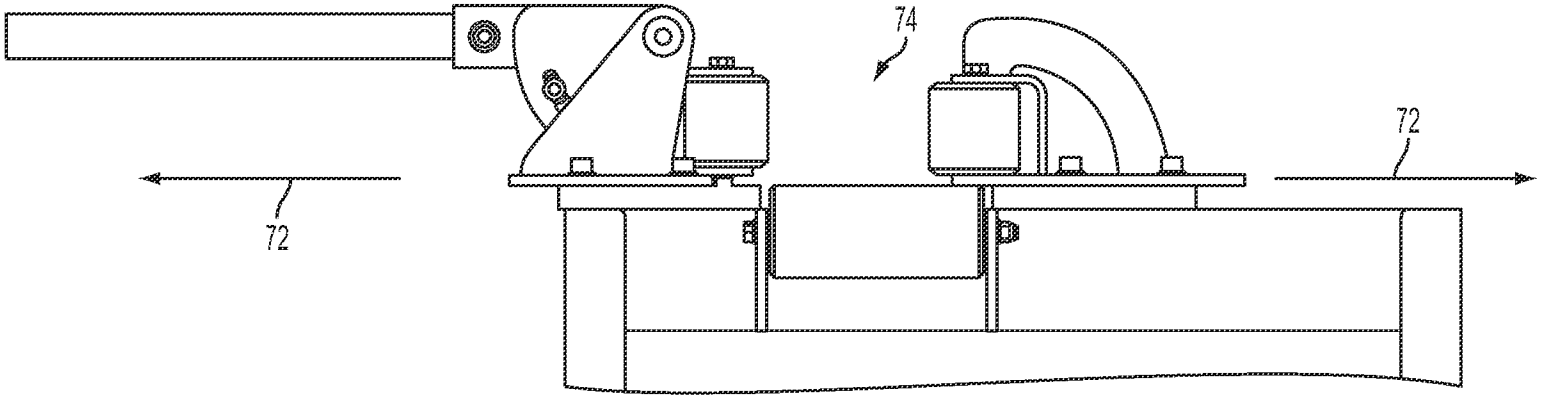
FIG. 3 depicts a front perspective view of an exemplary loading device as disclosed herein.
Figure 4:
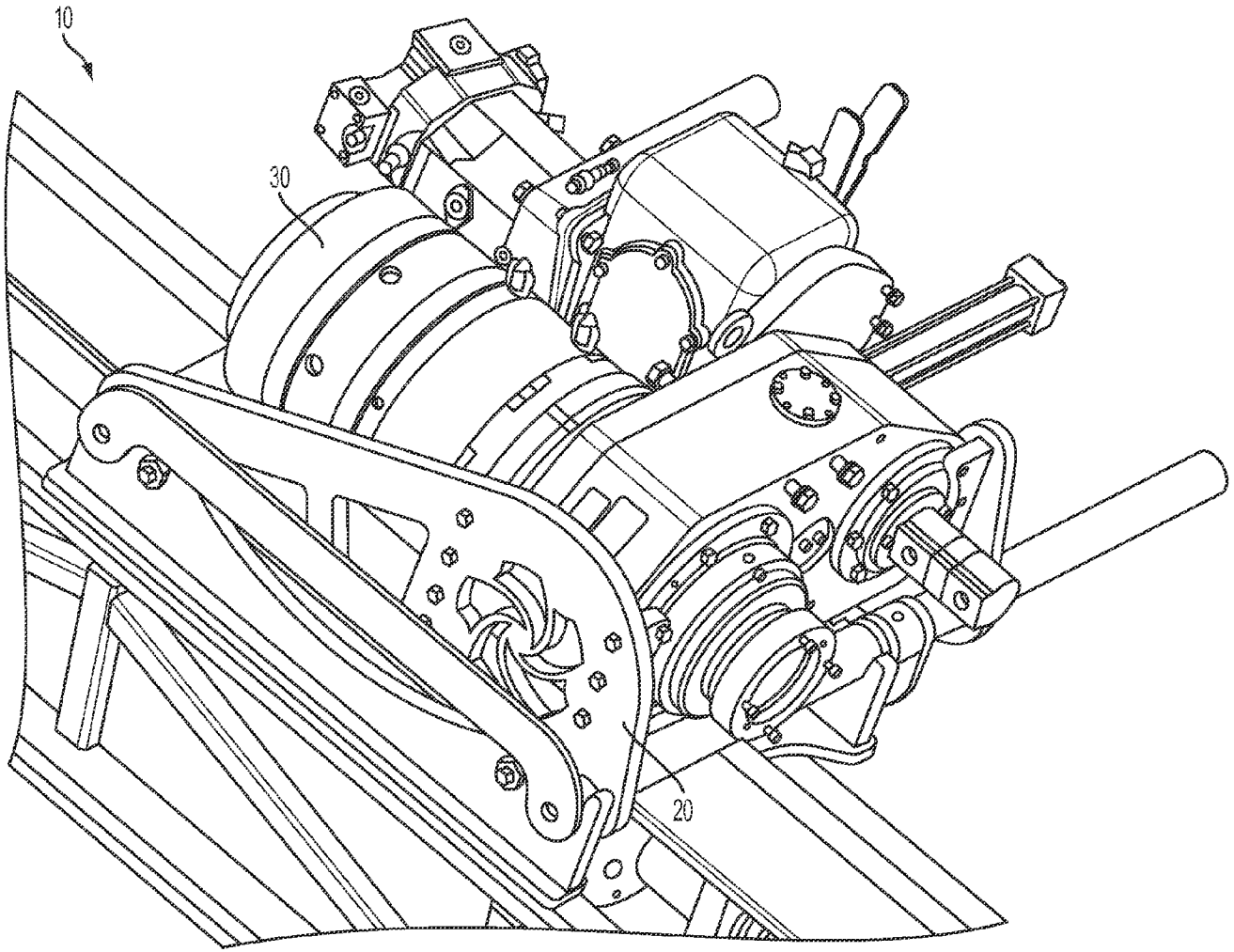
FIG. 4 depicts a perspective view of an exemplary drill head assembly as disclosed herein.
Figure 5:
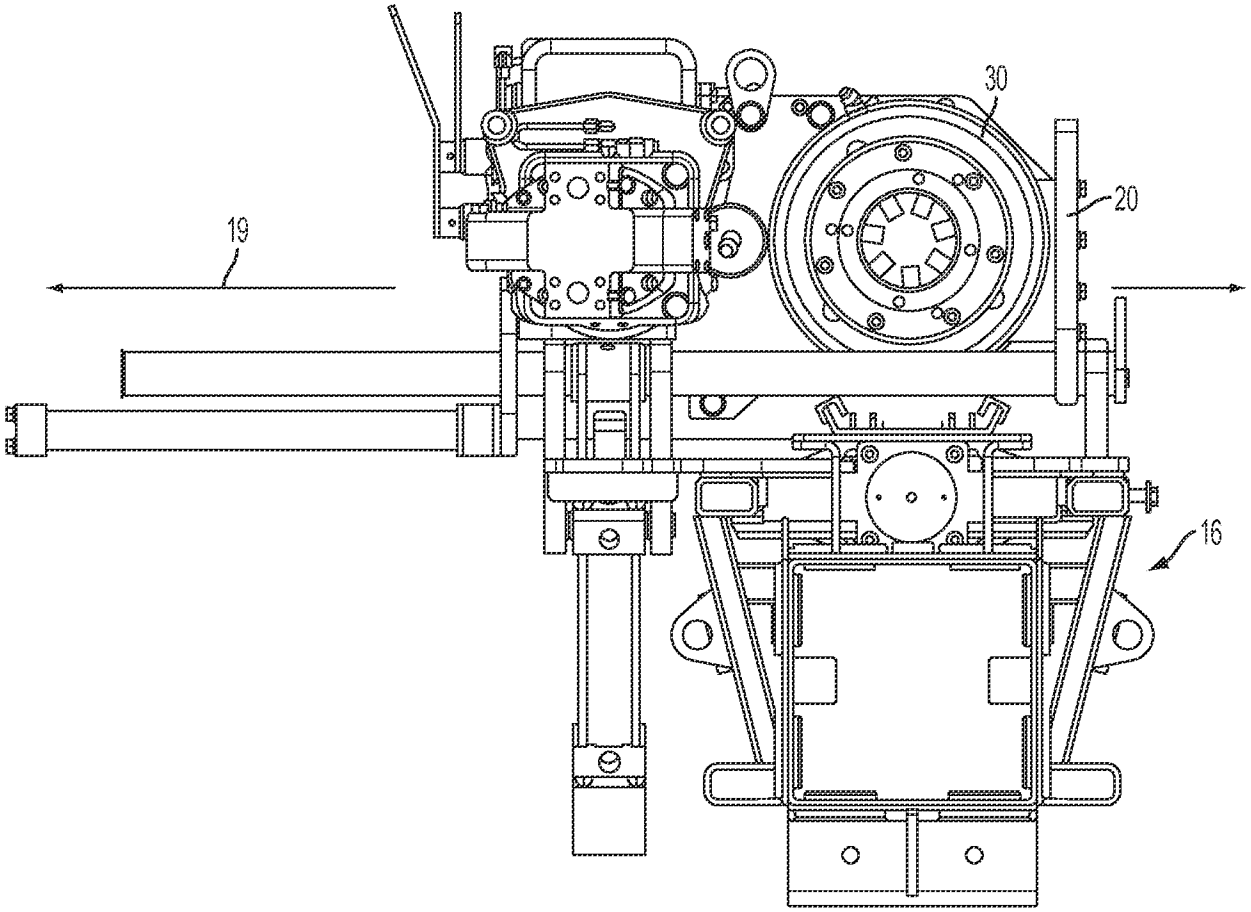
FIG. 5 depicts a top perspective view of the drill head assembly of FIG. 4.
Figure 6B:
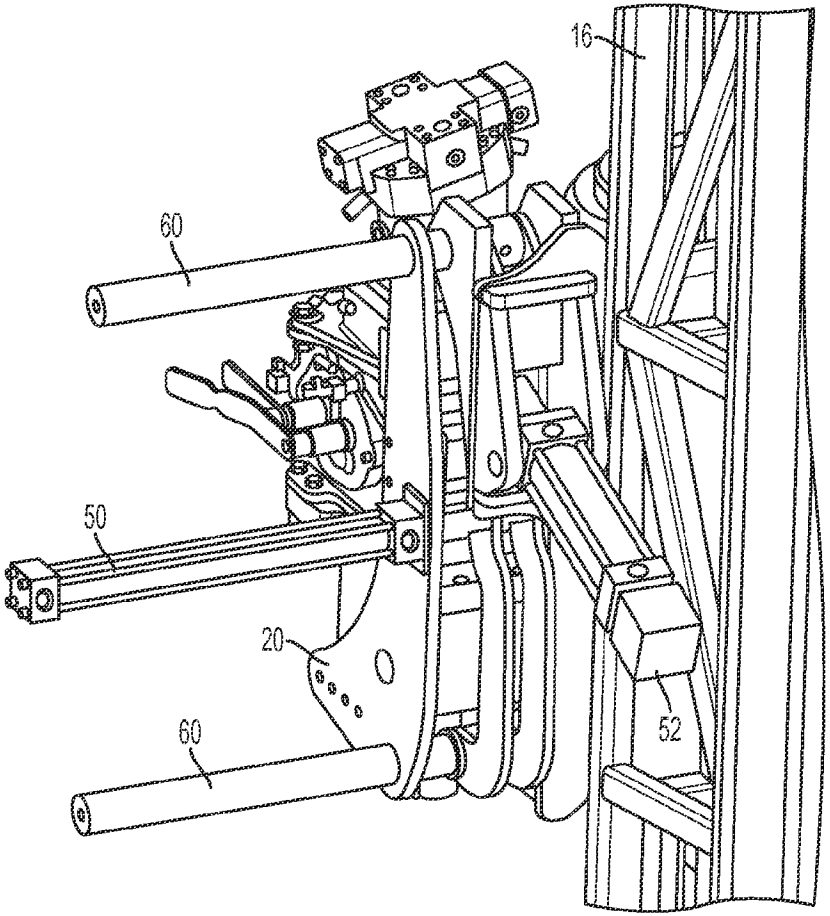
FIG. 6B is a back perspective view of the drill head assembly of FIG. 6A.
Figure 6A:
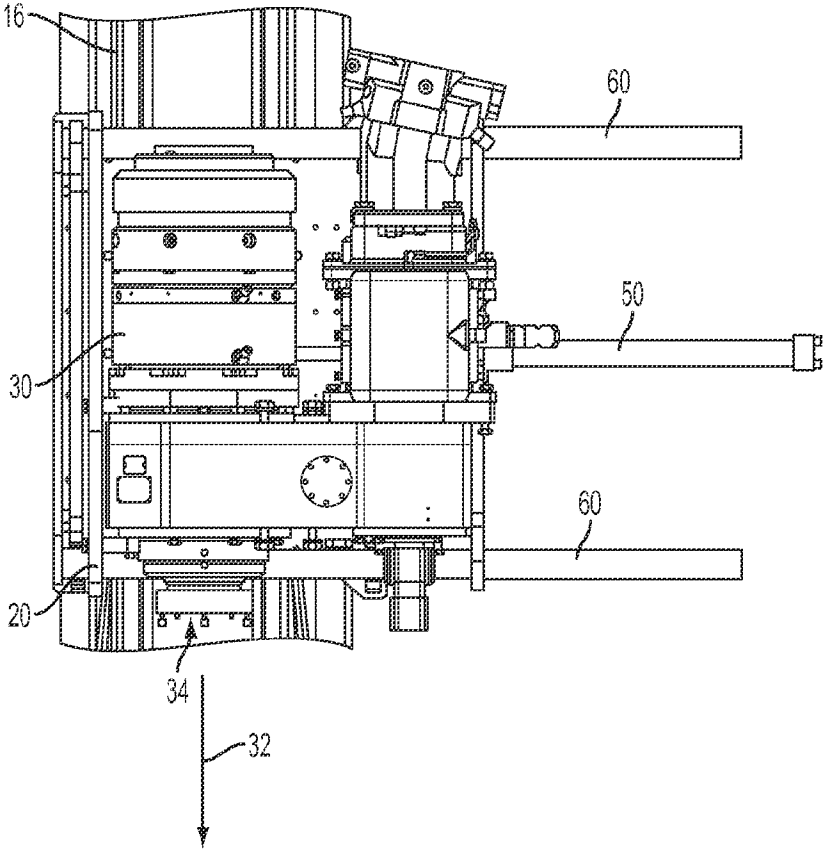
FIG. 6A depicts a front perspective view of an exemplary drill head assembly as disclosed herein.
Figure 7:
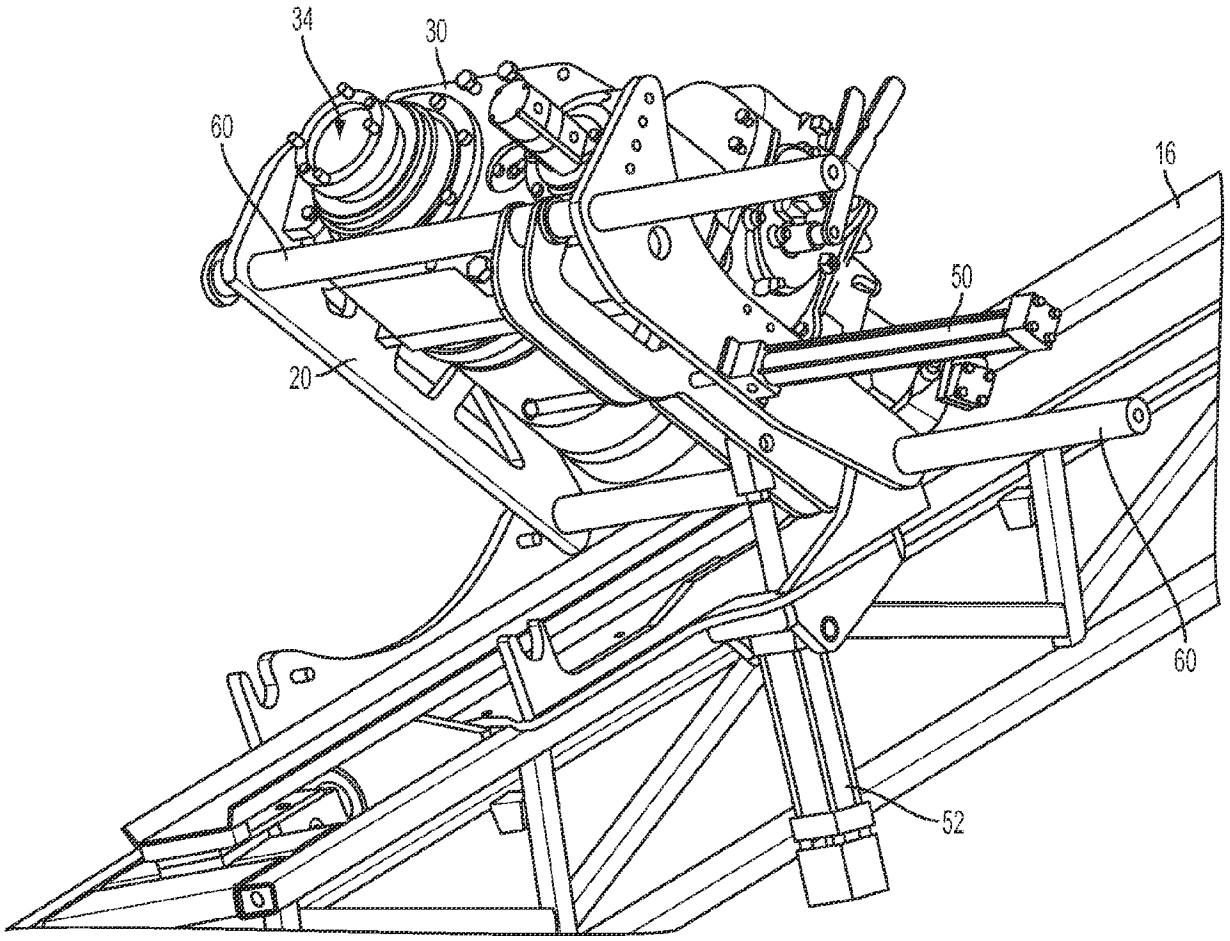
FIG. 7 depicts a perspective view of an exemplary drill head assembly during movement of the cradle between the first and second positions as disclosed herein.
Figure 8A:
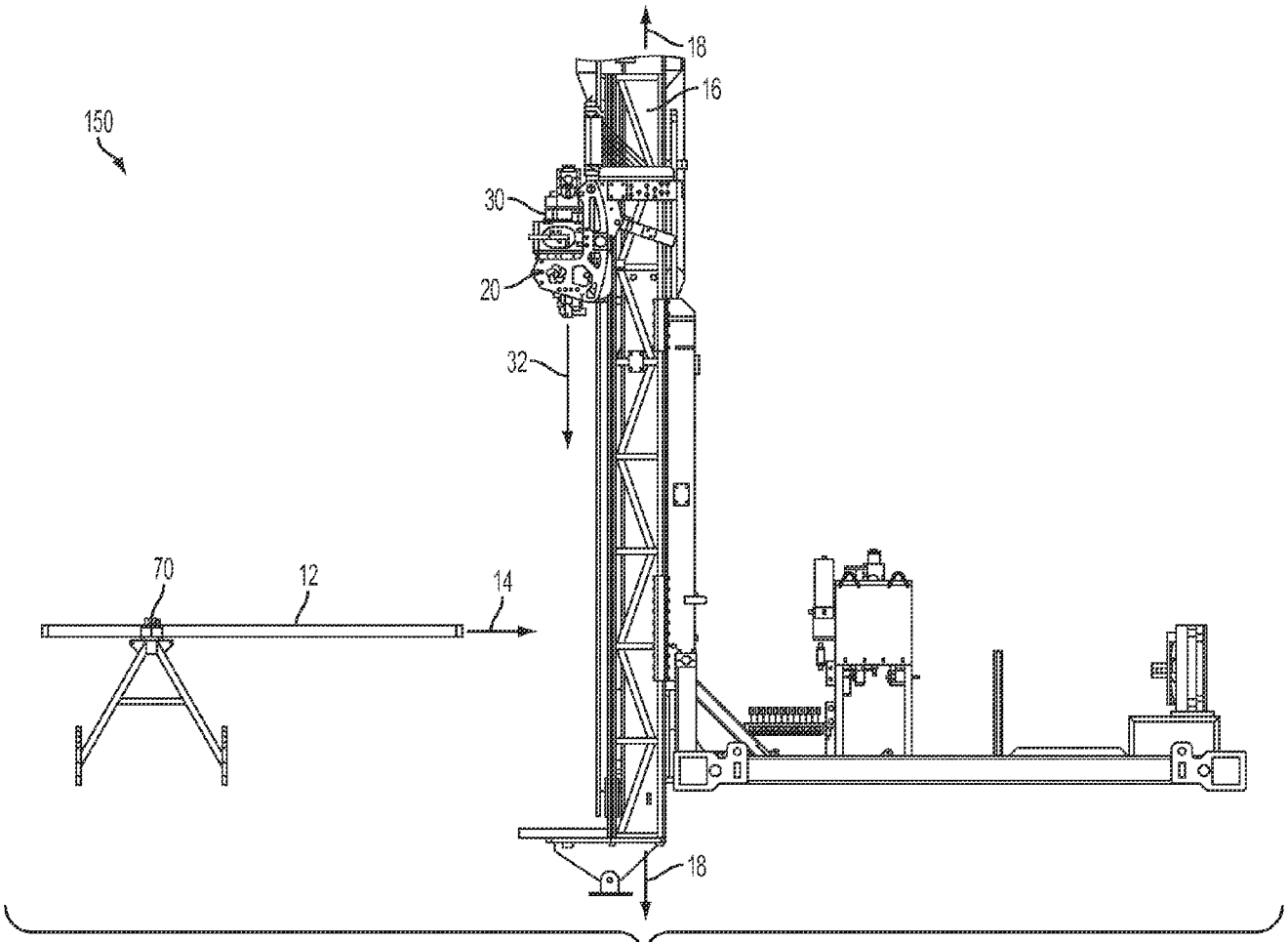
Figure 8B:
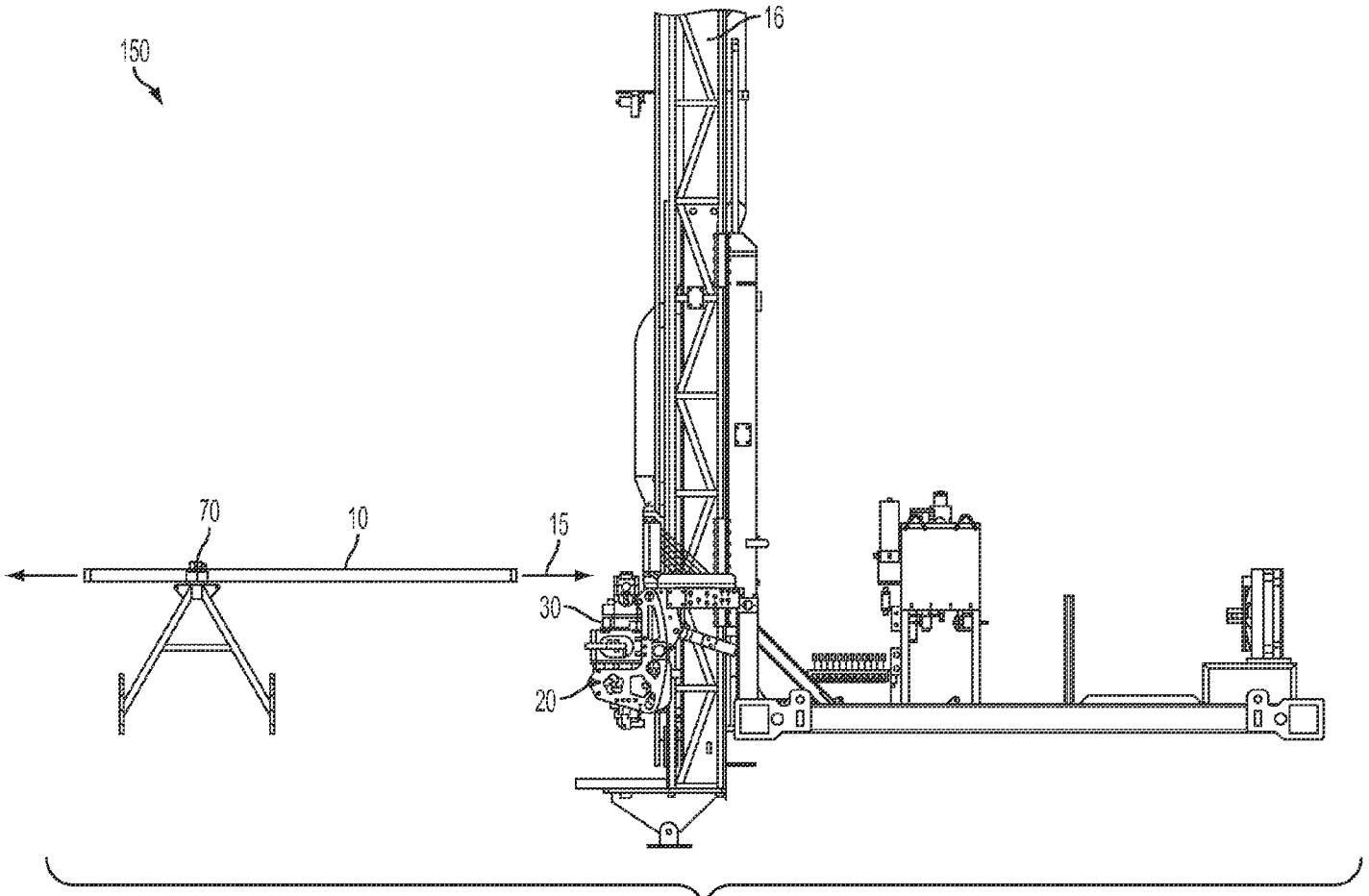
Figure 8C:
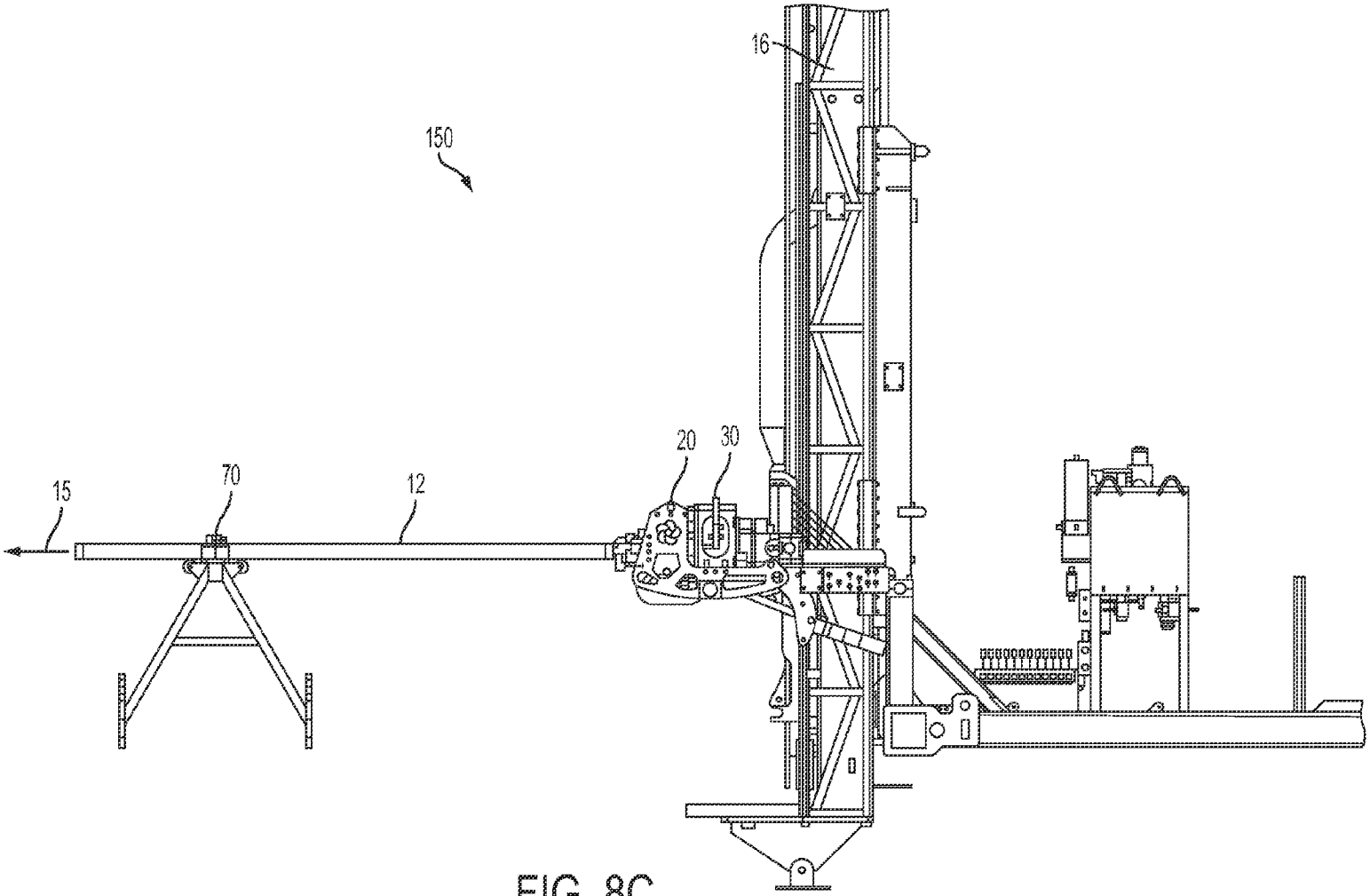
Figure 8D:
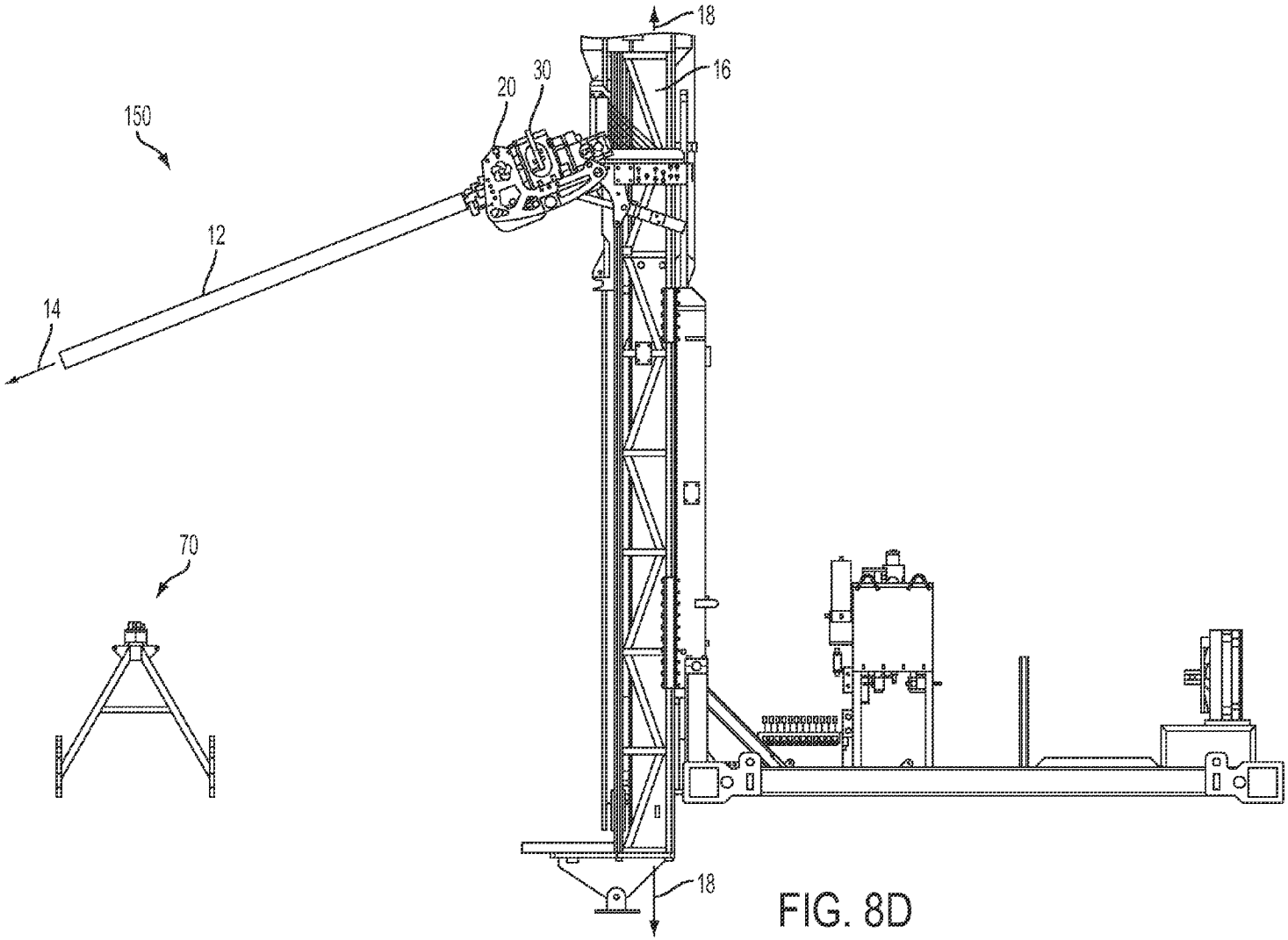
Figure 8E:
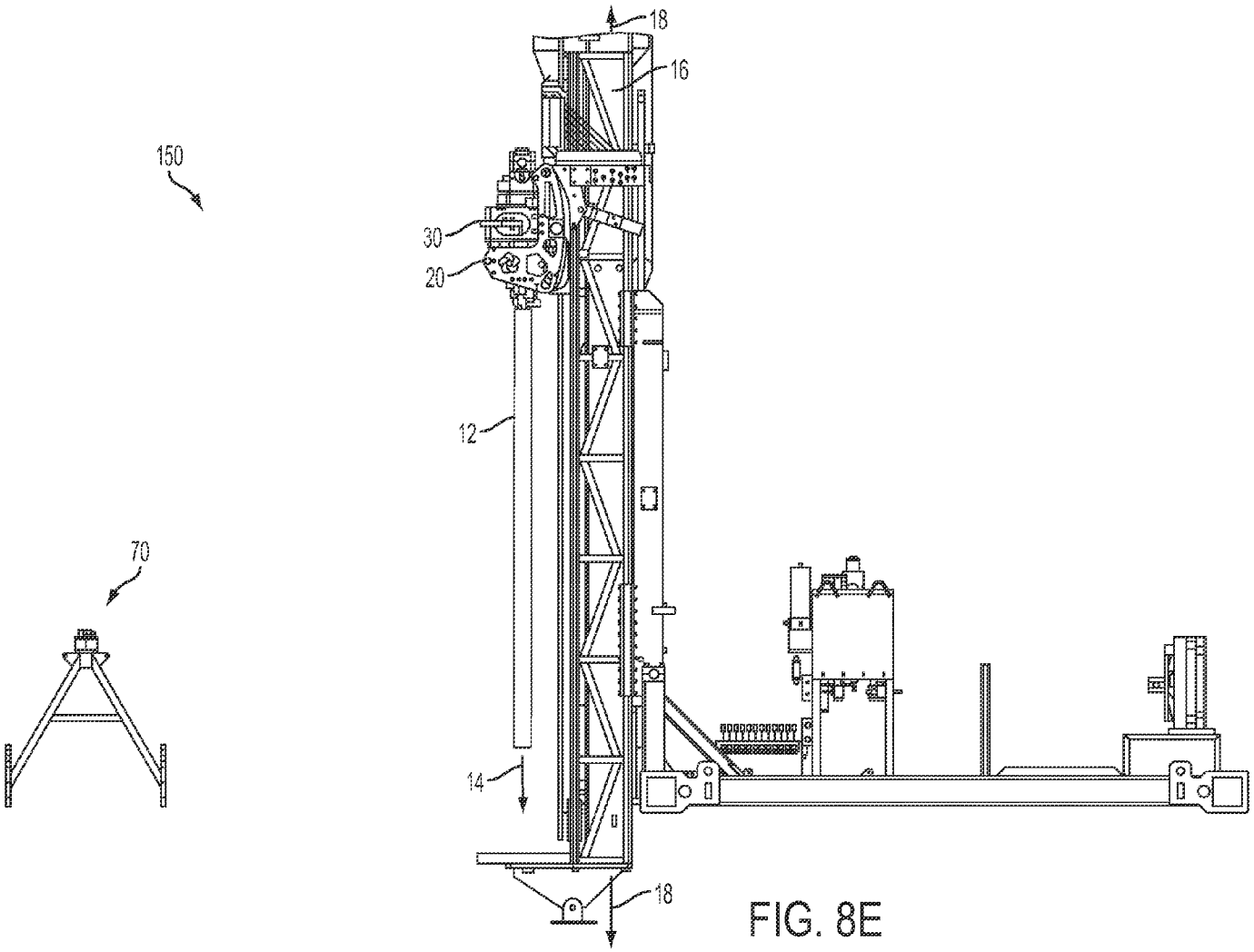

FIG. 8A depicts the drill head assembly prior to movement of the drill head assembly relative to the longitudinal axis of the drill mast. FIG. 8B depicts the drill head assembly in a first position, following movement of the drill head assembly relative to the longitudinal axis of the drill mast such that the drill head assembly is positioned proximate a drilling formation. FIG. 8C depicts the drill head assembly in a second position, following axial and then pivotal movement of the drill head assembly relative to a transverse axis (perpendicular to the longitudinal axis of the drill mast). As shown, in the second position, the drill head assembly can receive a drill rod supported by the loading device. FIG. 8D depicts axial movement of the drill head assembly relative to the longitudinal axis of the drill mast following engagement between the drill rod and the drill head assembly. FIG. 8E depicts the drill head assembly following pivotal and then axial movement of the drill head assembly relative to the transverse axis such that the drill rod is substantially parallel to the longitudinal axis of the drill mast. FIG. 8F depicts the drill head assembly in a drilling position, following axial advancement of the drill rod toward the drilling formation.

Figure 9:
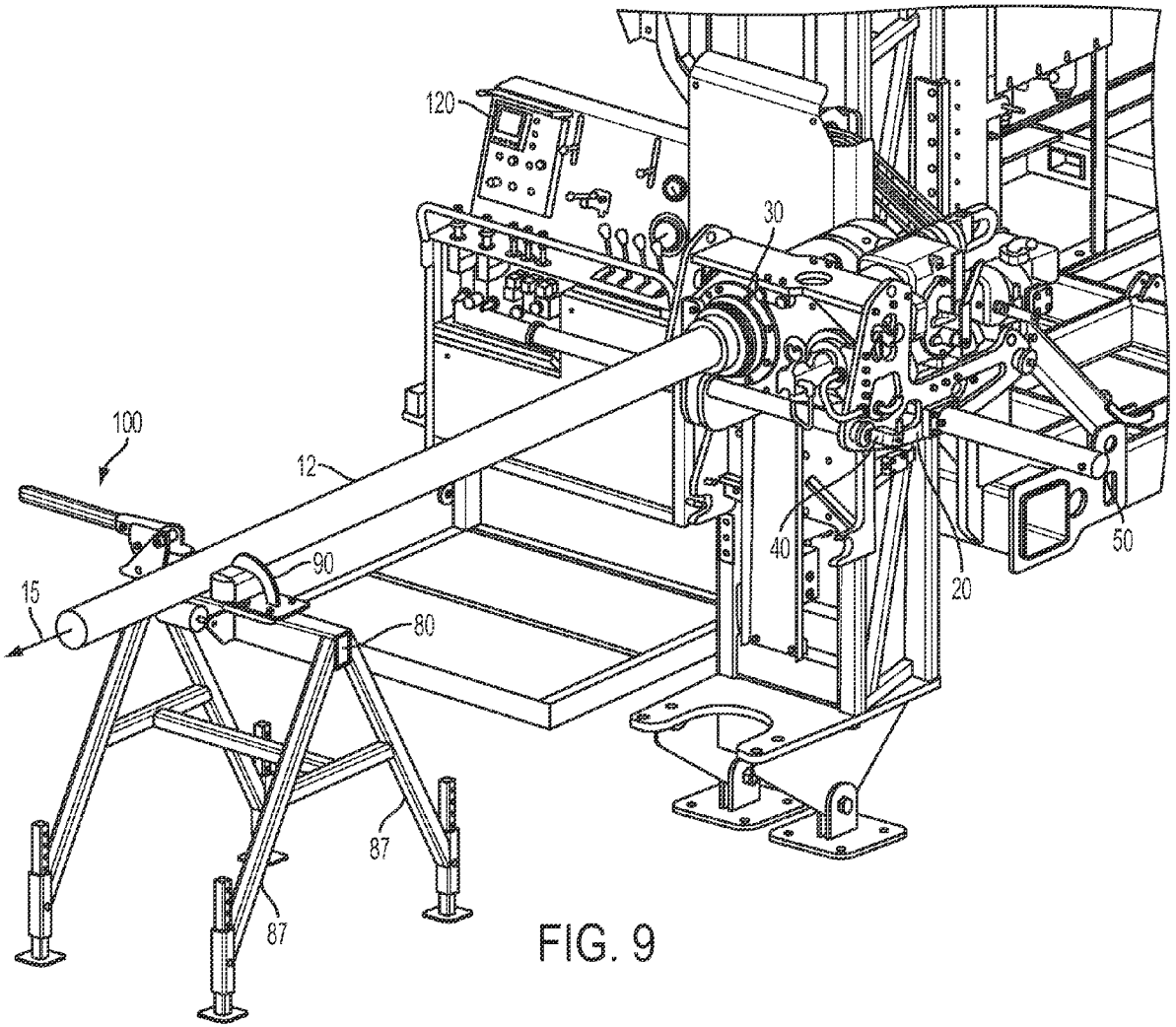

FIG. 9 is a right side perspective view of a drill rod handling system comprising a loading device and a drill head assembly as disclosed herein. As shown, the loading device can support a drill rod during engagement between the drill rod and the drill head assembly.

Figure 10:
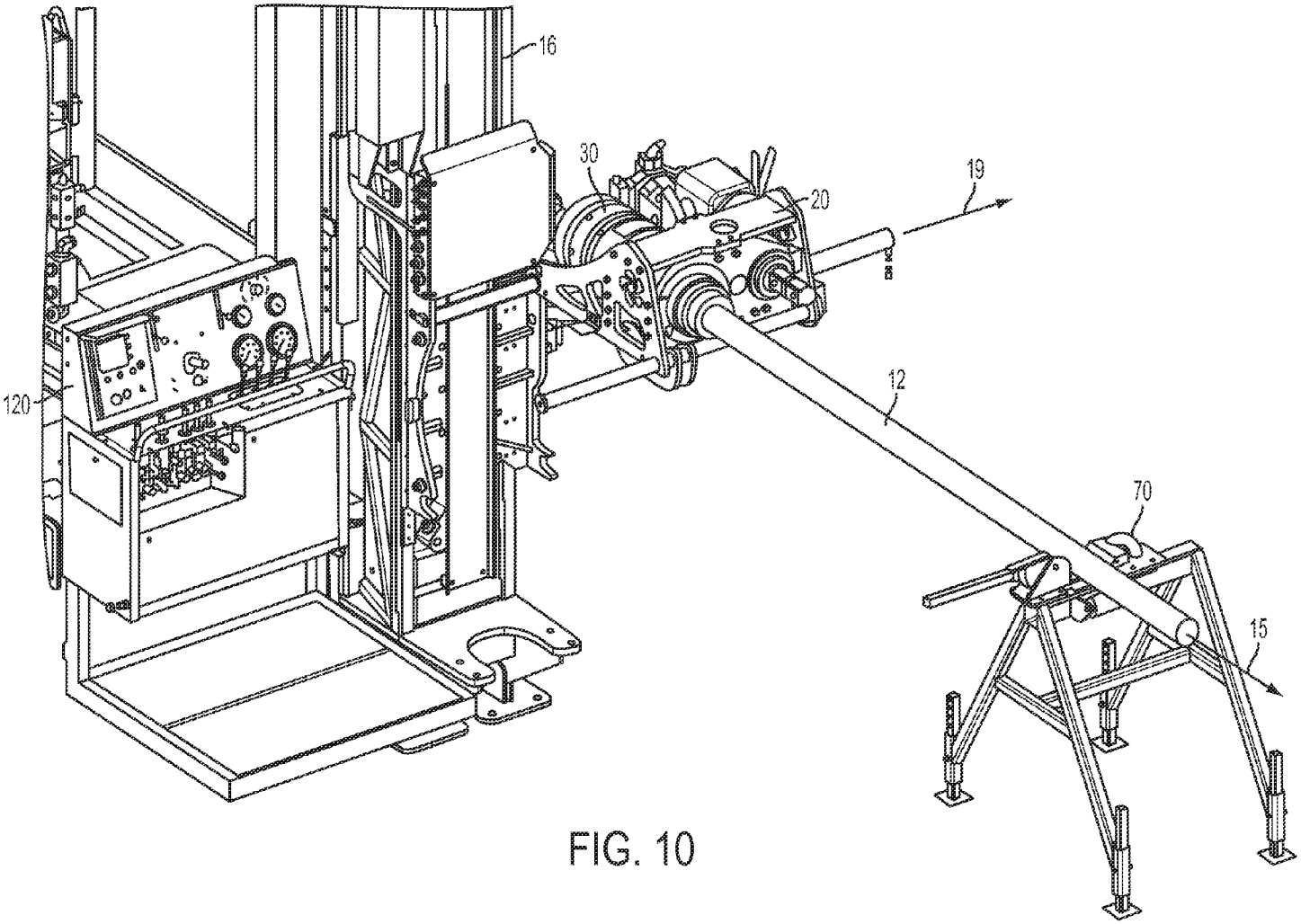

FIG. 10 is a left side perspective view of the drill rod handling system of FIG. 9.

Figure 11A:
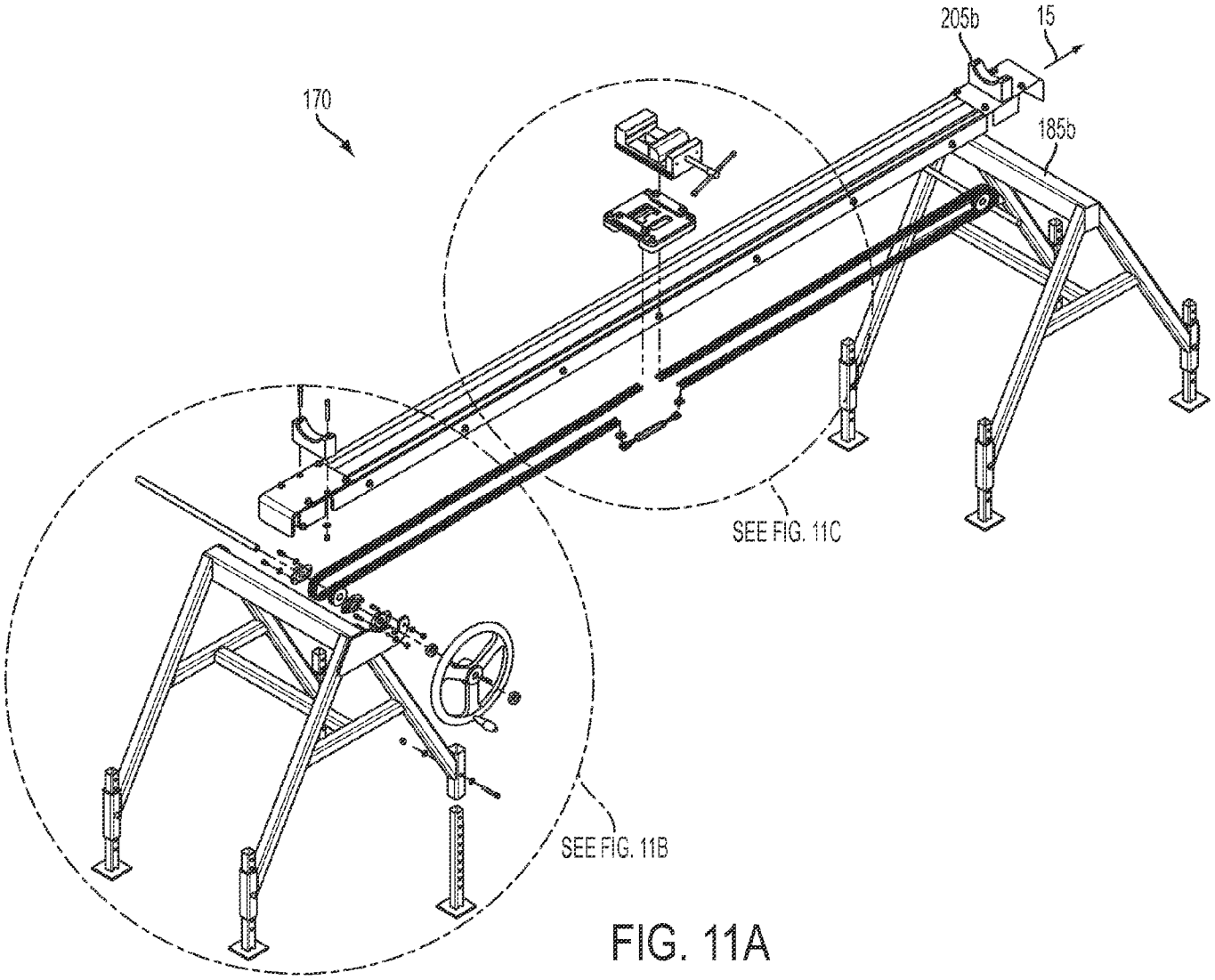
Figure 11B:
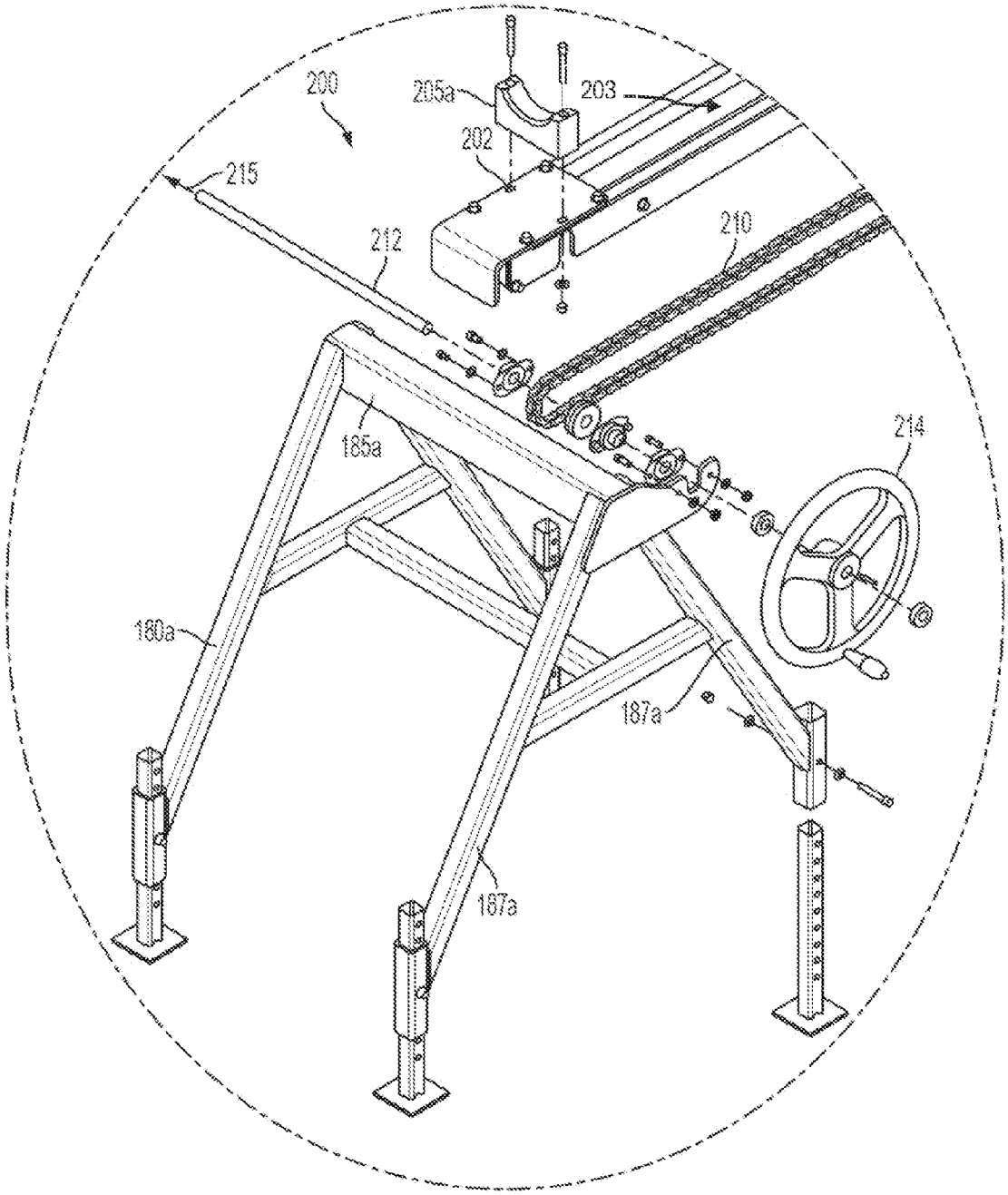
Figure 11C:
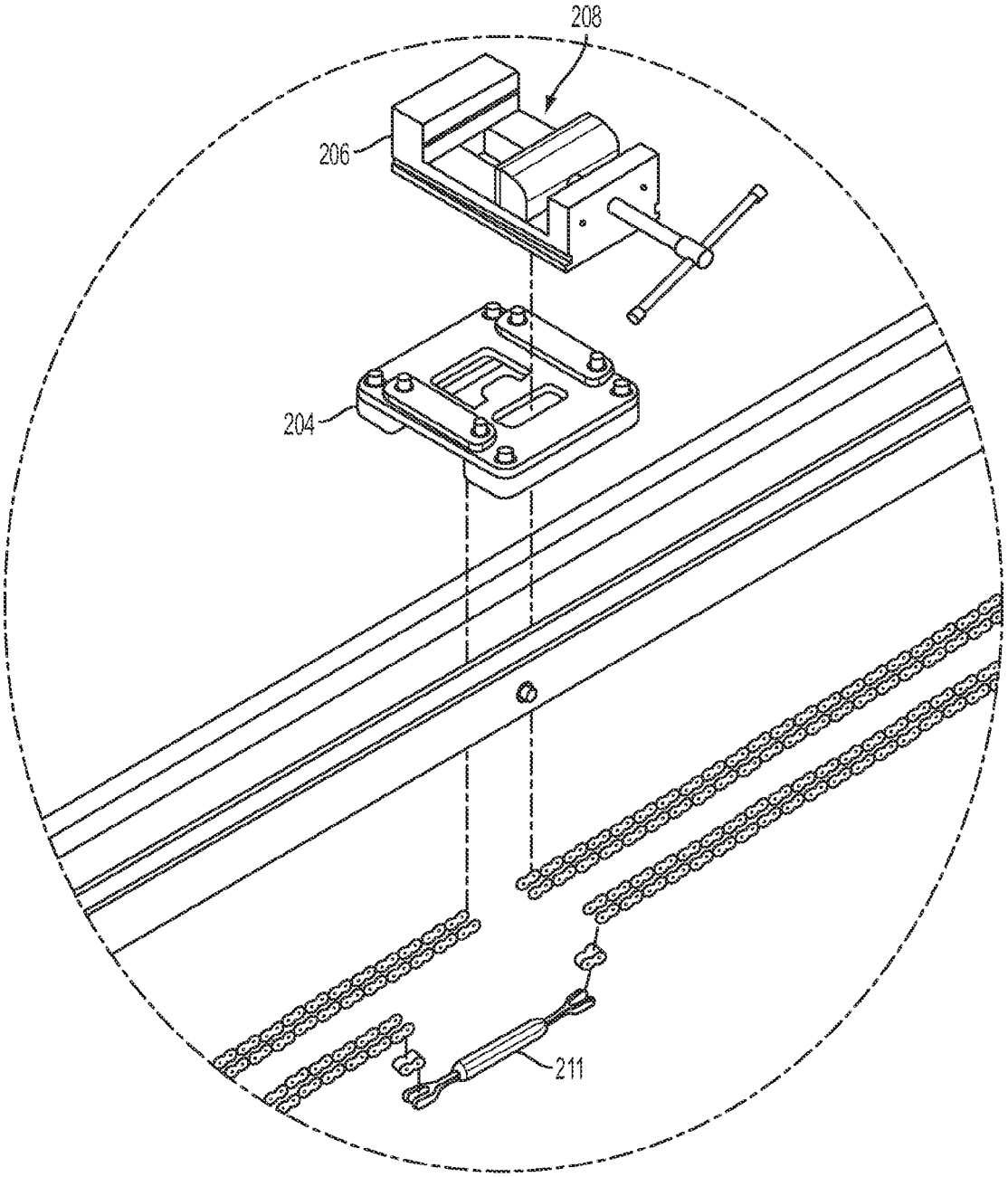

FIG. 11A depicts a perspective view of another exemplary loading device as disclosed herein. FIG. 11B depicts a partial exploded view of the base assembly and the clamping assembly of the loading device of FIG. 11A. FIG. 11C depicts a partial exploded view of the carriage and vice assembly of the loading device of FIG. 11A.

Figure 12A:
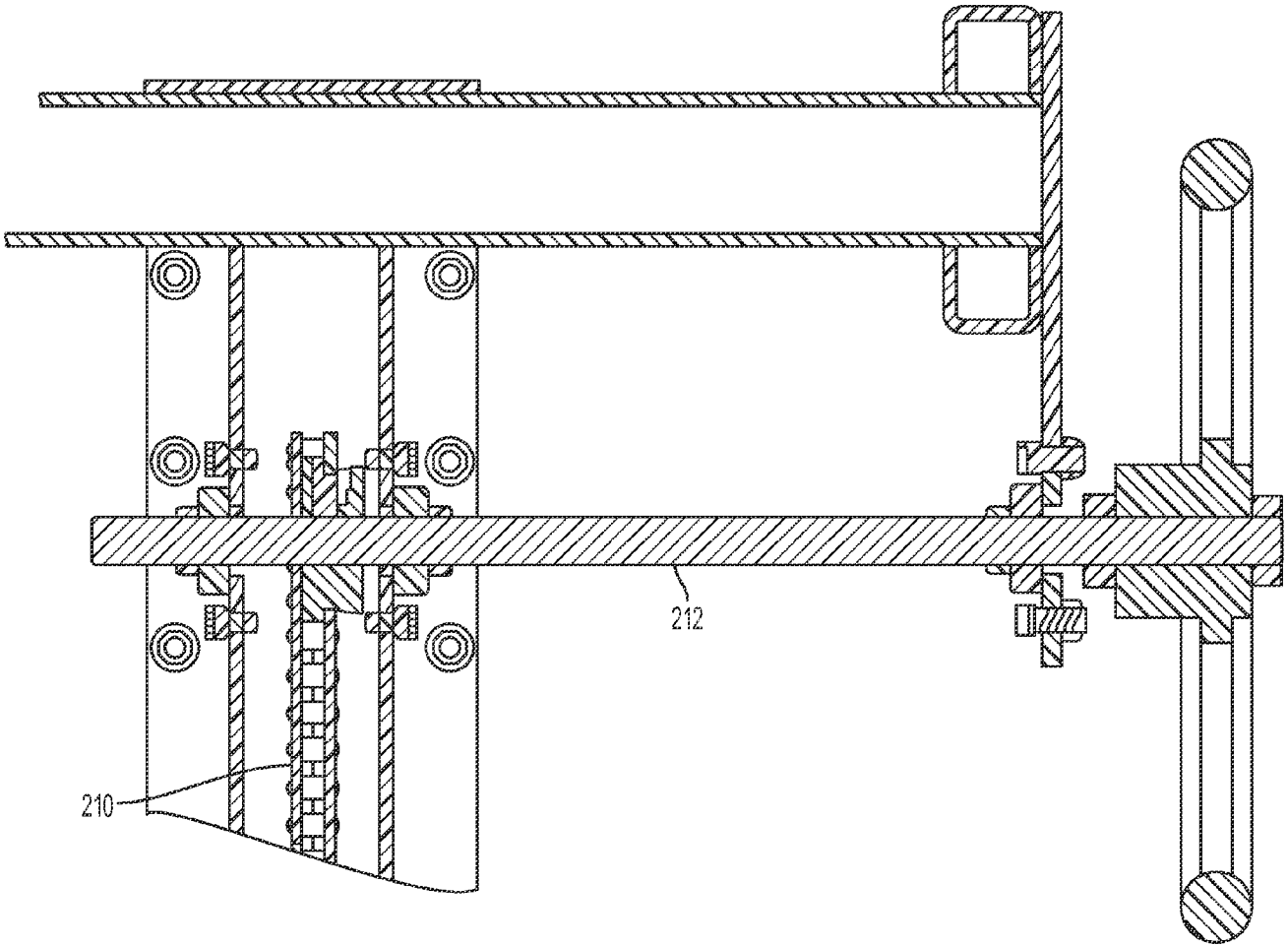
Figure 12B:
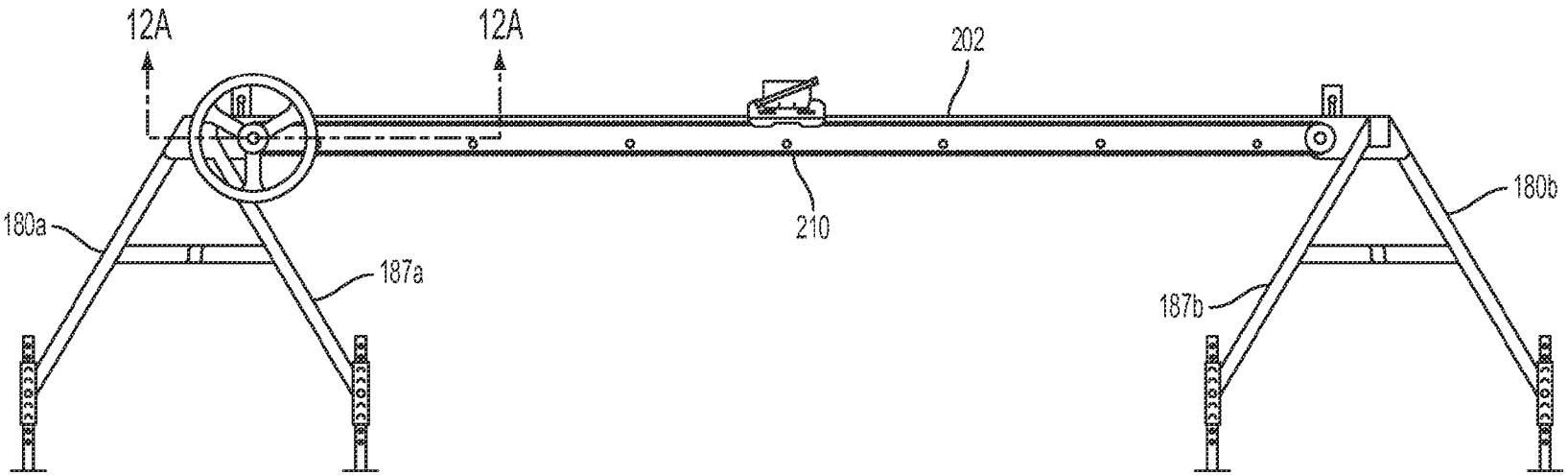

FIG. 12A depicts an isolated top perspective view of the interface between the first shaft and the chain link of the loading device of FIGS. 11A-11C, taken at Line 12A-12A of FIG. 12B. FIG. 12B depicts a side perspective view of the loading device of FIGS. 11A-11C.

Figure 13A:
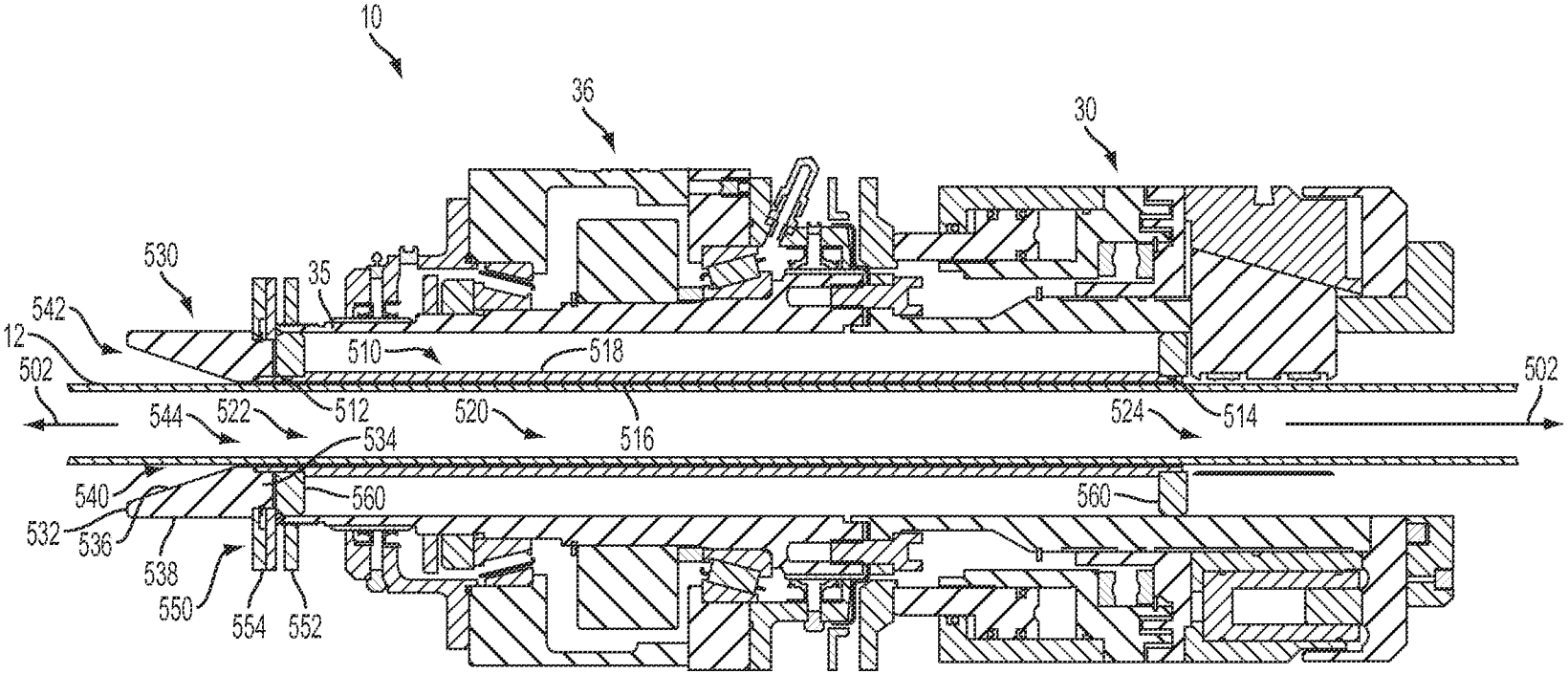
Figure 13B:
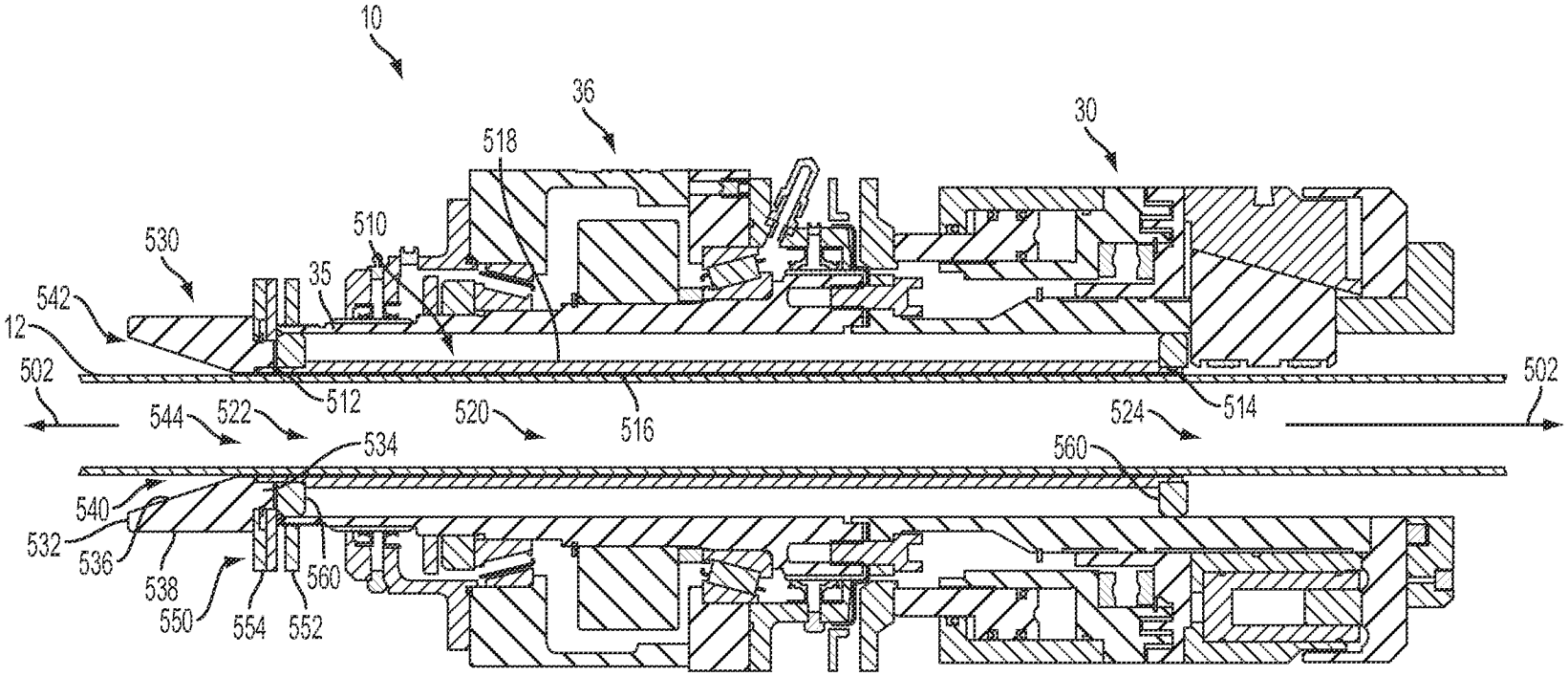
Figure 13C:
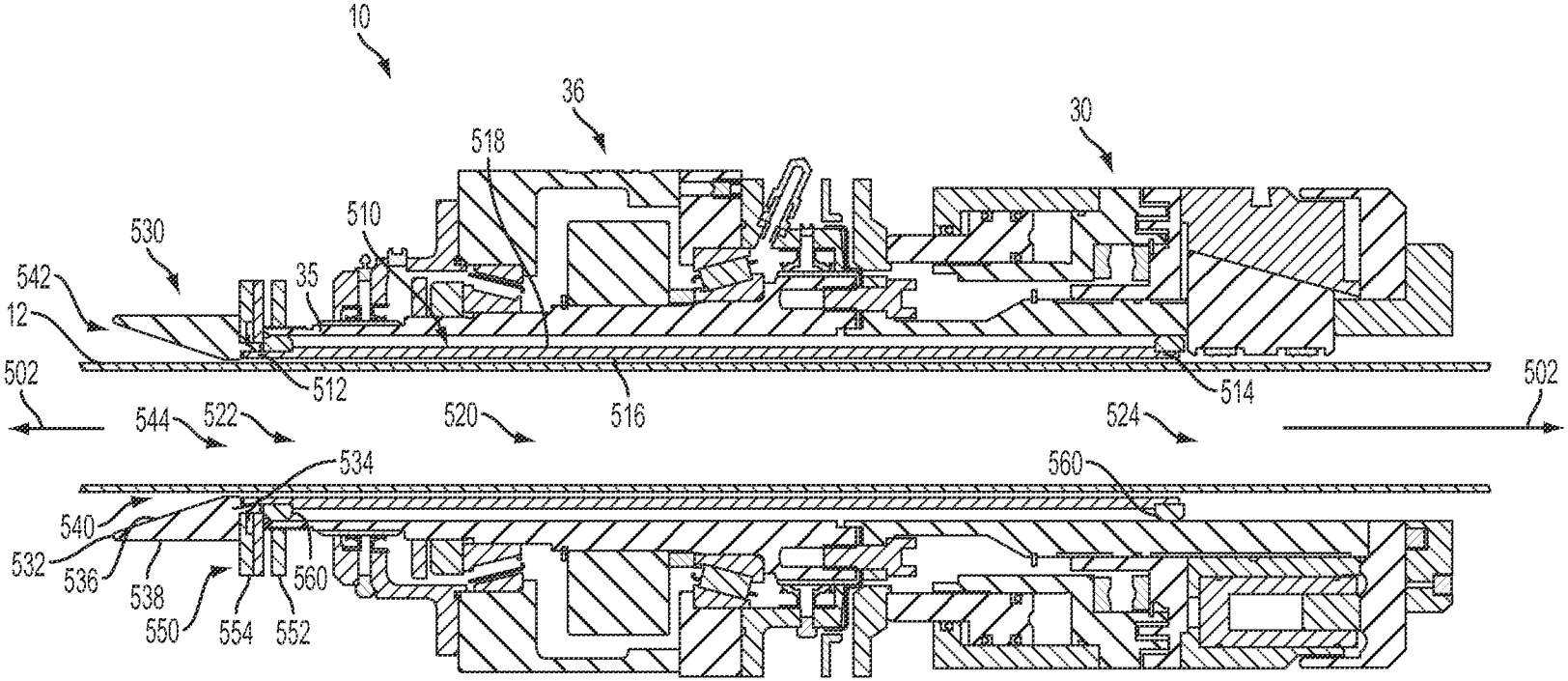
Figure 13D:
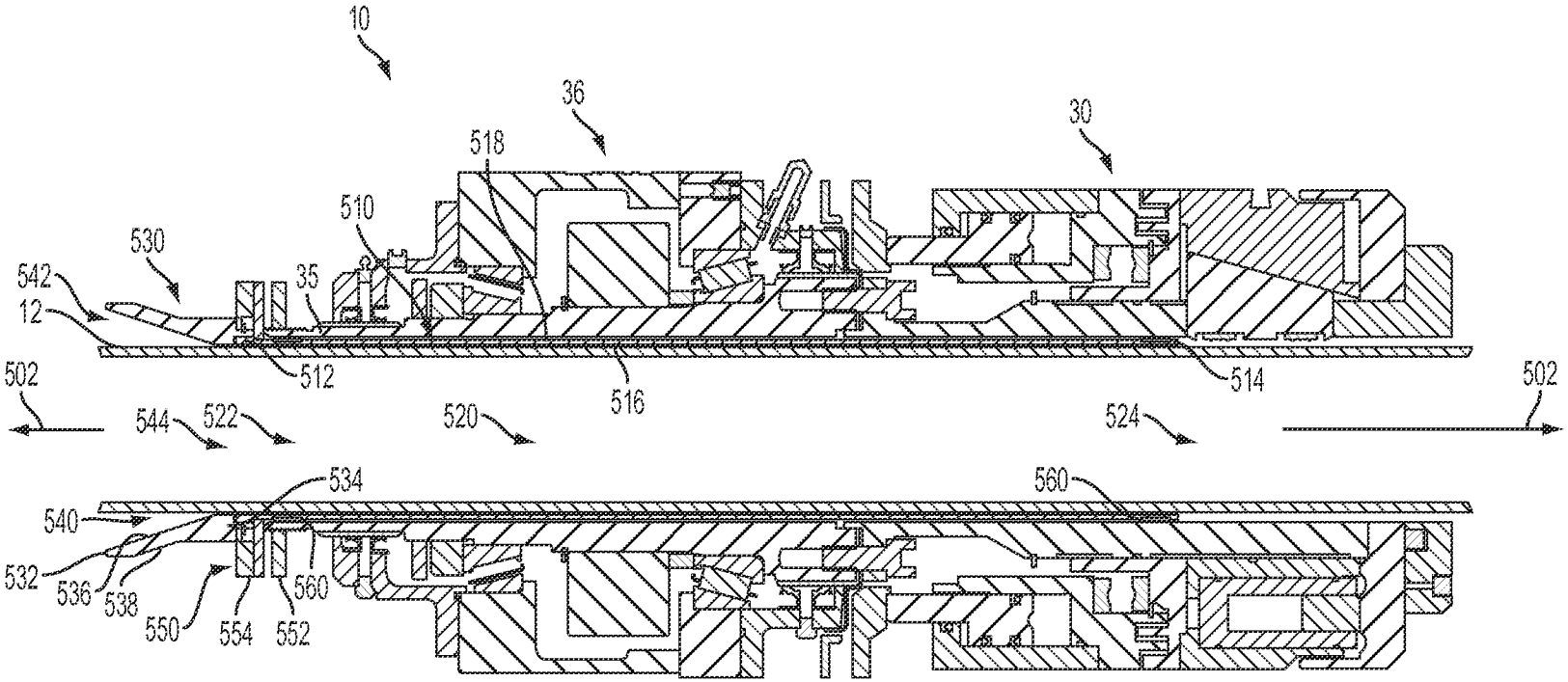

FIGS. 13A-13D depict longitudinal cross-sectional view of exemplary drill rod receiving assemblies positioned within a head spindle of a drill head. As shown, a receiving element of the drill rod receiving assemblies can have a tapered inner surface that cooperates with an elongate shaft to guide a drill rod into a desired orientation in which a longitudinal axis of the drill rod is substantially parallel to the longitudinal axis of the head spindle. The exemplary drill rod receiving assemblies depicted in FIGS. 13A-13D are configured to receive progressively larger drill rods, with FIG. 13A depicting a drill rod receiving assembly for receiving a relatively small drill rod and FIG. 13D depicting a drill rod receiving assembly for receiving a relatively large drill rod.

Figure 14:
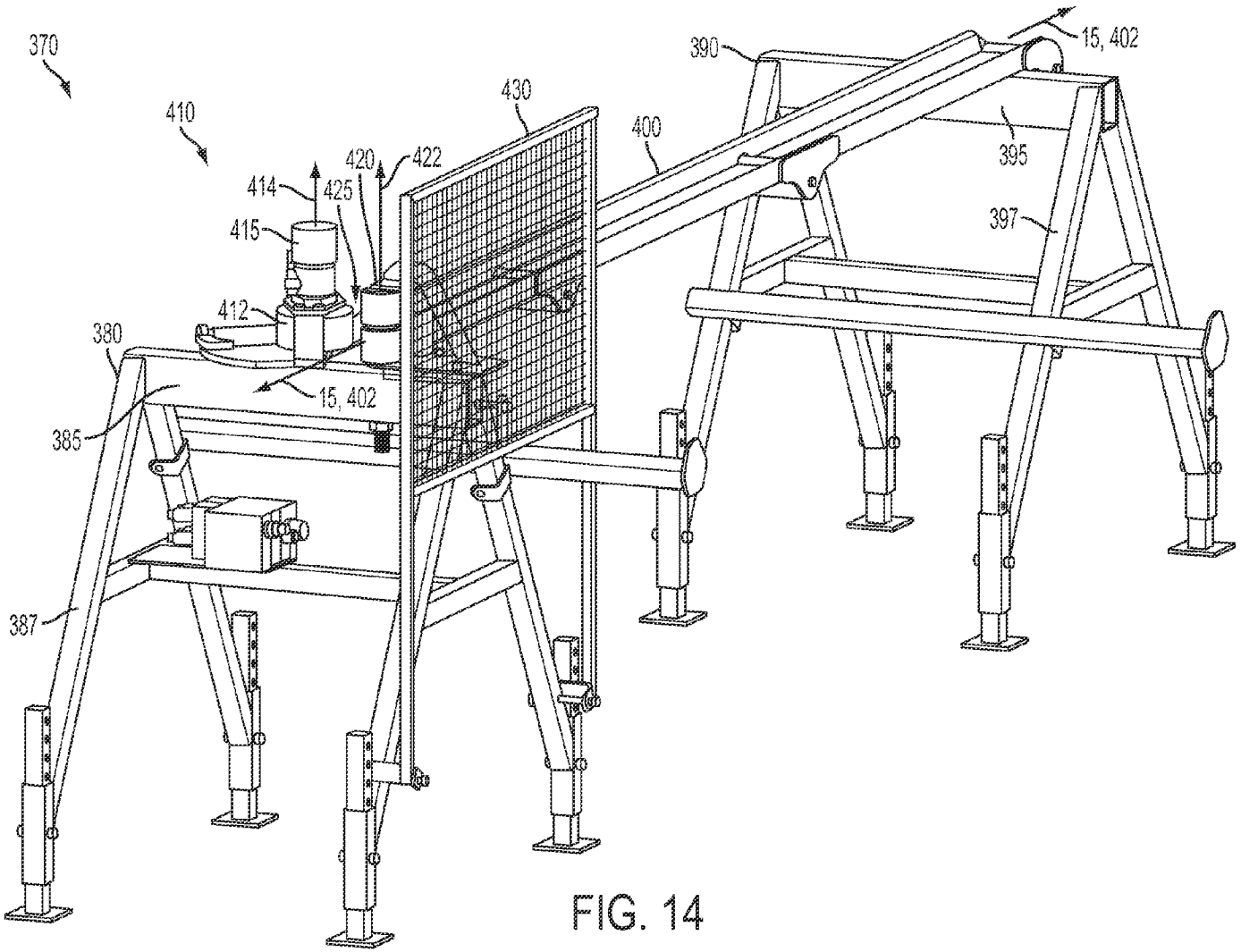

FIG. 14 depicts a perspective view of an exemplary loading device as disclosed herein.

Figure 15:
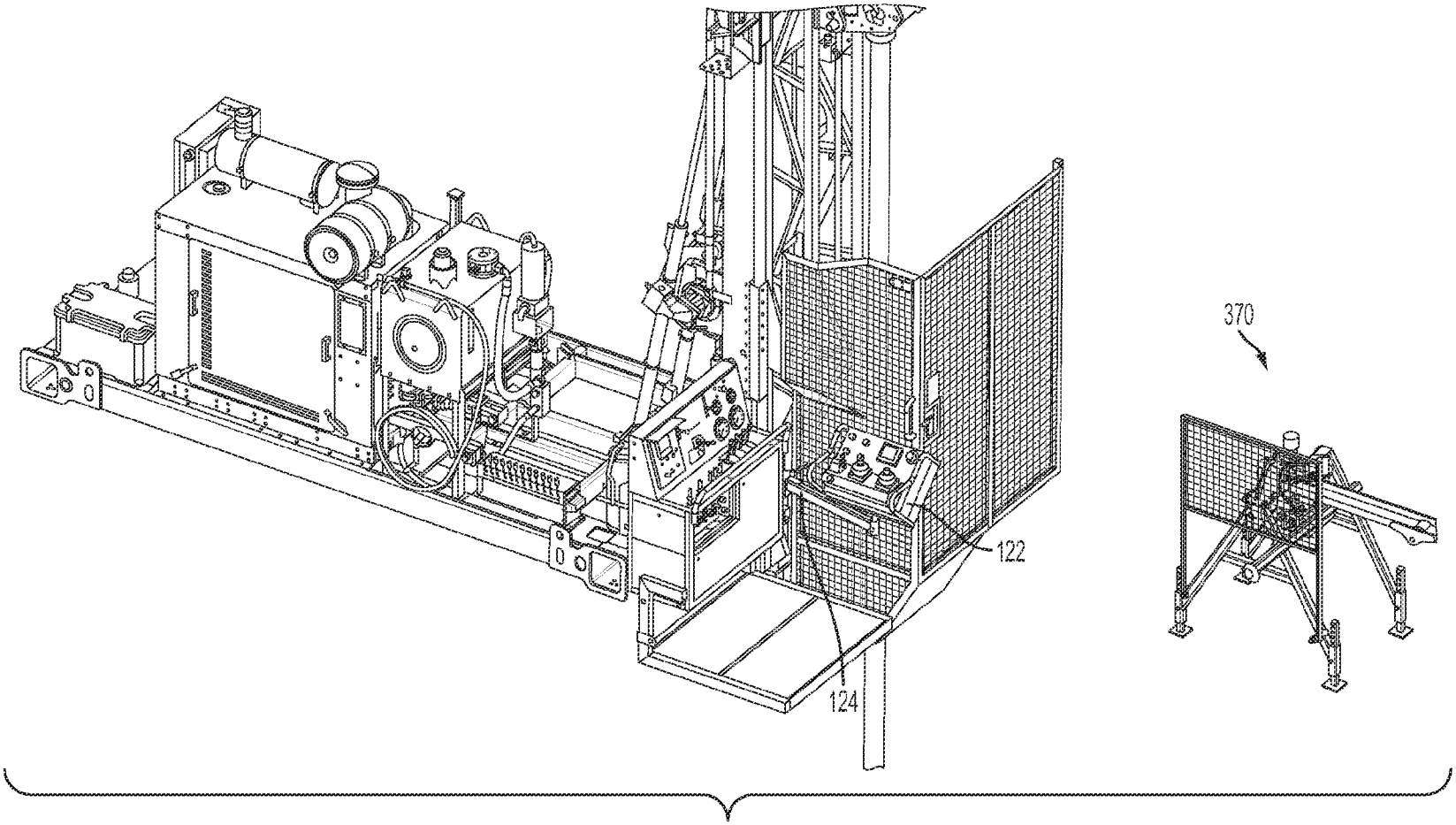

FIG. 15 is a perspective view showing the position of an exemplary control assembly relative to an exemplary loading device as disclosed herein.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a roller" can include two or more such rollers unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Described herein with reference to FIGS. 1-15 is a drill rod handling system 150 for positioning a drill rod 12 in an operative position. In exemplary aspects, the drill rod handling system 150 can comprise a loading device 70, 170, 370, a drill mast 16, and a drill head assembly 10. The drill mast 16 and the drill rod 12 can have respective longitudinal axes 18, 14. As further disclosed herein, it is contemplated that the drill rod handling system 150 can substantially eliminate the need for direct contact between an operator of the drill rod handling system and a drill rod to be loaded or unloaded from the drill head assembly 10. It is further contemplated that the drill rod handling system 150 can operate as fast as current drill loading and unloading methods while offering a cost reduction.

The Drill Head Assembly

In exemplary aspects, and with reference to FIGS. 4-10 and 13A-13D, the drill head assembly 10 can be used for securing the drill rod 12 in the operative position. In these aspects, the drill head assembly 10 can be operatively coupled to the drill mast 16. It is contemplated that the drill head assembly 10 can comprise a motor and a gear box as are known in the art. In exemplary aspects, it is contemplated that the disclosed drill head assembly 10 can be retrofit and/or added to an existing drilling system, such as, for example and without limitation, the LF™ 90D Surface Coring Drill system manufactured by BOART LONGYEAR (South Jordan, Utah).

In one aspect, the drill head assembly 10 can comprise a cradle 20, a chuck 30 operatively supported by the cradle, and a gear box portion 36. In this aspect, it is contemplated that the cradle 20 can be operatively configured for movement relative to the longitudinal axis 18 of the drill mast 16. It is further contemplated that the cradle 20 can be operatively configured for movement relative to a transverse axis 19 substantially perpendicular to the longitudinal axis 18 of the drill mast 16. In exemplary aspects, the cradle 20 can be operatively configured for movement relative to both the transverse axis 19 and the longitudinal axis 18 of the drill mast 16. Optionally, in exemplary aspects, the chuck can be a NITRO CHUCK™ (BOART LONGYEAR, South Jordan, Utah) chuck. However, it is contemplated that the chuck 30 can be any conventional chuck that is configured to grip drill shafts and spin with a head spindle as is known in the art.

In another aspect, the chuck 30 can have a longitudinal axis 32 and define an opening 34. Optionally, in this aspect, the opening 34 of the chuck 30 can be configured to securely receive a portion of a Kelly rod as is known in the art. It is contemplated that the Kelly rod can be configured for engagement with a portion of the drill rod 12 such that the longitudinal axis 14 of the drill rod 12 is substantially axially aligned with the longitudinal axis 32 of the chuck 30.

Optionally, it is contemplated that the drill rod 12 can be positioned within the chuck 30 without the need of a Kelly rod as is known in the art. In these aspects, and with reference to FIGS. 13A-13D, it is contemplated that the drill head assembly 10 can comprise a head spindle 35 that spans between the gear box portion 36 and the chuck portion 30 of the drill head assembly 10. In exemplary aspects, a drill rod receiving assembly 500 for receiving the drill rod 12 can be provided. In these aspects, and with reference to FIG. 13A-13D, the drill rod receiving assembly 500 can have a longitudinal axis 502 and be configured for positioning within the head spindle 35 of the drill head 10 such that the longitudinal axis of the drill rod receiving assembly is substantially aligned with a longitudinal axis of the head spindle.

In one aspect, the drill rod receiving assembly 500 can comprise an elongate shaft 510 having a first end 512, an opposed second end 514, an inner surface 516, and an outer surface 518. In this aspect, the inner surface 516 of the elongate shaft 510 can define a bore 520 extending between the first and second ends 512, 514 of the elongate shaft 510. It is contemplated that the first end 512 of the elongate shaft 510 can define a first opening 522 in communication with the bore 520. It is further contemplated that the second end 514 of the elongate shaft 510 can be configured for receipt within the chuck portion 30 of the drill head 10.

In another aspect, the drill rod receiving assembly 500 can comprise a receiving element 530 configured for operative coupling to the gear box portion 36 of the drill head 10. In this aspect, the receiving element 530 can have a first end 532, an opposed second end 534, an inner surface 536, and an outer surface 538. The inner surface 536 of the receiving element 530 can define a bore 540 extending between the first and second ends 532, 534 of the receiving element. The first end 532 of the receiving element 530 can define a first opening 542 in communication with the bore 540. The second end 534 of the receiving element 530 can define a second opening 544 in communication with the bore 540. It is contemplated that at least a portion of the inner surface 536 of the receiving element 530 can be inwardly tapered moving from the first opening 542 toward the second opening 544. In exemplary aspects, at least a portion of the inner surface 536 of the receiving element 530 can be angled relative to the longitudinal axis 502 of the drill rod receiving assembly 500 at an angle ranging from about 10 degrees to about 45 degrees and, more preferably, about 15 degrees. Thus, the inner surface 536 of the receiving element 530 can be configured to provide between about 20 and about 90 degrees of tolerance during insertion of the drill rod 12 into the first opening 542 of the receiving element 530. It is contemplated this tolerance can permit receipt of a wide range of drill rods that are not axially aligned with the first opening 542 of the receiving element 530. It is further contemplated that the second end 534 of the receiving element 530 can be operatively coupled to the first end 512 of the elongate shaft 510 such that the second opening 544 of the receiving element 530 is substantially aligned and in communication with the first opening 522 of the elongate shaft.

In exemplary aspects, upon advancement of the drill rod 10 from the first opening 542 of the receiving element 530 toward the second end 514 of the elongate shaft 510, the inner surfaces 536, 516 of the receiving element and the elongate shaft can be configured to cooperate to guide the drill rod to a desired orientation in which a longitudinal axis of the drill rod 12 is substantially parallel to the longitudinal axis of the head spindle. In these aspects, it is contemplated that the longitudinal axis of the drill rod 12 can also be substantially parallel to (or in alignment with) the translation axis 15 of a loading device as further disclosed herein. Unlike known drill heads, the disclosed drill rod receiving assembly 500 can receive a drill rod in the desired orientation without the need for threading joints to pass the drill rod to a drilling assembly. During use of the disclosed drill rod receiving assembly 500, only axial advancement (i.e., pushing) of the drill rod is needed to correctly position the drill rod within the assembly 500.

Optionally, in further aspects, the drill rod receiving assembly 500 can further comprise a plate assembly 550. In these aspects, the plate assembly 550 can comprise a first plate 552 configured for circumferential engagement with the outer surface of the head spindle 35 of the drill head 10 and a second plate 554 configured to circumferentially engage a portion of the outer surface 538 of the receiving element 530 proximate the second end 534 of the receiving element. In another aspect, the plate assembly 550 can further comprise means for securely coupling the first plate 552 to the second plate 554 to thereby stabilize the receiving element. In exemplary aspects, the means for securely coupling the first plate to the second plate can comprise at least one fastener configured to securely couple the first plate 552 to the second plate 554. In these aspects, it is contemplated that the at least one fastener can comprise a plurality of fasteners. It is further contemplated that each fastener of the at least one fastener can comprise any conventional fastener as is known in the art, including, for example and without limitation, a bolt, a screw, a pin, and the like. In further aspects, it is contemplated that the means for securely coupling the first plate to the second plate can comprise a snap ring as is known in the art. In these aspects, the snap ring can be configured for operative engagement with an inner portion of the second plate 554 such that the snap ring is positioned between the second plate and the outer surface 538 of the receiving element 530.

Optionally, in additional aspects, the drill rod receiving assembly 500 can further comprise a plurality of spacers 560. In these aspects, each spacer 560 of the plurality of spacers can be configured to circumferentially surround a portion of the outer surface 518 of the elongate shaft 510 and to maintain the spacing between the outer surface of the elongate shaft and an inner surface of the head spindle.

In exemplary aspects, it is contemplated that at least a portion of the inner surface 516 of the elongate shaft 510 can be configured for engagement with a portion of the drill rod 12 to support the drill rod in alignment with the longitudinal axis 502 of the receiving assembly 500 (and, thus, with the longitudinal axis of the chuck 30). In operation, a drill rod 12 can be inserted into the first opening 542 of the receiving element 530 and then advanced relative to the longitudinal axis 502 of the receiving assembly 500 such that the drill rod is received in the second opening 544 of the receiving element and then axially advanced through the first opening 522 of the elongate shaft 510 until the drill rod passes through the second opening 524 of the elongate shaft. As further described above, it is contemplated that the inwardly tapered profile of the receiving element 530 can accommodate receipt of drill rods positioned at a wide range of angles and then help establish alignment of the drill rod with the longitudinal axis 502 of the receiving assembly 500 as the drill rods are advanced toward the second opening 524 of the elongate shaft. It is further contemplated that the inwardly tapered profile of the receiving element 530 can be useful in a variety of operating conditions, including, for example and without limitation, when deflection occurs during feeding of a drill head down over a drill rod positioned within a foot clamp or during the addition of a drill rod onto a spindle. In exemplary aspects, it is contemplated that the receiving element 530 and the elongate shaft 510 can be configured to prevent contact between the drill rod 12 and the chuck 30 until the drill rod is adequately positioned within the jaws of the chuck.

In exemplary aspects, it is contemplated that the elongate shaft 510 can have a substantially constant inner diameter (defined by inner surface 516) and a substantially constant outer diameter (defined by outer surface 518).

Optionally, it is contemplated that the receiving element 530 of the receiving assembly 500 can be selectively detachable from the head spindle 35 and the elongate shaft 510 of the receiving assembly. It is further contemplated that each elongate shaft 510 can be selectively removed from the drill head 10. In other exemplary aspects, it is contemplated that each respective receiving element 530 can be configured for operative connection to a corresponding elongate shaft 510. Thus, in these aspects, it is contemplated that, for a given drill rod 12, a suitably sized elongate shaft 510 and corresponding receiving element 530 can be selected for usage with the drill head 10 to permit advancement of the drill rod as disclosed herein. FIGS. 13A-13D depict various drill rods being advanced within suitably sized elongate shafts and their complementary receiving elements. As can be appreciated, as the diameter of the drill rod 12 to be inserted within the drill head 10 increases, the inner diameter of the elongate shaft 510 and at least a minimum inner diameter of the receiving element 530 increase, whereas the dimensions of the spacers 560 (which may not be used depending upon the diameter of the drill rod) decrease.

In a further aspect, the cradle 20 can be configured for movement between a first position and a second position. As shown in FIGS. 8A-8B, in the first position, it is contemplated that the longitudinal axis 32 of the chuck 30 can be substantially parallel to the longitudinal axis 18 of the drill mast 16. From the first position, the cradle 20 can be configured for sequential axial and then pivotal (or, alternatively, sequential pivotal and then axial) movement relative to the transverse axis 19 to reach the second position. As shown in FIG. 8C, in the second position, it is contemplated that the longitudinal axis 32 of the chuck 30 can be substantially perpendicular to the longitudinal axis 18 of the drill mast 16. Optionally, in the second position, the cradle 20 can be axially spaced from the drill mast 16 relative to the transverse axis 19. From the second position, the cradle 20 can be configured for sequential pivotal and then axial (or, alternatively, sequential axial and then pivotal) movement relative to the transverse axis 19 to return to the first position. However, depending on the length of the drill rod, it will be appreciated that it may be necessary to lift the cradle 20 axially relative to the longitudinal axis 18 of the drill mast 16 before the cradle is sequentially pivotally and then axially moved relative to the transverse axis 19.

In exemplary aspects, during movement of the cradle 20 between the first and second positions, pivotal movement of the cradle can be restricted until the completion of axial movement relative to the transverse axis 19. It is further contemplated that axial movement of the cradle 20 relative to the transverse axis 19 can be restricted until the completion of pivotal movement of the cradle relative to the transverse axis. Thus, it is contemplated that, in use, the cradle 20 (and, thus, the chuck 30) will not axially shift during tilting of the cradle relative to the transverse axis 19, such as, for example, while it is tilting during movement of the cradle from the second position to the first position. Similarly, it is contemplated that, in use, the cradle 20 (and, thus, the chuck 30) will not tilt while the cradle is shifting axially relative to the transverse axis 19, such as, for example, while it is shifting axially from the first position to the second position. It is contemplated that, by requiring a full axial shift before tilting occurs and/or a full tilt before axial shifting occurs, many of the safety risks associated with conventional drill head assemblies can be avoided.

In another aspect, the drill head assembly 10 can comprise a plurality of sensors 40. In this aspect, at least one sensor 40 of the plurality of sensors can be configured to detect the completion of axial movement of the cradle 20 relative to the transverse axis 19. It is contemplated that at least one sensor 40 of the plurality of sensors can be configured to detect the completion of pivotal movement of the cradle 20 relative to the transverse axis 19. Optionally, in one exemplary aspect, the plurality of sensors 40 can comprise a plurality of proximity switches operatively coupled in a relay configuration. However, it is contemplated that any conventional position sensors, such as, for example and without limitation, electrical position sensors, programmable logic controllers (PLC's), and the like, can be used.

In another exemplary aspect, the plurality of sensors 40 can optionally comprise a plurality of hydraulic sequence valves. In this aspect, the drill head assembly 10 can further comprise a first hydraulic cylinder 50 operatively coupled to the cradle and positioned in communication with the plurality of hydraulic sequence valves. It is contemplated that the first hydraulic cylinder 50 can optionally have a longitudinal axis substantially parallel to the transverse axis. It is further contemplated that activation of the first hydraulic cylinder 50 can be configured to effect axial movement of the cradle 20 relative to the transverse axis 19. In an additional aspect, the drill head assembly 10 can further comprise a second hydraulic cylinder 52 operatively coupled to the cradle 20 and positioned in communication with the plurality of hydraulic sequence valves. In this aspect, it is contemplated that activation of the second hydraulic cylinder 52 can be configured to effect pivotal movement of the cradle 20 relative to the transverse axis 19. In use, it is contemplated that oil can be diverted between the first and second hydraulic cylinders 50, 52 as necessary to effect tilting and shifting of the cradle 20 and chuck 30.

In exemplary aspects, the plurality of sensors 40 and the first and second hydraulic cylinders 50, 52 can be positioned in operative communication with a control assembly 120 as further described herein. Optionally, it is contemplated that sequential axial and then pivotal movement of the cradle from the first position to the second position can be effected by a single action by an operator of the control assembly 120. It is further contemplated that sequential pivotal and then axial movement of the cradle from the second position to the first position can be effected by a single action by an operator of the control assembly. For example, it is contemplated that the control assembly 120 can comprise a first lever (or other user input means) that can be activated to effect movement of the cradle from the first position to the second position as disclosed herein and a second lever (or other user input means) that can be activated to effect movement of the cradle from the second position to the first position as disclosed herein. Alternatively, it is contemplated that movement about and between the first and second positions can be accomplished using a single lever (or other user input means) having two or more operative positions, with one operative position effecting movement from the first position to the second position and a second operative position effecting movement from the second position to the first position. Separately, the control assembly 120 can comprise one or more additional user input means for effecting movement of the cradle relative to the longitudinal axis 18 of the drill mast 16. In operation, the control assembly 120 can communicate with the plurality of sensors 40 and the hydraulic cylinders 50, 52 to ensure that axial movement of the cradle relative to the transverse axis is completed before pivotal movement begins and that pivotal movement of the cradle relative to the transverse axis is completed before axial movement relative to the transverse axis begins. For example, when the control assembly 120 directs the plurality of sensors to move the cradle from the first position to the second position, the control assembly can actuate the first hydraulic cylinder to effect axial movement of the cradle relative to the transverse axis. When a sensor of the plurality of sensors detects that axial movement of the cradle relative to the transverse axis has been completed, the sensor and/or the control assembly can effect sequential actuation of the second hydraulic cylinder (e.g., in a relay configuration) to thereby effect pivotal movement of the cradle relative to the transverse axis; however, the control assembly cooperates with the plurality of sensors to prevent pivotal movement of the cradle until axial movement has been completed. A sensor of the plurality of sensors can also determine when pivotal movement of the cradle has been completed, thereby confirming positioning of the cradle in the second position. Similarly, when the control assembly 120 directs the plurality of sensors to move the cradle from the second position to the first position, the control assembly can actuate the second hydraulic cylinder to effect pivotal movement of the cradle relative to the transverse axis. When a sensor of the plurality of sensors detects that pivotal movement of the cradle relative to the transverse axis has been completed, the sensor and/or the control assembly can effect sequential actuation of the first hydraulic cylinder (e.g., in a relay configuration) to thereby effect axial movement of the cradle relative to the transverse axis; however, the control assembly cooperates with the plurality of sensors to prevent axial movement of the cradle until pivotal movement has been completed. A sensor of the plurality of sensors can also determine when axial movement of the cradle has been completed, thereby confirming positioning of the cradle has been returned to the first position.

In a further aspect, the drill head assembly 10 can further comprise a plurality of spaced guide bars 60 operatively coupled to the cradle 20. In this aspect, each guide bar 60 of the plurality of guide bars can have a longitudinal axis substantially parallel to the transverse axis 19. It is contemplated that the cradle 20 can be configured for movement along the plurality of guide bars 60 relative to the transverse axis 19. It is further contemplated that the plurality of guide bars 60 can be configured to support the cradle 20 during axial and pivotal movement of the cradle relative to the transverse axis 19. During or following tilting of the cradle 20, it is contemplated that the plurality of spaced guide bars 60 must fully support the cradle 20 before the drill head assembly 10 will be permitted to axially shift relative to the transverse axis 19.

The Loading Device

In exemplary aspects, and with reference to FIGS. 1-3 and 8A-10, the loading device 70 can be used for engaging a drill rod 12 moving relative to a translation axis 15. In these aspects, the loading device 70 can optionally comprise a base assembly 80, a support assembly 90, and a clamping assembly 100.

In one aspect, the base assembly 80 of the loading device 70 can comprise at least one horizontal roller. It is contemplated that the at least one horizontal roller can comprise a single horizontal roller. Optionally, in another aspect, the at least one horizontal roller can comprise at least one proximal roller 82 and at least one distal roller 86. In this aspect, the at least one proximal roller 82 can be spaced from the at least one distal roller 86. It is contemplated that the proximal and distal rollers 82, 86 can have respective longitudinal axes 84, 88. It is further contemplated that the longitudinal axes 84 of the at least one proximal roller 82 can be substantially parallel to the longitudinal axes 88 of the at least one distal roller 86. It is still further contemplated that the longitudinal axes 84, 88 of the proximal and distal rollers 82, 86 can be substantially perpendicular to the translation axis 15.

In another aspect, the support assembly 90 of the loading device 70 can be secured to the base assembly 80. In this aspect, the support assembly 90 can comprise at least one support roller 92. Optionally, the at least one support roller 92 can comprise a plurality of support rollers. It is contemplated that each support roller 92 of the at least one support roller can have a respective longitudinal axis 94. It is further contemplated that the longitudinal axes 94 of the at least one support roller 92 can be substantially parallel. It is still further contemplated that the longitudinal axes 94 of the at least one support roller 92 can be substantially perpendicular to the translational axis 15 and the longitudinal axes 84, 88 of the proximal and distal rollers 82, 86.

In an additional aspect, the clamping assembly 100 of the loading device 70 can be spaced from the support assembly 90 relative to a transverse axis 72. In this aspect, the transverse axis 72 can optionally be substantially parallel to the longitudinal axes 84, 88 of the proximal and distal rollers 82, 86. It is contemplated that the clamping assembly 100 can have at least one clamping roller 102 configured for movement relative to the transverse axis 72 between an open position and an engaged position. It is further contemplated that the at least one clamping roller 102 can have a longitudinal axis 104 that is substantially parallel to the longitudinal axes 94 of the at least one support roller 92. Optionally, in some aspects, the at least one clamping roller 102 can comprise a plurality of clamping rollers. In exemplary aspects, it is contemplated that each clamping roller 102 can comprise a flexible material that is configured to also provide a surface for frictional engagement with a drill rod. Optionally, in these aspects, the clamping roller 102 can comprise urethane. In one exemplary aspect, the clamping roller 102 can comprise carbides that are configured to frictionally engage a drill rod while minimizing damage to the drill rod. In a further exemplary aspect, the clamping roller 102 can comprise urethane and carbides.

In exemplary aspects, the horizontal, support, and clamping rollers 82, 86, 92, 102 can cooperate to define a receiving space 74. In these aspects, the receiving space 74 can be configured to receive at least a portion of the drill rod 12. It is contemplated that, in the engaged position of the clamping roller 102, the horizontal, support, and clamping rollers 82, 86, 92, 102 can be positioned in engagement with the drill rod 12. It is further contemplated that, in the engaged position of the at least one clamping roller 102, the horizontal, support, and clamping rollers 82, 86, 92, 102 can be configured to permit axial movement of the drill rod 12 relative to the translation axis 15 but restrict rotation of the drill rod relative to the translation axis.

In a further aspect, the loading device 70 can further comprise a lever 112. In this aspect, the lever 112 can have a lever support 114 secured to the base assembly 80 and a coupling element 116 coupled to the lever 112 and the at least one clamping roller 102. It is contemplated that the coupling element 116 can be pivotally coupled to the lever support 114. It is further contemplated that the coupling element 116 can be configured for pivotal movement relative to the lever support 114. In exemplary aspects, it is contemplated that selective pivotal movement of the coupling element 116 can effect movement of the clamping roller 102 relative to the transverse axis 72. In exemplary aspects, it is contemplated that the position of at least one of the lever support 114 and the support assembly 90 can be selectively adjustable relative to the transverse axis 72. Optionally, in exemplary aspects, the loading device 70 can comprise means for driving the lever 112. In these aspects, the means for driving the lever 112 can be configured to selectively move the lever, thereby effecting movement of the coupling element 116 and/or the clamping roller 102. In other exemplary aspects, the loading device 70 can comprise means for driving the at least one support roller 92. In these aspects, the means for driving the at least one support roller 92 can be configured to selectively rotate the at least one support roller. It is still further contemplated that the loading device 70 can further comprise means for adjusting the axial position of the support assembly 90 relative to the transverse axis 72 and/or means for adjusting the axial position of the clamping assembly 100 relative to the transverse axis 72. It is contemplated that the means for driving the lever 112, the means for driving the at least one support roller 92, the means for adjusting the axial position of the support assembly 90, and the means for adjusting the axial position of the clamping assembly 100 can comprise any conventional motor that is operatively coupled to a conventional power source, including, for example and without limitation, a hydraulic or electronic power source.

In additional exemplary aspects, the lever 112 can have a longitudinal axis 113. In these aspects, in the open position of the at least one clamping roller 102, the longitudinal axis 113 of the lever can be substantially parallel to the transverse axis 72. In further aspects, it is contemplated that the at least one clamping roller 102 can be moveable from the open position to the engaged position upon application of a downward force to the lever 112. It is further contemplated that, in the engaged position of the at least one clamping roller 102, the longitudinal axis 113 of the lever 112 can be angled downwardly relative to the transverse axis 72. In exemplary aspect, the loading device 70 can comprise means for driving the at least one clamping roller 102. In this aspect, the means for driving the at least one clamping roller 102 can be configured to selectively rotate the at least one clamping roller 102. It is contemplated that the means for driving the at least one clamping roller 102 can comprise any conventional motor that is operatively coupled to a conventional power source, including, for example and without limitation, a hydraulic or electronic power source.

In another aspect, the base assembly 80 of the loading device 70 can further comprise a cross-bar 85. In this aspect, it is contemplated that the proximal and distal rollers 82, 86 of the base assembly 80 can be positioned on opposing sides of the cross-bar 85. Optionally, it is further contemplated that the base assembly 80 can further comprise a plurality of legs 87 secured to the cross-bar 85.

Optionally, in an additional aspect, the at least one clamping roller 102 of the clamping assembly 100 can comprise a single clamping roller. In this aspect, it is contemplated that the at least one support roller 92 of the support assembly 90 can comprise two support rollers. It is further contemplated that the single clamping roller 102 can be substantially axially centered between the two support rollers 92 relative to the translation axis 15.

In further exemplary aspects, it is contemplated that the proximal and distal rollers 82, 86 of the base assembly 80 can be positioned at substantially the same height. In still further exemplary aspects, it is contemplated that the support and clamping rollers 92, 102 can be positioned at substantially the same height.

In other exemplary aspects, it is contemplated that the height of the base assembly 80 can be selectively adjustable using conventional means. In one non-limiting example, the legs 87 can comprise first and second leg portions, with the second leg portion configured for telescopic movement relative to the first leg portion, and each leg portion defining a plurality of axially spaced openings for receiving a locking pull pin (or other fastener) to lock the second leg portion relative to the first leg portion in the manner known in the art.

Referring to FIGS. 11A-12B, in alternative exemplary aspects, a clamping/loading device 170 can have a pair of spaced base assemblies (first and second base assemblies 180*a*, 180*b*) and a clamping assembly 200. In exemplary aspects, the first and second base assemblies 180*a*, 180*b* can be spaced relative to the translation axis 15.

In further aspects, the loading device 170 can have a frame 202 that is securely coupled to and positioned between the first and second base assemblies 180*a*, 180*b* such that a longitudinal axis of the frame is substantially axially aligned with the translation axis 15. In additional aspects, the loading device 170 can further comprise a carriage 204 that is operatively coupled to the frame 202 such that the carriage is configured for selective movement along the length of the frame relative to the translation axis 15. In these aspects, the carriage 204 can support a vice assembly 206 that defines a central space 208 for receiving a portion of a drill rod, and at least a portion of the carriage can be supported by and/or engaged by the frame 202. It is contemplated that the size of the central space 208 of the vice assembly 206 can be selectively adjusted to securely engage the drill rod in an operative position. For example, in one aspect, the vice assembly 206 can comprise first and second walls that define the central space 208, with the first wall being selectively moveable relative to the second wall using conventional means to thereby selectively adjust the width of the central space 208. Optionally, in some aspects, the frame 202 can comprise first and second guide blocks 205*a*, 205*b* configured to receive a portion of the drill rod. In these aspects, it is contemplated that the first guide block 205*a* can be positioned proximate a first end of the frame 202 (proximate the first base assembly 180*a*) while the second guide block 205*b* can be positioned proximate a second end of the frame (proximate the second base assembly 180*b*). Thus, it is contemplated that the vice assembly 206 can be positioned in between the first and second guide blocks 205*a*, 205*b* relative to the translation axis 15. It is further contemplated that the first and second guide blocks 205*a*, 205*b* can be substantially axially aligned with the vice assembly 206.

Optionally, in some aspects, the frame 202 can have a central opening 203 extending substantially along the length of the frame between the first and second base assemblies 180*a*, 180*b*. In one aspect, the loading device 170 can comprise first and second shafts 212*a*, 212*b*, with the first and second shafts 212*a*, 212*b* being supported by the frame 202. In this aspect, it is contemplated that the first and second shafts 212*a*, 212*b* can optionally be fully keyed drive shafts (MCMASTER CARR) defining a keyway that permits driving of a sprocket and/or wheel as further disclosed herein. Optionally, the frame can comprise at least one bearing operatively coupled to the first shaft 212*a* and at least one bearing operatively coupled to the second shaft 212*b*. It is contemplated that the first base assembly 180*a* can optionally comprise a bearing operatively coupled to the first shaft 212*a*. It is further contemplated that the second base assembly 180*b* can optionally comprise a bearing operatively coupled to the second shaft 212*b*. The first and second shafts 212*a*, 212*b* can be supported by the frame 202 such that the shafts are oriented substantially perpendicularly to the translation axis 15 (and parallel to one another). In exemplary aspects, the loading device 170 can further comprise a chain 210 positioned over both shafts 212*a*, 212*b*, thereby forming a closed chain loop containing both the first and second shafts, and a first portion of the chain loop can be securely coupled to the carriage 204 through the central opening 203. Optionally, an opposed second portion of the chain loop 210 can comprise a stop element 211. In operation, it is contemplated that the stop element 211 can prevent rotation of the chain loop 210 beyond predetermined rotational positions, such as, for example and without limitation, rotational positions corresponding to contact between the carriage 204 and the first or second ends (e.g., first or second guide blocks) of the frame. In exemplary aspects, the chain 210 can be operatively coupled to the first shaft 212*a* such that rotation of the first shaft in a first direction effects advancement of the chain loop in a corresponding direction and the carriage 204 is advanced toward the second shaft 212*b* (and second base assembly 180*b*) relative to the translation axis 15. It is contemplated that the chain 210 can also be operatively coupled to the first shaft 212*a* such that rotation of the first shaft in an opposed, second direction effects advancement of the chain loop in a corresponding direction and the carriage 204 is advanced toward the first shaft (and first base assembly 180*a*) relative to the translation axis 15. Optionally, it is contemplated that the loading device 170 can comprise a sprocket to operatively couple the first shaft 212*a* to the chain 210. In additional aspects, the first shaft 212*a* can be operatively coupled to a wheel 214, which is configured for rotation relative to a rotation axis 215 and configured to selectively impart rotational motion to the first shaft, thereby causing advancement of the chain 210 in a desired direction.

Optionally, in exemplary aspects, the frame 202 can be operatively secured to the first and second base assemblies 180*a*, 180*b* by at least one fastener. In these aspects, it is contemplated that the fasteners can be selectively removed to permit disassembly and transport of individual components of the clamping assembly 200. It is further contemplated that the fasteners can be selectively positioned to permit efficient assembly of the clamping assembly 200.

Optionally, in exemplary aspects, the first and second base assemblies 180*a*, 180*b* can comprise respective cross bars 185*a*, 185*b*. In these aspects, it is contemplated that the first base assembly 180*a* can comprise a plurality of legs 187*a* extending downwardly from the cross bar 185*a*, and the second base assembly 180*b* can comprise a plurality of legs 187*b* extending downwardly from the cross bar 185*b*. Optionally, it is contemplated that the cross bars 185*a* and 185*b* can be configured for engagement with respective end portions of the frame 202, as shown in FIG. 11A. In further aspects, the first base assembly 180*a* can optionally comprise an arm 188 extending outwardly from the base assembly and defining a notch 189 for receiving at least a portion of the first shaft 212*a*.

In other exemplary aspects, it is contemplated that the height of the first and second base assemblies 180*a*, 180*b* can be selectively adjustable using conventional means. In one non-limiting example, the legs 187*a* can comprise first and second leg portions, with the second leg portion configured for telescopic movement relative to the first leg portion, and each leg portion defining a plurality of axially spaced openings for receiving a locking pull pin (or other fastener) to lock the second leg portion relative to the first leg portion in the manner known in the art.

Referring to FIGS. 14-15, in alternative exemplary aspects, a loading device 370 can have a pair of spaced base assemblies (first and second base assemblies 380, 390) and a driving assembly 410. In exemplary aspects, the first and second base assemblies 380, 390 can be spaced relative to the translation axis 15. It is contemplated that the loading device 370 can be spaced from the drill head assembly. In use, the loading device 370 can selectively move the drill rod 12 relative to the translation axis 15. In exemplary aspects, when the loading device 370 is used to load a drill rod 12 into a head spindle 500 as disclosed herein, it is contemplated that it is unnecessary for the loading device 370 to apply and hold torque against the drill rod 12.

In one aspect, and with reference to FIG. 14, the loading device 370 can comprise first and second base assemblies 380, 390. In this aspect, the first base assembly 380 can be spaced from the second base assembly 390 relative to the translation axis 15.

In another aspect, and with reference to FIG. 14, the loading device 370 can comprise a support platform 400 extending between and coupled to the first base assembly 380 and the second base assembly 390. In this aspect, the support platform 200 can have a longitudinal axis 202 substantially parallel to the translation axis 15. In exemplary aspects, the support platform 200 can be configured to support at least a portion of the drill rod 12 as the drill rod is moved relative to the translation axis 15.

In an additional aspect, and with reference to FIG. 14, the loading device 370 can comprise a driving assembly 410. In this aspect, the driving assembly 410 can comprise at least one driving roller 412. Each driving roller 412 can have a respective longitudinal axis 414. Optionally, in exemplary aspects, the longitudinal axis 414 of each driving roller 412 can be substantially perpendicular to the translation axis 15. In operation, each driving roller 412 can be configured for rotation about its longitudinal axis 414. In exemplary aspects, it is contemplated that each driving roller 412 can comprise a flexible material that is configured to also provide a surface for frictional engagement with a drill rod. Optionally, in these aspects, the driving roller 412 can comprise urethane. In one exemplary aspect, the driving roller 412 can comprise carbides that are configured to frictionally engage a drill rod while minimizing damage to the drill rod. In a further exemplary aspect, the driving roller 412 can comprise urethane and carbides.

In a further aspect, and with reference to FIG. 14, the driving assembly 410 can further comprise at least one drive assembly 415. In this aspect, each drive assembly 415 can be positioned in operative communication with a respective driving roller 412. It is contemplated that each drive assembly 415 can be configured for selective activation to selectively rotate a respective driving roller 412. In exemplary aspects, each drive assembly 415 can be a hydraulic drive assembly. However, it is contemplated that the drive assembly 415 can be any conventional type of drive assembly, such as, for example and without limitation, an electric drive assembly, a pneumatic drive assembly, or a manually-powered drive assembly.

In still another aspect, and with reference to FIG. 14, the driving assembly 410 can further comprise at least one guide roller 420. In this aspect, each guide roller can have a respective longitudinal axis 422. Optionally, in exemplary aspects, the longitudinal axis 422 of each guide roller 420 can be substantially perpendicular to the translation axis 15 and substantially parallel to the longitudinal axis 414 of each respective driving roller 412. In an additional aspect, the at least one driving roller 412 and the at least one guide roller 420 can cooperate to define a receiving space 425. In this aspect, the receiving space 425 can be configured to receive at least a portion of the drill rod 12.

In use, the at least one driving roller 412 and the at least one guide roller 420 can be configured for engagement with the drill rod 12 when at least a portion of the drill rod is received within the receiving space 425. When at least a portion of the drill rod 12 is received within the receiving space 425, rotation of the at least one driving roller 412 in a first direction can be configured to advance the drill rod toward the drill head assembly relative to the translation axis 15. In further aspects, it is contemplated that rotation of the at least one driving roller 412 in a second direction opposite the first direction can be configured to move the drill rod 12 away from the drill head assembly relative to the translation axis 15 (such as, for example, to retract a drill rod from the drill head assembly).

It is contemplated that the loading device 370 can optionally further comprise means for adjusting the axial position of the at least one driving roller 412 relative to a transverse axis that is perpendicular to both the longitudinal axis 414 of the at least one driving roller and the translation axis 15. It is further contemplated that the loading device 370 can optionally further comprise means for adjusting the axial position of the at least one guide roller 420 relative to the transverse axis. It is contemplated that the means for adjusting the axial position of the at least one driving roller 412 and the means for adjusting the axial position of the at least one guide roller 420 can comprise any conventional motor that is operatively coupled to a conventional power source, including, for example and without limitation, a hydraulic or electronic power source.

Optionally, in exemplary aspects, and as shown in FIG. 14, the loading assembly 370 can further comprise at least one screen 430 secured to at least one of the first and second base assemblies 380, 390. In these aspects, it is contemplated that the screen can be secured to the first and/or second base assemblies 380, 390 to shield operators of the loading assembly 370 from contact with a drill rod 12 positioned within the support platform 400 or the receiving space 425.

Optionally, in exemplary aspects, the support platform 400 can be operatively secured to the first and second base assemblies 380, 390 by at least one fastener. In these aspects, it is contemplated that the fasteners can be selectively removed to permit disassembly and transport of individual components of the loading assembly 370. It is further contemplated that the fasteners can be selectively positioned to permit efficient assembly of the loading assembly 370. In exemplary aspects, the support platform 400 can optionally be foldable or otherwise collapsible to permit disassembly and transport of the support platform. Optionally, in these aspects, the support platform 400 can define at least one seam corresponding to a fold location of the support platform. Optionally, the at least one seam can comprise a plurality of seams spaced relative to the longitudinal axis 402 of the support platform 400.

Optionally, in exemplary aspects, the first and second base assemblies 380, 390 can comprise respective cross bars 385, 395. In these aspects, it is contemplated that the first base assembly 380 can comprise a plurality of legs 387 extending downwardly from the cross bar 385, and the second base assembly 390 can comprise a plurality of legs 397 extending downwardly from the cross bar 385. Optionally, it is contemplated that the cross bars 385 and 395 can be configured for engagement with respective end portions of the support platform 400, as shown in FIG. 15.

In some exemplary aspects, and as shown in FIG. 14, the first and second base assemblies 380, 390 can be provided with respective brackets that are configured to engage spaced pairs of legs 387 of the base assemblies such that a portion of each bracket extends laterally away from the base assemblies by a selected distance. In these aspects, it is contemplated that the portions of the brackets that extend from the base assemblies can cooperate to support a core barrel assembly when the core barrel assembly is retrieved from a drill hole while the core barrel assembly contains a core sample.

In other exemplary aspects, it is contemplated that the height of the first and second base assemblies 380, 390 can be selectively adjustable using conventional means. In one non-limiting example, the legs 387 can comprise first and second leg portions, with the second leg portion configured for telescopic movement relative to the first leg portion, and each leg portion defining a plurality of axially spaced openings for receiving a locking pull pin (or other fastener) to lock the second leg portion relative to the first leg portion in the manner known in the art.

Drill Rod Handling Systems

Upon engagement between the loading device 70, 170, 370 and the drill rod 12, it is contemplated that the longitudinal axis 14 of the drill rod can be substantially parallel to the translational axis 15. As disclosed herein, it is contemplated that the loading device 70, 170, 370 can be configured to permit movement of the drill rod 12 relative to the translation axis 15 but restrict rotation of the drill rod relative to the translation axis. In use, the drill head assembly 10 can be configured to receive the drill rod 12 from the loading device 70 in an operative position.

In exemplary aspects, the drill rod handling system 150 can comprise a control assembly 120 configured to permit user-control of at least one of the drill head assembly 10 and the loading device 70, 170, 370. In these aspects, it is contemplated that the control assembly 120 can be positioned in operative communication with at least one of the drill head assembly 10 and the loading device 70, 170, 370. In some aspects, the control assembly 120 can be positioned in operative communication with both the drill head assembly 10 and the loading device 70, 170, 370. In one exemplary aspect, the control assembly 120 can be positioned in operative communication with the cradle 20 to effect movement of the cradle as disclosed herein. In another exemplary aspect, the control assembly 120 can be positioned in operative communication with at least one of: means for driving the lever 112, means for selectively driving the at least one support roller 92 in opposing directions, means for selectively driving the at least one clamping roller 102 in opposing directions, means for adjusting the axial position of the support assembly 90 relative to the transverse axis 72, means for adjusting the axial position of the clamping assembly 100 relative to the transverse axis 72, means for adjusting the axial position of the at least one driving roller relative to a transverse axis that is substantially perpendicular to the longitudinal axis 414 of the driving roller and to the translation axis 15, means for adjusting the axial position of the at least one guide roller relative to the transverse axis, and the drive assembly 415. It is contemplated that the control assembly 120 can be configured to permit selective control of these various control means. As shown in FIG. 15, in exemplary aspects, the control assembly can comprise a control panel 122 that is configured for selective pivotal movement relative to the remainder of the control assembly 120. In these aspects, the control assembly 120 can comprise a pivotal connection 124 as is known in the art to permit selective movement of the control panel. It is contemplated that selective pivotal movement of the control panel 122 can allow an operator of the drill head assembly 10 to orient his or her body in an optimal position to both access the control panel 122 and see the progress of ongoing operations.

Additionally, as further disclosed herein, it is contemplated that the control assembly 150 can be configured cooperate with a plurality of sensors to control sequential axial and pivotal movement of a cradle of a drill head assembly as disclosed herein.

It is contemplated that the control assembly 120 can comprise a conventional computer having a memory and a processor in operative communication with one another. It is further contemplated that the computer can have any conventional user interface. It is still further contemplated that the computer can be positioned in operative communication with the drill head assembly 10 and/or the loading device 70, 170 using any conventional communication means, including both wired communication means and wireless communication means.

In additional aspects, the drill rod handling system 150 can optionally comprise a hoist as is known in the art. In further aspects, the drill rod handling system 150 can comprise a foot clamp, as is known in the art, for preventing axial and rotational movement of a drill rod within a drill hole. In still further aspects, the drill rod handling system 150 can optionally comprise a Kelly rod as is conventionally known in the art. In these aspects, it is contemplated that the loading device 70 disclosed herein can be used to translate drill shafts toward and away from the Kelly rod as further disclosed herein.

General Drilling Methods

In exemplary aspects, a drilling method can comprise engaging a drill rod with the loading device. In these aspects, the drilling method can further comprise moving the cradle of the drill head assembly between the first position and the second position. It is contemplated that the drilling method can further comprise advancing the drill rod relative to the translation axis such that a portion of the drill rod is securely threaded onto an end of a Kelly rod positioned within the opening of the chuck of the drill head assembly. More particularly, it is contemplated that the Kelly rod can be gripped by the chuck, and a male thread of the Kelly rod can be exposed below the drill head assembly, thereby permitting engagement between the thread of the Kelly rod and the new drill rod (such that the new drill rod is positioned in the operative position).

In other exemplary aspects, the drilling method does not require the use of a Kelly rod. In these aspects, a drilling method can comprise engaging a drill rod with a loading device as disclosed herein. In these aspects, the drilling method can further comprise moving the cradle of the drill head assembly between the first position and the second position. It is contemplated that the drilling method can further comprise advancing the drill rod relative to the translation axis such that a portion of the drill rod is securely received within an inwardly tapered head spindle of the chuck without the use of a Kelly rod.

Exemplary methods for adding a drill rod, tripping a drill rod out of a drill hole, and tripping a drill rod into a drill hole are described below. It is contemplated that wireline operations conducted using the disclosed drill rod handling system can be substantially unchanged relative to conventional wireline operations conducted using known drilling systems.

An Exemplary Method for Adding a Drill Rod (with Kelly Rod)

In exemplary applications, a drill rod can be added to a drill string during drilling operations. In one aspect, the drill head assembly can continue drilling action (rotation and feeding) until the drill approaches the bottom of its stroke, at which point the foot clamp can be closed to hold the drill string for formation of a joint. A gear shift of the drill head assembly can be adjusted as required to make the joint, if needed. Upon rotation of the drill head, the joint can be formed at the bottom of a Kelly rod. The gear shift of the drill head assembly can then be adjusted to shift the gears from the position used to form the joint. The drill head can be fed upwardly to disengage the inner and outer threads of the drill rod. The drill head can then be shifted laterally as disclosed herein such that the drill head is substantially laterally aligned with the clamping axis. After lateral shifting is completed, the drill head can be tilted as required such that the angular orientation of the drill head substantially matches the angular orientation of the translation axis of the loading device, and the drill head can be fed downwardly as needed for axial alignment with the translation axis.

At this point, a worker can add a rod to the loading device such that the rod is substantially aligned with the translation axis. The clamping assembly can then be operated to grip the rod and then axially advance the rod along the translation axis toward the Kelly rod.

After axial advancement of the rod, the drill head can rotate to form a joint between the Kelly rod and the new rod. Optionally, in some aspects, upon opening of the chuck, the clamping assembly can be operated to advance the joined rod elements along the translation axis until the rod elements are positioned within the head spindle. In these aspects, it is contemplated that the clamping assembly can disengage the rod elements, and the chuck can then close down to grip the rod elements.

The drill head can then be fed upwardly to accommodate the axial length of the joined rod elements (the Kelly rod and the new rod). The drill head can then be tilted such that the rod elements are substantially parallel to the drill mast. Finally, the drill head can be laterally shifted such that the joined rod elements are substantially aligned with a center line of the drill string. The drill head can then be fed downwardly to engage the threads of the rod elements with a drill rod already positioned within the drill hole and held in the foot clamp. The drill head can be rotated to form a joint between the new rod and the rod in the food clamp. Finally, the foot clamp can be opened to permit axial movement of the joined rod elements.

An Exemplary Method for Tripping a Rod Out of a Drill Hole (with Kelly Rod)

In additional exemplary applications, the disclosed drill rod handling system can be used to trip a drill rod out of a drill hole. Optionally, in these applications, the hoist of the drill rod handling system can be rotated to provide tension to a drill rod hoisting cable. The chuck and foot clamp can be opened to permit axial movement of the drill rod. The hoist can then be pulled as required to remove the drill rod from the hole such that the drill rod is positioned above the foot clamp. The foot clamp can be closed to secure the drill rod in a position suitable for breaking the joint between the drill rod and an adjoining rod element of the drill string. The drill head can then be fed such that the chuck is positioned above the foot clamp. For a 6 m drill rod, it is contemplated that the chuck should be positioned about 2.5 m above the foot clamp. The chuck can then be closed on the drill rod, and the drill head can be rotated to thereby break the lowest exposed joint of the drill rod.

The drill head can then be fed upwardly to disengage the inner and outer threads of the drill rod. The drill head can then be shifted laterally as disclosed herein such that the drill head is substantially laterally aligned with the clamping axis. After lateral shifting is completed, the drill head can be tilted as required (typically, upwardly) until the angular orientation of the drill head substantially matches the angular orientation of translation axis of the loading device. The drill head can then be fed downwardly to substantially align the drill head with the translation axis of the loading device.

The loading device can then engage the drill rod as disclosed herein, and the chuck of the drill head can be opened to permit axial movement of the drill rod. The loading device can be operated as required to translate the drill rod along the translation axis away from the head spindle. After the drill rod has exited the drill head, the chuck can be closed to grip the Kelly rod, and the drill head can be rotated to unthread and/or disengage a joint at the Kelly Rod. The loading device can continue translating the drill rod along the translation axis such that the box and pin are disengaged.

The rod can then be removed from the loading device. During removal of the rod from the loading device, the drill head can be fed upwardly to distance the drill head from the clamping assembly. The drill head can then be tilted downwardly until the head is substantially parallel with the drill mast. Following tilting of the drill head, the drill head can be shifted laterally as disclosed herein such that the drill head is substantially aligned with a center line of the drill string. The drill head can then be fed downwardly to engage the threads of the rod being added with the rod in the foot clamp. The drill head can then be rotated to form a joint between the rod being added and the rod in the foot clamp.

An Exemplary Method for Tripping a Rod into a Drill Hole (with Kelly Rod)

In exemplary applications, the drill rod handling system disclosed herein can be used to trip a drill rod into a drill hole. Initially, the foot clamp can be closed to hold the drill string in position for formation of a breaking joint. The chuck can be closed to grip the Kelly rod. The gears of the drill head can be shifted as required to prepare the drill head for formation of the breaking joint. The drill head can then be rotated to form a break joint at a bottom portion of the Kelly rod. The drill head can then be shifted out of its break-formation condition. The drill head can be fed upwardly to disengage the box and pin. The drill head can then be shifted laterally to substantially align with the translation axis of the loading device. The drill head can then be tilted to substantially align with the angular orientation of the translation axis of the loading device. The drill head can then be fed downwardly such that the chuck is substantially axially aligned with the translation axis of the loading device.

A helper can then position a drill rod within the receiving channel of the loading device such that the rod is substantially aligned with the translation axis. The loading device can then be operated to grip the drill rod and translate the drill rod along the translation axis toward the Kelly rod. The drill head can then be rotated to form a joint between the new drill rod and the Kelly rod. The chuck can then be opened, and the loading device can be operated to further advance the drill rod (and joined Kelly rod) into the spindle of the drill head.

The chuck can then be closed to grip the joined drill rod. The drill head can be fed upwardly to accommodate the combined axial length of the drill rod and the Kelly rod. The drill head can then be tilted such that the drill rod and Kelly rod are substantially parallel with the drill mast. After tilting of the drill head is complete, the drill head can be shifted laterally such that the drill head is substantially aligned with a center line of the drill string. The drill head can be fed downwardly to engage the threads of the new rod with a drill rod element positioned within the foot clamp. The drill head can then be rotated to make a joint between the new rod and the rod element in the foot clamp.

After formation of the joint between the new rod and the existing drill string, the hoist can be pulled and/or rotated to provide tension to the drilling cable. The chuck and foot clamp can then be opened to permit rod movement. The drill head can then be fed downwardly to the bottom of its stroke, and the hoist can be lowered to advance the drill string (including the newly joined drill rod) into the drill hole.

An Exemplary Method for Tripping a Rod Out of a Drill Hole (without Kelly Rod)

In additional exemplary applications, the disclosed drill rod handling system can be used to trip a drill rod out of a drill hole without the use of a Kelly rod or a hoist. With a top portion of the drill rod in the drill hole above the foot clamp (e.g., for 6 meter drill rods, at about 1 meter above the foot clamp), the chuck can be closed on the drill rod above the foot clamp. Then, the foot clamp can be opened to permit axial movement of the drill rod. The drill head can then feed the drill rod upwardly (e.g., for six meter drill rods, upwardly at about 3 meters) to pull a selected distance of the drill rod (e.g., for six meter drill rods, the next 3 meters of the drill rod) out of the drill hole. The foot clamp can be closed to secure the drill rod in a position suitable for breaking the joint between the drill rod and an adjoining rod element of the drill string. The chuck can then be opened, and the drill head can then feed the chuck downwardly such that the chuck is positioned around the lowest drill rod to be removed from the drill hole. The chuck can then be closed, and the foot clamp can be opened. The drill head can then feed the drill rod upwardly as needed, and the foot clamp can then be closed again. With the chuck and the foot clamp closed, the drill head can be rotated to thereby break the lowest exposed joint of the drill rod.

The drill head can then be fed upwardly to disengage the inner and outer threads of the drill rod. In some applications, this upward feeding action of the drill head can separate the box and pin. The drill head can then be shifted laterally as disclosed herein such that the drill head is substantially laterally aligned with the clamping axis, which generally corresponds to a center line of the loading device. After lateral shifting is completed, the drill head can be tilted as required (typically, upwardly) until the angular orientation of the drill head substantially matches the angular orientation of translation axis of the loading device. The drill head can then be fed downwardly to substantially align the drill head with the translation axis of the loading device.

The loading device can then engage the drill rod as disclosed herein, and the chuck of the drill head can be opened to permit axial movement of the drill rod. The loading device can be operated as required to translate the drill rod along the translation axis and pull the drill rod out of the head spindle of the chuck. After the drill rod has exited the drill head, the operator of the loading device can remove the rod from the loading device. In some applications, when the box and pin are not previously disengaged, the loading device can continue translating the drill rod along the translation axis such that the box and pin are disengaged.

During removal of the rod from the loading device, the drill head can be fed upwardly to distance the drill head from the loading device. The drill head can then be tilted downwardly until the head is substantially parallel with the drill mast. Following tilting of the drill head, the drill head can be shifted laterally as disclosed herein such that the drill head is substantially aligned with a center line of the drill string. The drill head can then be fed downwardly to engage the rod being added with the rod in the foot clamp. The drill head can then be rotated to form a joint between the rod being added and the rod in the foot clamp.

An Exemplary Method for Tripping a Rod into a Drill Hole (without Kelly Rod)

In other exemplary applications, the disclosed drill rod handling system can be used to trip a drill rod into a drill hole without the use of a Kelly rod or a hoist. With a top portion of a first drill rod in the drill hole above the foot clamp (e.g., for 6 meter drill rods, at about 1 meter above the foot clamp) and the drill head at the bottom of its stroke, the foot clamp can be closed to secure the first drill rod. Then, the chuck can be opened to allow the first drill rod to hang from the foot clamp. The drill head can then be fed upwardly to permit removal of the drill rod from the head spindle. To align the head spindle with a new rod in the loading device, the drill head can be shifted laterally, tilted upwardly, and fed downwardly as disclosed herein. The rollers of the loading device can be closed to grip a second drill rod, and the rollers can be selectively rotated to push the drill rod into the head spindle. The chuck can then be closed to grip the second drill rod. The drill head can be fed upwardly, tilted downwardly, shifted laterally, and then fed downwardly as disclosed herein to align the threads of the first and second drill rods. The drill head can be operatively coupled to a "make/break" switch, and upon activation of the "make/break" switch, the drill head can effect rotation of the first and second drill rods and apply sufficient torque to make a joint between the first and second drill rods. The foot clamp can then be opened, and the drill head can feed the first (lower) drill rod into the drill hole. The foot clamp can then be closed to secure the drill string in place. The chuck can be opened to allow the drill string to hang from the foot clamp. The drill head can be fed upwardly, and the chuck can be closed to grip a top portion of the second (higher) drill rod. The foot clamp can then be opened, and the drill head can be fed downwardly to lower the drill string into the drill hole.

Exemplary Aspects

In one exemplary aspect, a drill head assembly for securing a drill rod in an operative position is provided, the drill rod having a longitudinal axis, the drill head assembly operatively coupled to a drill mast, the drill mast having a longitudinal axis, the drill head assembly comprising: a cradle configured for movement relative to both the longitudinal axis of the drill mast and a transverse axis substantially perpendicular to the longitudinal axis of the drill mast; and a chuck operatively supported by the cradle, the chuck having a longitudinal axis and defining an opening, the opening being configured to securely receive a portion of a Kelly rod, the Kelly rod being configured for engagement with a drill rod such that the longitudinal axis of the drill rod is substantially axially aligned with the longitudinal axis of the chuck, wherein the cradle is configured for movement between a first position and a second position, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, and wherein, in the second position, the longitudinal axis of the chuck is substantially parallel to a surface of a drilling formation.

In another exemplary aspect, during movement of the cradle between the first and second positions, pivotal movement of the cradle is restricted until the completion of axial movement of the cradle relative to the transverse axis.

In another exemplary aspect, from the second position, the cradle is configured for sequential pivotal and then axial movement relative to the transverse axis to return to the first position.

In another exemplary aspect, during movement of the cradle from the second position to the first position, axial movement of the cradle relative to the transverse axis is restricted until the completion of pivotal movement of the cradle relative to the transverse axis.

In another exemplary aspect, in the second position, the cradle is axially spaced from the drill mast relative to the transverse axis.

In another exemplary aspect, the drill head assembly further comprises a plurality of sensors, wherein at least one sensor of the plurality of sensors is configured to detect the completion of axial movement of the cradle relative to the transverse axis, and wherein at least one sensor of the plurality of sensors is configured to detect the completion of pivotal movement of the cradle relative to the transverse axis.

In another exemplary aspect, the plurality of sensors comprises a plurality of proximity switches.

In another exemplary aspect, the at least one drive assembly comprises at least one hydraulic drive assembly, and the plurality of sensors comprises a plurality of hydraulic sequence valves.

In another exemplary aspect, the drill head assembly further comprises a first hydraulic cylinder operatively coupled to the cradle and positioned in communication with the plurality of hydraulic sequence valves, the hydraulic cylinder having a longitudinal axis substantially parallel to the transverse axis, wherein activation of the hydraulic cylinder is configured to effect axial movement of the cradle relative to the transverse axis.

In another exemplary aspect, the drill head assembly further comprises a second hydraulic cylinder operatively coupled to the cradle and positioned in communication with the plurality of hydraulic sequence valves, wherein activation of the hydraulic cylinder is configured to effect pivotal movement of the cradle relative to the transverse axis.

In another exemplary aspect, the drill head assembly further comprises a plurality of spaced guide bars operatively coupled to the cradle, each guide bar of the plurality of guide bars having a longitudinal axis substantially parallel to the transverse axis, wherein the cradle is configured for movement along the plurality of guide bars relative to the transverse axis, and wherein the plurality of guide bars are configured to support the cradle during axial and pivotal movement of the cradle relative to the transverse axis.

In additional exemplary aspects, a drill rod handling system is disclosed, comprising: a loading device configured to engage a drill rod, the drill rod having a longitudinal axis, wherein, upon engagement between the loading device and the drill rod, the longitudinal axis of the drill rod is substantially parallel to a translational axis; a drill mast having a longitudinal axis; and a drill head assembly configured to receive the drill rod from the loading device in an operative position, the drill head assembly operatively coupled to the drill mast, the drill head assembly comprising: a cradle configured for movement relative to both the longitudinal axis of the drill mast and a transverse axis substantially perpendicular to the longitudinal axis of the drill mast; and a chuck operatively supported by the cradle, the chuck having a longitudinal axis and defining an opening configured to receive a portion of the drill rod such that the longitudinal axis of the drill rod is substantially axially aligned with the longitudinal axis of the chuck, wherein the cradle is configured for movement between a first position and a second position, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, and wherein, in the second position, the longitudinal axis of the chuck is substantially perpendicular to the longitudinal axis of the drill mast, and wherein, when the cradle is in the second position, the longitudinal axis of the chuck is substantially axially aligned with the translational axis and the longitudinal axis of the drill rod.

In another exemplary aspect, during movement of the cradle of the drill head assembly from the first position to the second position, pivotal movement of the cradle is restricted until the completion of axial movement relative to the transverse axis.

In another exemplary aspect, the loading device is configured to permit movement of the drill rod relative to the translation axis but restrict rotation of the drill rod relative to the translation axis.

In another exemplary aspect, the loading device comprises: a base assembly having at least one horizontal roller, each horizontal roller having a respective longitudinal axis, wherein the longitudinal axis of each horizontal roller is substantially perpendicular to the translation axis; a support assembly secured to the base assembly, the support assembly having at least one support roller, each support roller of the at one support roller having a respective longitudinal axis, wherein the longitudinal axis of each support roller is substantially perpendicular to the translational axis and the longitudinal axis of each respective horizontal roller; and a clamping assembly spaced from the support assembly relative to a transverse axis, the transverse axis being substantially parallel to the longitudinal axis of each respective horizontal roller, the clamping assembly having at least one clamping roller configured for movement relative to the transverse axis between an open position and an engaged position, wherein the proximal, distal, support, and clamping rollers cooperate to define a receiving space, the receiving space being configured to receive at least a portion of the drill rod, and wherein, in the engaged position of the clamping roller, the horizontal, support, and clamping rollers are positioned in engagement with the drill rod.

In another exemplary aspect, the loading device comprises: a first base assembly; a second base assembly, the first base assembly being spaced from the second base assembly relative to the translation axis; a clamping assembly, comprising: a frame securely coupled to and positioned between the first and second base assemblies, the frame having a longitudinal axis substantially axially aligned with the translation axis; a carriage operatively coupled to the frame and configured for selective movement relative to the longitudinal axis of the frame; a vice assembly supported thereon the carriage, the vice assembly defining a central space configured to receive a portion of the drill rod, wherein the vice assembly is selectively adjustable to securely engage the drill rod in the operative position; a first shaft supported by the frame and oriented substantially perpendicularly to the translation axis; a second shaft supported by the frame and oriented substantially perpendicularly to the translation axis; and a chain positioned over the first and second shafts and defining a chain loop, the chain being securely coupled to the carriage, wherein the chain is operatively coupled to the first shaft such that: rotation of the first shaft in a first direction effects advancement of the chain loop in a corresponding direction and the carriage is advanced toward the second shaft relative to the translation axis, and rotation of the first shaft in an opposed, second direction effects advancement of the chain loop in a corresponding direction and the carriage is advanced toward the first shaft relative to the translation axis.

In another exemplary aspect, the loading device can comprise: a first base assembly; a second base assembly, the first base assembly being spaced from the second base assembly relative to the translation axis; a support platform extending between and coupled to the first base assembly and the second base assembly, the support platform having a longitudinal axis substantially parallel to the translation axis, the support platform being configured to support at least a portion of the drill rod as the drill rod is moved relative to the translation axis; and a driving assembly, comprising: at least one driving roller, each driving roller having a respective longitudinal axis, wherein the longitudinal axis of each driving roller is substantially perpendicular to the translation axis, and wherein each driving roller is configured for rotation about its longitudinal axis; at least one drive assembly, each drive assembly being positioned in operative communication with a respective driving roller, wherein each drive assembly is configured for selective activation to selectively rotate a respective driving roller; and at least one guide roller, each guide roller having a respective longitudinal axis, wherein the longitudinal axis of each guide roller is substantially perpendicular to the translation axis and substantially parallel to the longitudinal axis of each respective driving roller, wherein the at least one driving roller and the at least one guide roller cooperate to define a receiving space, the receiving space being configured to receive at least a portion of the drill rod, wherein the at least one driving roller and the at least one guide roller are configured for engagement with the drill rod when at least a portion of the drill rod is received within the receiving space, and wherein, when at least a portion of the drill rod is received within the receiving space, rotation of the at least one driving roller in a first direction is configured to advance the drill rod toward the drill head assembly.

In another exemplary aspect, the drill head assembly further comprises a gear box portion and a head spindle that spans between the gear box portion and the chuck of the drill head assembly, and the drill rod handling system further comprises a drill rod receiving assembly for receiving the drill rod, the drill rod receiving assembly having a longitudinal axis and being configured for positioning within the head spindle of the drill head assembly such that the longitudinal axis of the drill rod receiving assembly is substantially aligned with a longitudinal axis of the head spindle, the drill rod receiving assembly comprising: an elongate shaft having a first end, an opposed second end, an inner surface, and an outer surface, the inner surface of the elongate shaft defining a bore extending between the first and second ends of the elongate shaft, the first end of the elongate shaft defining a first opening in communication with the bore, the second end of the elongate shaft configured for receipt within the chuck of the drill head assembly; a receiving element configured for operative coupling to the gear box portion of the drill head assembly, the receiving element having a first end, an opposed inner surface, and an outer surface, the inner surface of the receiving element defining a bore extending between the first and second ends of the receiving element, the first end of the receiving element defining a first opening in communication with the bore, the second end of the receiving element defining a second opening in communication with the bore, wherein at least a portion of the inner surface of the receiving element is inwardly tapered moving from the first opening toward the second opening, and wherein the second end of the receiving element is operatively coupled to the first end of the elongate shaft such that the second opening of the receiving element is substantially aligned and in communication with the first opening of the elongate shaft; wherein, upon advancement of the drill rod from the first opening of the receiving element toward the second end of the elongate shaft, the inner surfaces of the receiving element and the elongate shaft are configured to cooperate to guide the drill rod to a desired orientation in which a longitudinal axis of the drill rod is substantially parallel to the longitudinal axis of the head spindle.

In another exemplary aspect, the drill rod receiving assembly further comprises a plate assembly, the plate assembly comprising: a first plate configured for circumferential engagement with the outer surface of the head spindle of the drill head; a second plate configured to circumferentially engage a portion of the outer surface of the receiving element proximate the second end of the receiving element; and means for securely coupling the first plate to the second plate to thereby stabilize the receiving element.

In another exemplary aspect, the drill rod receiving assembly further comprises a plurality of spacers, each spacer configured to circumferentially surround a portion of the outer surface of the elongate shaft and to maintain the spacing between the outer surface of the elongate shaft and an inner surface of the head spindle.

In other exemplary aspects, a loading device for engaging a drill rod moving relative to a translation axis is provided, the loading device comprising: a base assembly having at least one horizontal roller, each horizontal roller of the at least one horizontal roller having a respective longitudinal axis, wherein the longitudinal axis of each horizontal roller the at least one horizontal roller is substantially perpendicular to the translation axis; a support assembly secured to the base assembly, the support assembly having at least one support roller, each support roller of the at least one support roller having a respective longitudinal axis, wherein the longitudinal axis of the at least one support roller is substantially perpendicular to the translational axis and the longitudinal axis of each horizontal roller of the at least one horizontal roller, and a clamping assembly spaced from the support assembly relative to a transverse axis, the transverse axis being substantially parallel to the longitudinal axis of each horizontal roller of the at least one horizontal roller, the clamping assembly having at least one clamping roller configured for movement relative to the transverse axis between an open position and an engaged position, wherein the horizontal, support, and clamping rollers cooperate to define a receiving space, the receiving space being configured to receive at least a portion of the drill rod, and wherein, in the engaged position of the clamping roller, the horizontal, support, and clamping rollers are positioned in engagement with the drill rod.

In another exemplary aspect, in the engaged position of the at least one clamping roller, the horizontal, support, and clamping rollers are configured to permit movement of the drill rod relative to the translation axis but restrict rotation of the drill rod relative to the translation axis.

In another exemplary aspect, the loading device further comprises a lever, the lever having a lever arm, a lever support secured to the base assembly, and a coupling element coupled to the lever arm and the at least one clamping roller, the coupling element being pivotally coupled to the lever support, wherein the coupling element is configured for pivotal movement relative to the lever support.

In another exemplary aspect, selective pivotal movement of the coupling element effects movement of the clamping roller relative to the transverse axis.

In another exemplary aspect, the base assembly further comprises a cross-bar, and wherein the proximal and distal rollers are positioned on opposing sides of the cross-bar.

In another exemplary aspect, the base assembly further comprises a plurality of legs secured to the cross-bar.

In another exemplary aspect, the at least one clamping roller of the clamping assembly comprises a single clamping roller, wherein the at least one support roller of the support assembly comprises two support rollers, and wherein the single clamping roller is substantially axially centered between the two support rollers relative to the translation axis.

In another exemplary aspect, at least one of the lever support and the support assembly is selectively adjustable relative to the transverse axis.

In another exemplary aspect, the lever arm has a longitudinal axis, and wherein, in the open position of the at least one clamping roller, the longitudinal axis of the lever arm is substantially parallel to the transverse axis.

In another exemplary aspect, the at least one clamping roller is moveable from the open position to the engaged position upon application of a downward force to the lever arm.

In another exemplary aspect, in the engaged position of the at least one clamping roller, the longitudinal axis of the lever arm is angled downwardly relative to the transverse axis.

In another exemplary aspect, the proximal and distal rollers are positioned at substantially the same height.

In another exemplary aspect, the support and clamping rollers are positioned at substantially the same height.

In another exemplary aspect, the height of the base assembly is selectively adjustable.

In additional exemplary aspects, a drill rod handling system comprises: a loading device configured to engage a drill rod, the drill rod having a longitudinal axis, wherein, upon engagement between the loading device and the drill rod, the longitudinal axis of the drill rod is substantially parallel to a translational axis; a drill mast having a longitudinal axis; and a drill head assembly configured to receive the drill rod from the loading device in an operative position, the drill head assembly operatively coupled to the drill mast, the drill head assembly comprising: a cradle configured for movement relative to both the longitudinal axis of the drill mast and a transverse axis substantially perpendicular to the longitudinal axis of the drill mast; and a chuck operatively supported by the cradle, the chuck having a longitudinal axis and defining an opening, the opening being configured to securely receive a portion of a Kelly rod, the Kelly rod configured for engagement with a portion of the drill rod such that the longitudinal axis of the drill rod is substantially axially aligned with the longitudinal axis of the chuck, wherein the cradle is configured for movement between a first position and a second position, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, and wherein, in the second position, the longitudinal axis of the chuck is substantially perpendicular to the longitudinal axis of the drill mast, and wherein, when the cradle is in the second position, the longitudinal axis of the chuck is substantially axially aligned with the translational axis and the longitudinal axis of the drill rod.

In another aspect, the loading device is configured to permit movement of the drill rod relative to the translation axis but restrict rotation of the drill rod relative to the translation axis.

In further exemplary aspects, a drilling method comprises: engaging a drill rod with a loading device, the drill rod having a longitudinal axis, wherein, upon engagement between the loading device and the drill rod, the longitudinal axis of the drill rod is substantially parallel to a translational axis, wherein the loading device is configured to permit movement of the drill rod relative to the translation axis but restrict rotation of the drill rod relative to the translation axis; moving a cradle of a drill head assembly between a first position and a second position, the cradle being configured for movement relative to both a longitudinal axis of a drill mast and a transverse axis substantially perpendicular to the longitudinal axis of the drill mast, the drill head assembly further comprising a chuck operatively supported by the cradle, the chuck having a longitudinal axis and defining an opening, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, wherein, in the second position, the longitudinal axis of the chuck is substantially perpendicular to the longitudinal axis of the drill mast, and wherein, when the cradle is in the second position, the longitudinal axis of the chuck is substantially axially aligned with the translational axis and the longitudinal axis of the drill rod; and advancing the drill rod relative to the translation axis such that a portion of the drill rod is securely positioned within the opening of the chuck of the drill head assembly.

In exemplary aspects, during movement of the cradle of the drill head assembly from the first position to the second position, pivotal movement of the cradle is restricted until the completion of axial movement relative to the transverse axis.

In still further exemplary aspects, a loading device is provided for engaging a drill rod moving relative to a translation axis. In these aspects, the loading device comprises: a first base assembly; a second base assembly, the first base assembly being spaced from the second base assembly relative to the translation axis; a clamping assembly, comprising: a frame securely coupled to and positioned between the first and second base assemblies, the frame having a longitudinal axis substantially axially aligned with the translation axis; a carriage operatively coupled to the frame and configured for selective movement relative to the longitudinal axis of the frame; a vice assembly supported thereon the carriage, the vice assembly defining a central space configured to receive a portion of the drill rod, wherein the vice assembly is selectively adjustable to securely engage the drill rod in an operative position; a first shaft supported by the first base assembly and oriented substantially perpendicularly to the translation axis; a second shaft supported by the second base assembly and oriented substantially perpendicularly to the translation axis; and a chain positioned over the first and second shafts and defining a chain loop, the chain being securely coupled to the carriage, wherein the chain is operatively coupled to the first shaft such that: rotation of the first shaft in a first direction effects advancement of the chain loop in a corresponding direction and the carriage is advanced toward the second shaft relative to the translation axis, and rotation of the first shaft in an opposed, second direction effects advancement of the chain loop in a corresponding direction and the carriage is advanced toward the first shaft relative to the translation axis.

In still further exemplary aspects, a loading device for selectively moving a drill rod relative to a translation axis is disclosed, the loading device being spaced from a drill head assembly and comprising: a first base assembly; a second base assembly, the first base assembly being spaced from the second base assembly relative to the translation axis; a support platform extending between and coupled to the first base assembly and the second base assembly, the support platform having a longitudinal axis substantially parallel to the translation axis, the support platform being configured to support at least a portion of the drill rod as the drill rod is moved relative to the translation axis; and a driving assembly, comprising: at least one driving roller, each driving roller having a respective longitudinal axis, wherein the longitudinal axis of each driving roller is substantially perpendicular to the translation axis, and wherein each driving roller is configured for rotation about its longitudinal axis; at least one drive assembly, each drive assembly being positioned in operative communication with a respective driving roller, wherein each drive assembly is configured for selective activation to selectively rotate a respective driving roller; and at least one guide roller, each guide roller having a respective longitudinal axis, wherein the longitudinal axis of each guide roller is substantially perpendicular to the translation axis and substantially parallel to the longitudinal axis of each respective driving roller, wherein the at least one driving roller and the at least one guide roller cooperate to define a receiving space, the receiving space being configured to receive at least a portion of the drill rod, wherein the at least one driving roller and the at least one guide roller are configured for engagement with the drill rod when at least a portion of the drill rod is received within the receiving space, and wherein, when at least a portion of the drill rod is received within the receiving space, rotation of the at least one driving roller in a first direction is configured to advance the drill rod toward the drill head assembly.

In still further exemplary aspects, a drill rod handling system is disclosed, comprising: a loading device configured to selectively move a drill rod relative to a translation axis, the drill rod having a longitudinal axis, wherein, upon engagement between the loading device and the drill rod, the longitudinal axis of the drill rod is substantially parallel to a translational axis, wherein the loading device is configured to permit movement of the drill rod relative to the translation axis but restrict rotation of the drill rod relative to the translation axis; a drill mast having a longitudinal axis; and a drill head assembly configured to receive the drill rod from the loading device in an operative position, the drill head assembly operatively coupled to the drill mast, the drill head assembly comprising: a cradle configured for movement relative to both the longitudinal axis of the drill mast and a transverse axis substantially perpendicular to the longitudinal axis of the drill mast; and a chuck operatively supported by the cradle, the chuck having a longitudinal axis and a spindle, the spindle having an inner surface, a first end portion, an opposed second end portion, and a shaft extending between the first and second end portions, the first end portion defining a first opening, the second end portion defining a second opening, the spindle being configured to securely receive a portion of the drill rod through the first and second openings such that the longitudinal axis of the drill rod is substantially axially aligned with the longitudinal axis of the chuck, wherein at least a portion of the inner surface of the first end portion of the spindle is inwardly tapered moving from the first opening toward the shaft relative to the longitudinal axis of the chuck, wherein the cradle is configured for movement between a first position and a second position, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, and wherein, in the second position, the longitudinal axis of the chuck is substantially perpendicular to the longitudinal axis of the drill mast, and wherein, when the cradle is in the second position, the longitudinal axis of the chuck is substantially axially aligned with the translational axis and the longitudinal axis of the drill rod.

In further exemplary aspects, the loading device can comprise: a first base assembly; a second base assembly, the first base assembly being spaced from the second base assembly relative to the translation axis; a support platform extending between and coupled to the first base assembly and the second base assembly, the support platform having a longitudinal axis substantially parallel to the translation axis, the support platform being configured to support at least a portion of the drill rod as the drill rod is moved relative to the translation axis; and a driving assembly, comprising: at least one driving roller, each driving roller having a respective longitudinal axis, wherein the longitudinal axis of each driving roller is substantially perpendicular to the translation axis, and wherein each driving roller is configured for rotation about its longitudinal axis; at least one drive assembly, each drive assembly being positioned in operative communication with a respective driving roller, wherein each drive assembly is configured for selective activation to selectively rotate a respective driving roller; and at least one guide roller, each guide roller having a respective longitudinal axis, wherein the longitudinal axis of each guide roller is substantially perpendicular to the translation axis and substantially parallel to the longitudinal axis of each respective driving roller, wherein the at least one driving roller and the at least one guide roller cooperate to define a receiving space, the receiving space being configured to receive at least a portion of the drill rod, wherein the at least one driving roller and the at least one guide roller are configured for engagement with the drill rod when at least a portion of the drill rod is received within the receiving space, and wherein, when at least a portion of the drill rod is received within the receiving space, rotation of the at least one driving roller in a first direction is configured to advance the drill rod toward the drill head assembly.

In additional exemplary aspects, a drill rod receiving assembly for receiving a drill rod is disclosed, the drill rod receiving assembly having a longitudinal axis and being configured for positioning within a head spindle of a drill head such that the longitudinal axis of the drill rod receiving assembly is substantially aligned with a longitudinal axis of the head spindle, the head spindle spanning between a gear box portion and a chuck portion of the drill head, the drill rod receiving assembly comprising: an elongate shaft having a first end, an opposed second end, an inner surface, and an outer surface, the inner surface of the elongate shaft defining a bore extending between the first and second ends of the elongate shaft, the first end of the elongate shaft defining a first opening in communication with the bore, the second end of the elongate shaft configured for receipt within the chuck portion of the drill head; a receiving element configured for operative coupling to the gear box portion of the drill head, the receiving element having a first end, an opposed inner surface, and an outer surface, the inner surface of the receiving element defining a bore extending between the first and second ends of the receiving element, the first end of the receiving element defining a first opening in communication with the bore, the second end of the receiving element defining a second opening in communication with the bore, wherein at least a portion of the inner surface of the receiving element is inwardly tapered moving from the first opening toward the second opening, and wherein the second end of the receiving element is operatively coupled to the first end of the elongate shaft such that the second opening of the receiving element is substantially aligned and in communication with the first opening of the elongate shaft; wherein, upon advancement of the drill rod from the first opening of the receiving element toward the second end of the elongate shaft, the inner surfaces of the receiving element and the elongate shaft are configured to cooperate to guide the drill rod to a desired orientation in which a longitudinal axis of the drill rod is substantially parallel to the longitudinal axis of the head spindle.

In other exemplary aspects, the drill rod receiving assembly further comprises a plate assembly, wherein the plate assembly comprises: a first plate configured for circumferential engagement with the outer surface of the head spindle of the drill head; a second plate configured to circumferentially engage a portion of the outer surface of the receiving element proximate the second end of the receiving element; and means for securely coupling the first plate to the second plate to thereby stabilize the receiving element.

In further exemplary aspects, the drill rod receiving assembly further comprises a plurality of spacers, each spacer configured to circumferentially surround a portion of the outer surface of the elongate shaft and to maintain the spacing between the outer surface of the elongate shaft and an inner surface of the head spindle.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A drill head assembly for securing a drill rod in an operative position, the drill rod having a longitudinal axis, the drill head assembly operatively coupled to a drill mast, the drill mast having a longitudinal axis, the drill head assembly comprising:

a cradle configured for movement relative to both the longitudinal axis of the drill mast and a transverse axis substantially perpendicular to the longitudinal axis of the drill mast; and a chuck operatively supported by the cradle, the chuck having a longitudinal axis and defining an opening, the opening being configured to securely receive a portion of the drill rod such that the longitudinal axis of the drill rod is substantially axially aligned with the longitudinal axis of the chuck, wherein the cradle is configured for movement between a first position and a second position, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, wherein, in the second position, the longitudinal axis of the chuck is substantially perpendicular to the longitudinal axis of the drill mast, and wherein, during movement of the cradle between the first and second positions, pivotal movement of the cradle is restricted until the completion of axial movement relative to the transverse axis.

2. The drill head assembly of claim 1, wherein, from the second position, the cradle is configured for sequential pivotal and then axial movement relative to the transverse axis to return to the first position.

3. The drill head assembly of claim 2, wherein, during movement of the cradle from the second position to the first position, axial movement of the cradle relative to the transverse axis is restricted until the completion of pivotal movement of the cradle relative to the transverse axis.

4. The drill head assembly of claim 1, wherein, in the second position, the cradle is axially spaced from the drill mast relative to the transverse axis.

5. The drill head assembly of claim 1, further comprising a plurality of sensors, wherein at least one sensor of the plurality of sensors is configured to detect the completion of axial movement of the cradle relative to the transverse axis, and wherein at least one sensor of the plurality of sensors is configured to detect the completion of pivotal movement of the cradle relative to the transverse axis.

6. The drill head assembly of claim 5, wherein the plurality of sensors comprises a plurality of proximity switches.

7. The drill head assembly of claim 5, wherein the plurality of sensors comprises a plurality of hydraulic sequence valves.

8. The drill head assembly of claim 7, further comprising a first hydraulic cylinder operatively coupled to the cradle and positioned in communication with the plurality of hydraulic sequence valves, the hydraulic cylinder having a longitudinal axis substantially parallel to the transverse axis, wherein activation of the hydraulic cylinder is configured to effect axial movement of the cradle relative to the transverse axis.

9. The drill head assembly of claim 8, further comprising a second hydraulic cylinder operatively coupled to the cradle and positioned in communication with the plurality of hydraulic sequence valves, wherein activation of the hydraulic cylinder is configured to effect pivotal movement of the cradle relative to the transverse axis.

10. The drill head assembly of claim 1, further comprising a plurality of spaced guide bars operatively coupled to the cradle, each guide bar of the plurality of guide bars having a longitudinal axis substantially parallel to the transverse axis, wherein the cradle is configured for movement along the plurality of guide bars relative to the transverse axis, and wherein the plurality of guide bars are configured to support the cradle during axial and pivotal movement of the cradle relative to the transverse axis.

11. A drill rod handling system, comprising:

a loading device configured to engage a drill rod, the drill rod having a longitudinal axis, wherein, upon engagement between the loading device and the drill rod, the longitudinal axis of the drill rod is substantially parallel to a translational axis;

a drill mast having a longitudinal axis; and a drill head assembly configured to receive the drill rod from the loading device in an operative position, the drill head assembly operatively coupled to the drill mast, the drill head assembly comprising:

a cradle configured for movement relative to both the longitudinal axis of the drill mast and a transverse axis substantially perpendicular to the longitudinal axis of the drill mast; and a chuck operatively supported by the cradle, the chuck having a longitudinal axis and defining an opening configured to receive a portion of the drill rod such that the longitudinal axis of the drill rod is substantially axially aligned with the longitudinal axis of the chuck, wherein the cradle is configured for movement between a first position and a second position, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, and wherein, in the second position, the longitudinal axis of the chuck is substantially perpendicular to the longitudinal axis of the drill mast, wherein, when the cradle is in the second position, the longitudinal axis of the chuck is substantially axially aligned with the translational axis and the longitudinal axis of the drill rod, and wherein, during movement of the cradle of the drill head assembly from the first position to the second position, pivotal movement of the cradle is restricted until the completion of axial movement relative to the transverse axis.

12. The drill rod handling system of claim 11, wherein the loading device is configured to permit movement of the drill rod relative to the translation axis but restrict rotation of the drill rod relative to the translation axis.

13. The drill rod handling system of claim 12, wherein the loading device comprises:

a base assembly having at least one horizontal roller, each horizontal roller having a respective longitudinal axis, wherein the longitudinal axis of each horizontal roller is substantially perpendicular to the translation axis;

a support assembly secured to the base assembly, the support assembly having at least one support roller, each support roller of the at one support roller having a respective longitudinal axis, wherein the longitudinal axis of each support roller is substantially perpendicular to the translational axis and the longitudinal axis of each respective horizontal roller; and a clamping assembly spaced from the support assembly relative to a transverse axis, the transverse axis being substantially parallel to the longitudinal axis of each respective horizontal roller, the clamping assembly having at least one clamping roller configured for movement relative to the transverse axis between an open position and an engaged position, wherein the horizontal, support, and clamping rollers cooperate to define a receiving space, the receiving space being configured to receive at least a portion of the drill rod, and wherein, in the engaged position of the clamping roller, the horizontal, support, and clamping rollers are positioned in engagement with the drill rod.

14. The drill rod handling system of claim 12, wherein the loading device comprises:

a first base assembly;

a second base assembly, the first base assembly being spaced from the second base assembly relative to the translation axis;

a clamping assembly, comprising:

a frame securely coupled to and positioned between the first and second base assemblies, the frame having a longitudinal axis substantially axially aligned with the translation axis;

a carriage operatively coupled to the frame and configured for selective movement relative to the longitudinal axis of the frame;

a vice assembly supported thereon the carriage, the vice assembly defining a central space configured to receive a portion of the drill rod, wherein the vice assembly is selectively adjustable to securely engage the drill rod in the operative position;

a first shaft supported by the frame and oriented substantially perpendicularly to the translation axis;

a second shaft supported by the frame and oriented substantially perpendicularly to the translation axis; and a chain positioned over the first and second shafts and defining a chain loop, the chain being securely coupled to the carriage, wherein the chain is operatively coupled to the first shaft such that:

rotation of the first shaft in a first direction effects advancement of the chain loop in a corresponding direction and the carriage is advanced toward the second shaft relative to the translation axis, and rotation of the first shaft in an opposed, second direction effects advancement of the chain loop in a corresponding direction and the carriage is advanced toward the first shaft relative to the translation axis.

15. The drill rod handling system of claim 12, wherein the loading device comprises:

a first base assembly;

a second base assembly, the first base assembly being spaced from the second base assembly relative to the translation axis;

a support platform extending between and coupled to the first base assembly and the second base assembly, the support platform having a longitudinal axis substantially parallel to the translation axis, the support platform being configured to support at least a portion of the drill rod as the drill rod is moved relative to the translation axis; and a driving assembly, comprising:

at least one driving roller, each driving roller having a respective longitudinal axis, wherein the longitudinal axis of each driving roller is substantially perpendicular to the translation axis, and wherein each driving roller is configured for rotation about its longitudinal axis;

at least one drive assembly, each drive assembly being positioned in operative communication with a respective driving roller, wherein each drive assembly is configured for selective activation to selectively rotate a respective driving roller; and at least one guide roller, each guide roller having a respective longitudinal axis, wherein the longitudinal axis of each guide roller is substantially perpendicular to the translation axis and substantially parallel to the longitudinal axis of each respective driving roller, wherein the at least one driving roller and the at least one guide roller cooperate to define a receiving space, the receiving space being configured to receive at least a portion of the drill rod, wherein the at least one driving roller and the at least one guide roller are configured for engagement with the drill rod when at least a portion of the drill rod is received within the receiving space, and wherein, when at least a portion of the drill rod is received within the receiving space, rotation of the at least one driving roller in a first direction is configured to advance the drill rod toward the drill head assembly.

16. The drill rod handling system of claim 12, wherein the drill head assembly further comprises a gear box portion and a head spindle that spans between the gear box portion and the chuck of the drill head assembly, wherein the drill rod handling system further comprises a drill rod receiving assembly for receiving the drill rod, the drill rod receiving assembly having a longitudinal axis and being configured for positioning within the head spindle of the drill head assembly such that the longitudinal axis of the drill rod receiving assembly is substantially aligned with a longitudinal axis of the head spindle, the drill rod receiving assembly comprising:

an elongate shaft having a first end, an opposed second end, an inner surface, and an outer surface, the inner surface of the elongate shaft defining a bore extending between the first and second ends of the elongate shaft, the first end of the elongate shaft defining a first opening in communication with the bore, the second end of the elongate shaft configured for receipt within the chuck of the drill head assembly;

a receiving element configured for operative coupling to the gear box portion of the drill head assembly, the receiving element having a first end, an opposed inner surface, and an outer surface, the inner surface of the receiving element defining a bore extending between the first and second ends of the receiving element, the first end of the receiving element defining a first opening in communication with the bore, the second end of the receiving element defining a second opening in communication with the bore, wherein at least a portion of the inner surface of the receiving element is inwardly tapered moving from the first opening toward the second opening, and wherein the second end of the receiving element is operatively coupled to the first end of the elongate shaft such that the second opening of the receiving element is substantially aligned and in communication with the first opening of the elongate shaft;

wherein, upon advancement of the drill rod from the first opening of the receiving element toward the second end of the elongate shaft, the inner surfaces of the receiving element and the elongate shaft are configured to cooperate to guide the drill rod to a desired orientation in which a longitudinal axis of the drill rod is substantially parallel to the longitudinal axis of the head spindle.

17. The drill rod handling system of claim 16, wherein the drill rod receiving assembly further comprises a plate assembly, the plate assembly comprising:

a first plate configured for circumferential engagement with the outer surface of the head spindle of the drill head;

a second plate configured to circumferentially engage a portion of the outer surface of the receiving element proximate the second end of the receiving element; and means for securely coupling the first plate to the second plate to thereby stabilize the receiving element.

18. The drill rod handling system of claim 16, wherein the drill rod receiving assembly further comprises a plurality of spacers, each spacer configured to circumferentially surround a portion of the outer surface of the elongate shaft and to maintain the spacing between the outer surface of the elongate shaft and an inner surface of the head spindle.

19. A drilling method, comprising:

engaging a drill rod with a loading device, the drill rod having a longitudinal axis, wherein, upon engagement between the loading device and the drill rod, the longitudinal axis of the drill rod is substantially parallel to a translational axis, wherein the loading device is configured to permit movement of the drill rod relative to the translation axis but restrict rotation of the drill rod relative to the translation axis;

moving a cradle of a drill head assembly between a first position and a second position, the cradle being configured for movement relative to both a longitudinal axis of a drill mast and a transverse axis substantially perpendicular to the longitudinal axis of the drill mast, the drill head assembly further comprising a chuck operatively supported by the cradle, the chuck having a longitudinal axis and defining an opening, wherein, in the first position, the longitudinal axis of the chuck is substantially parallel to the longitudinal axis of the drill mast, wherein, from the first position, the cradle is configured for sequential axial and then pivotal movement relative to the transverse axis to reach the second position, wherein, in the second position, the longitudinal axis of the chuck is substantially perpendicular to the longitudinal axis of the drill mast, wherein, when the cradle is in the second position, the longitudinal axis of the chuck is substantially axially aligned with the translational axis and the longitudinal axis of the drill rod, and wherein, during movement of the cradle of the drill head assembly from the first position to the second position, pivotal movement of the cradle is restricted until the completion of axial movement relative to the transverse axis; and advancing the drill rod relative to the translation axis such that a portion of the drill rod is received within the chuck of the drill head assembly.

* * * * *